US006328150B1

(12) United States Patent
Hibari

(10) Patent No.: US 6,328,150 B1
(45) Date of Patent: Dec. 11, 2001

(54) COIN DISCRIMINATING APPARATUS

(75) Inventor: Eiko Hibari, Saitama (JP)

(73) Assignee: Laurel Bank Machines Co., Ltd., Tokyo (JP)

( * ) Notice: Subject to any disclaimer, the term of this patent is extended or adjusted under 35 U.S.C. 154(b) by 0 days.

(21) Appl. No.: 09/551,241

(22) Filed: Apr. 17, 2000

(30) Foreign Application Priority Data

Apr. 26, 1999 (JP) ..... 11-118277

(51) Int. Cl.[7] ..... G07D 5/08
(52) U.S. Cl. ..... 194/317; 194/328; 194/334
(58) Field of Search ..... 194/303, 328, 194/334, 317, 330

(56) References Cited

U.S. PATENT DOCUMENTS

| | | | | |
|---|---|---|---|---|
| 5,538,123 | | 7/1996 | Tsuji | 194/303 |
| 5,887,697 | * | 3/1999 | Takahashi et al. | 194/317 |
| 6,065,582 | * | 5/2000 | Seitz | 194/317 |
| 6,230,870 | * | 5/2001 | Levasseu et al. | 194/317 |

FOREIGN PATENT DOCUMENTS

| | | |
|---|---|---|
| 0 683 473 A | 11/1995 | (EP) . |
| 06 150104 A | 5/1994 | (JP) . |
| 8-36661 | 6/1996 | (JP) . |
| 09 097363 A | 4/1997 | (JP) . |
| 10 222716 A | 8/1998 | (JP) . |
| 00 48137 A | 8/2000 | (WO) . |

* cited by examiner

*Primary Examiner*—James R. Bidwell
(74) *Attorney, Agent, or Firm*—Frishauf, Holtz, Goodman, Langer & Chick, P.C.

(57) ABSTRACT

A coin discriminating apparatus includes a first light source for projecting light onto one surface of a coin being transported, a second light source for projecting light onto the other surface of a coin being transported, a first light detector for photoelectrically receiving light emitted from the first light source and reflected by the one surface of the coin and producing image pattern data of the one surface of the coin, a first pattern data memory for storing the image pattern data of the one surface of the coin produced by the first light detector, a second light detector for photoelectrically receiving light emitted from the second light source and reflected by the other surface of the coin and producing image pattern data of the other surface of the coin, a second pattern data memory for storing the image pattern data of the other surface of the coin produced by the second light detecting means, a reference data memory for storing reference data of coins of each denomination, a discriminator for comparing the image pattern data of the one surface of the coin with the reference data of coins of each denomination and comparing the image pattern data of the other surface of the coin with the reference data of coins of each denomination, thereby discriminating whether or not the coin is acceptable and the denomination of the coin. According to the thus constituted coin discriminating apparatus, it is possible to discriminate whether or not coins are acceptable and the denominations of coins with high accuracy even when coins has a common pattern on one side surface thereof but a different pattern on the other side surface thereof like Euro coins.

12 Claims, 24 Drawing Sheets

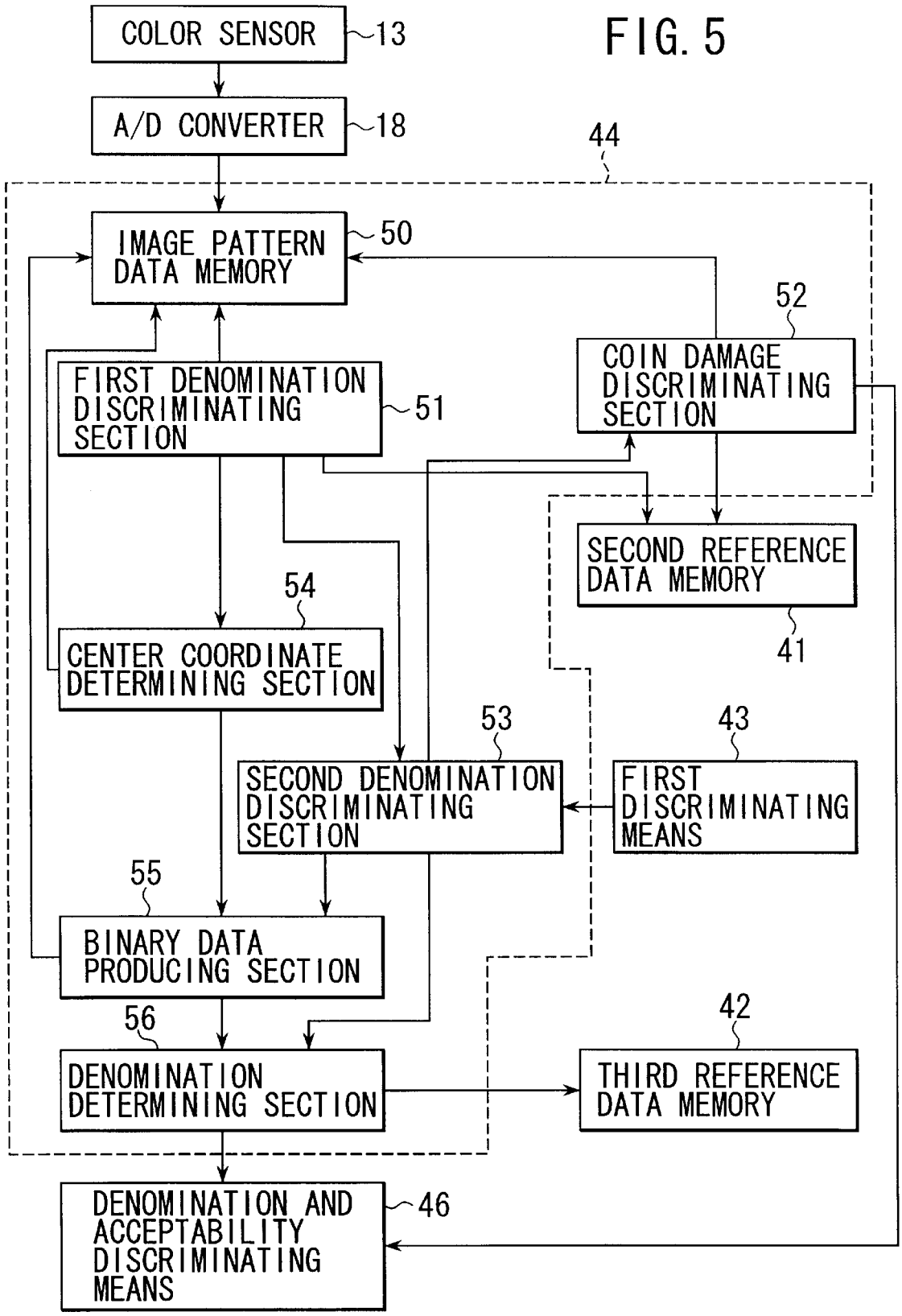
FIG. 5
COLOR SENSOR
13
A/D CONVERTER
18
44
IMAGE PATTERN DATA MEMORY
50
52
COIN DAMAGE DISCRIMINATING SECTION
FIRST DENOMINATION DISCRIMINATING SECTION
51
SECOND REFERENCE DATA MEMORY
41
54
CENTER COORDINATE DETERMINING SECTION
53
43
SECOND DENOMINATION DISCRIMINATING SECTION
FIRST DISCRIMINATING MEANS
55
BINARY DATA PRODUCING SECTION
56
42
DENOMINATION DETERMINING SECTION
THIRD REFERENCE DATA MEMORY
DENOMINATION AND ACCEPTABILITY DISCRIMINATING MEANS
46

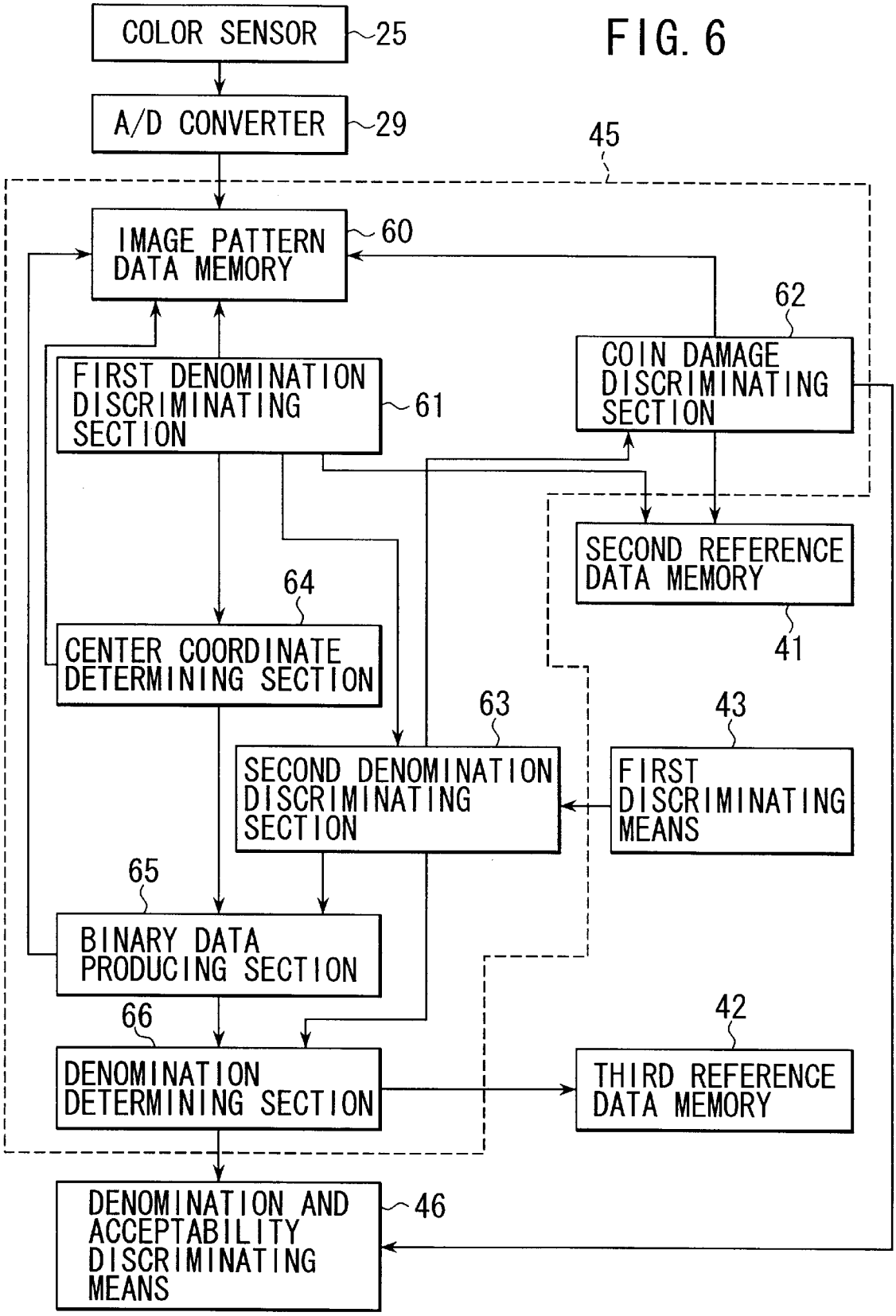
FIG. 6
COLOR SENSOR
25
A/D CONVERTER
29
45
IMAGE PATTERN DATA MEMORY
60
62
COIN DAMAGE DISCRIMINATING SECTION
FIRST DENOMINATION DISCRIMINATING SECTION
61
SECOND REFERENCE DATA MEMORY
41
64
CENTER COORDINATE DETERMINING SECTION
63
43
SECOND DENOMINATION DISCRIMINATING SECTION
FIRST DISCRIMINATING MEANS
65
BINARY DATA PRODUCING SECTION
66
42
DENOMINATION DETERMINING SECTION
THIRD REFERENCE DATA MEMORY
DENOMINATION AND ACCEPTABILITY DISCRIMINATING MEANS
46

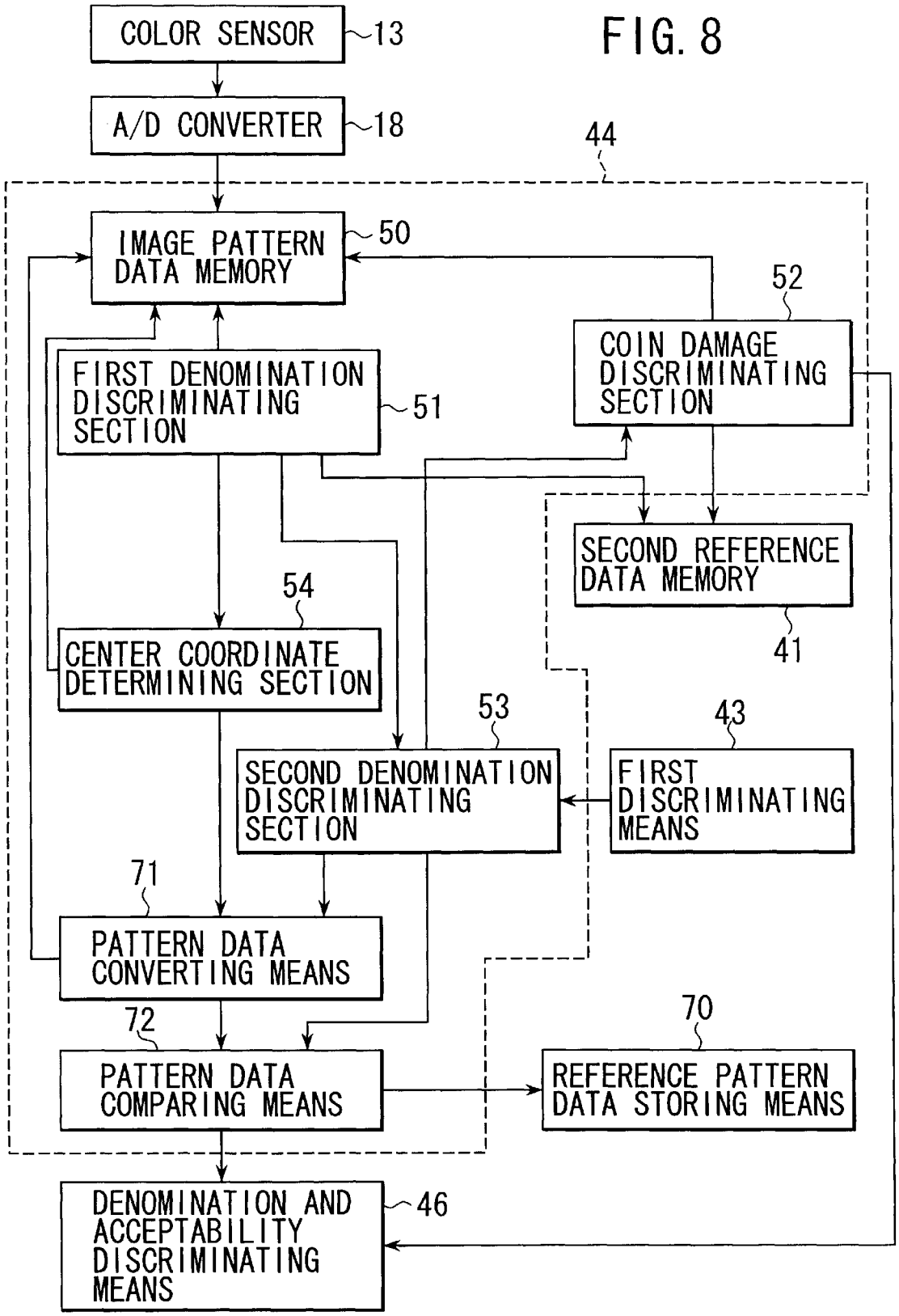
FIG. 8
COLOR SENSOR
13
A/D CONVERTER
18
44
IMAGE PATTERN DATA MEMORY
50
52
COIN DAMAGE DISCRIMINATING SECTION
FIRST DENOMINATION DISCRIMINATING SECTION
51
SECOND REFERENCE DATA MEMORY
41
54
CENTER COORDINATE DETERMINING SECTION
53
43
SECOND DENOMINATION DISCRIMINATING SECTION
FIRST DISCRIMINATING MEANS
71
PATTERN DATA CONVERTING MEANS
72
70
PATTERN DATA COMPARING MEANS
REFERENCE PATTERN DATA STORING MEANS
DENOMINATION AND ACCEPTABILITY DISCRIMINATING MEANS
46

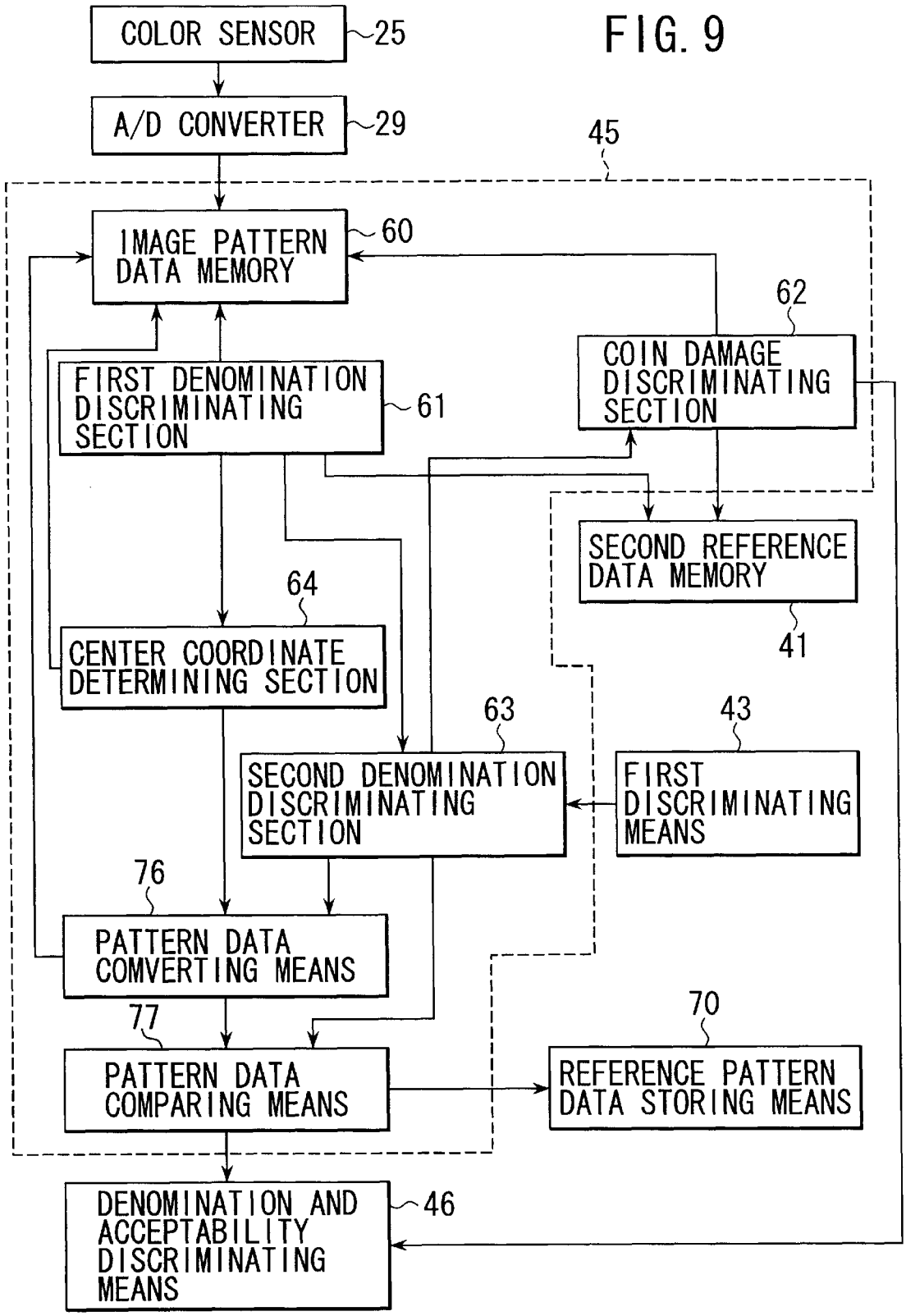
FIG. 9
COLOR SENSOR
25
A/D CONVERTER
29
45
IMAGE PATTERN DATA MEMORY
60
62
COIN DAMAGE DISCRIMINATING SECTION
FIRST DENOMINATION DISCRIMINATING SECTION
61
SECOND REFERENCE DATA MEMORY
41
64
CENTER COORDINATE DETERMINING SECTION
63
43
SECOND DENOMINATION DISCRIMINATING SECTION
FIRST DISCRIMINATING MEANS
76
PATTERN DATA COMVERTING MEANS
77
70
PATTERN DATA COMPARING MEANS
REFERENCE PATTERN DATA STORING MEANS
DENOMINATION AND ACCEPTABILITY DISCRIMINATING MEANS
46

COIN DISCRIMINATING APPARATUS

BACKGROUND OF THE INVENTION

The present invention relates to a coin discriminating apparatus and, in particular, to a coin discriminating apparatus for reliably discriminating whether or not coins are acceptable, whether or not coins are damaged to higher than a predetermined level and the denominations of coins by optically detecting coin surface patterns.

DESCRIPTION OF THE PRIOR ART

Conventionally, it is discriminated whether or not coins are acceptable, namely, whether coins are genuine or counterfeit and whether or not coins are current coins by detecting the diameter, material, thickness and the like of the coins. However, a coin discriminating apparatus for discriminating coins by optically detecting coin surface patterns has been recently proposed in order to improve the discriminating accuracy.

For example, Japanese Patent Application Laid-Open No. 8-36661 proposes a coin discriminating apparatus which is provided with a magnetic sensor disposed in a coin passage for detecting magnetic properties of coins, a number of light emitting elements such as light emitting diodes for projecting light onto coins being transported on a transparent passage portion formed in the coin passage from the lower portion and a CCD (Charge Coupled Device) for photoelectrically detecting light emitted from the light emitting elements and reflected by the surface of a coin and discriminates whether or not coins are acceptable and the denominations of coins based on image pattern data of coins photoelectrically detected by the CCD and digitized.

One side surface of Euro coins issued following by the currency unification in Europe is formed with a common pattern for each denomination and the other side surface thereof is formed with a pattern which differs depending upon countries issuing Euro coins. Therefore, when Euro coins are required to be classified in accordance with issuing countries of Euro coins in the Federal Banks or the like, since the above-mentioned coin discriminating apparatus discriminates coins by optically only surface patterns of one side of coins, it is impossible to classify Euro coins in accordance with issuing countries of Euro coins.

Further, since the above-mentioned coin discriminating apparatus discriminates coins by optically only surface patterns of one side of coins, even when the coin side surface whose pattern is not detected is damaged to higher than a predetermined level, such a coin cannot be discriminated as a damaged coin.

SUMMARY OF THE INVENTION

It is therefore an object of the present invention to provide a coin discriminating apparatus capable of discriminating whether or not coins are acceptable and the denominations of coins with high accuracy even when coins have a common pattern on one side surface thereof but a different pattern on the other side surface thereof like Euro coins.

Another object of the present invention is to provide a coin discriminating apparatus capable of discriminating whether or not coins are damaged to higher than a predetermined level with high accuracy.

The above and other objects of the present invention can be accomplished by a coin discriminating apparatus comprising a first light source for projecting light onto one surface of a coin being transported, a second light source for projecting light onto the other surface of a coin being transported, a first light detecting means for photoelectrically receiving light emitted from the first light source and reflected by the one surface of the coin and producing image pattern data of the one surface of the coin, first pattern data storing means for storing the image pattern data of the one surface of the coin produced by the first light detecting means, a second light detecting means for photoelectrically receiving light emitted from the second light source and reflected by the other surface of the coin and producing image pattern data of the other surface of the coin, second pattern data storing means for storing the image pattern data of the other surface of the coin produced by the second light detecting means, reference data storing means for storing reference data of coins of each denomination, discriminating means for comparing the image pattern data of the one surface of the coin stored in the first pattern data storing means with the reference data of coins of each denomination stored in the reference data storing means and comparing the image pattern data of the other surface of the coin stored in the second pattern data storing means with the reference data of coins of each denomination stored in the reference data storing means, thereby discriminating whether or not the coin is acceptable and the denomination of the coin.

According to the present invention, since the discriminating means discriminates whether or not a coin is acceptable and the denomination of the coin by comparing the image pattern data of the one surface of the coin stored in the first pattern data storing means with the reference data of coins of each denomination stored in the reference data storing means and comparing the image pattern data of the other surface of the coin stored in the second pattern data storing means with the reference data of coins of each denomination stored in the reference data storing means, even when coins such as Euro coins whose one surface pattern is common but whose the other surface pattern is different are to be discriminated, it is possible to reliably discriminate whether or not the coin is acceptable and the denomination of the coin and to sort Euro coins into those of each issuing country when Euro coins are required to be sorted by issuing country.

In a preferred aspect of the present invention, the first light detecting means and the second light detecting means are constituted as color sensor means capable of producing color image data, the reference data storing means stores reference chromaticity data and reference lightness data of coins of each denomination, and the discriminating means further includes first damage degree discriminating means for calculating chromaticity data and lightness data of the one surface of the coin based on R data, G data and B data corresponding to the primaries of light in the image pattern data of the one surface of the coin stored in the first pattern data storing means, comparing the thus calculated chromaticity data and lightness data with the reference chromaticity data and the reference lightness data of coins of each denomination stored in the reference data storing means and discriminating the damage degree of the one surface of the coin and second damage degree discriminating means for calculating chromaticity data and lightness data of the other surface of the coin based on R data, G data and B data corresponding to the primaries of light in the image pattern data of the other surface of the coin stored in the second pattern data storing means, comparing the thus calculated chromaticity data and lightness data with the reference chromaticity data and the reference lightness data of coins of each denomination stored in the reference data storing means and discriminating the damage degree of the other surface of the coin.

According to this preferred aspect of the present invention, since the discriminating means further includes first damage degree discriminating means for calculating chromaticity data and lightness data of the one surface of the coin based on R data, G data and B data corresponding to the primaries of light in the image pattern data of the one surface of the coin stored in the first pattern data storing means, comparing the thus calculated chromaticity data and lightness data with the reference chromaticity data and the reference lightness data of coins of each denomination stored in the reference data storing means and discriminating the damage degree of the one surface of the coin and second damage degree discriminating means for calculating chromaticity data and lightness data of the other surface of the coin based on R data, G data and B data corresponding to the primaries of light in the image pattern data of the other surface of the coin stored in the second pattern data storing means, comparing the thus calculated chromaticity data and lightness data with the reference chromaticity data and the reference lightness data of coins of each denomination stored in the reference data storing means and discriminating the damage degree of the other surface of the coin, it is possible to reliably discriminate whether or not the coin is damaged to higher than a predetermined level.

In another preferred aspect of the present invention, the reference data storing means is constituted so as to store the reference chromaticity data and the reference lightness data and the coin discriminating apparatus further includes a first white light source for emitting white light onto the one surface of the coin, a second white light source for emitting white light onto the other surface of the coin, first color sensor means for photoelectrically detecting light emitted from the first white light source and reflected by the one surface of the coin and producing color image data of the one surface of the coin, first color image data storing means for storing the color data of the one surface of the coin produced by the first color sensor means, second color sensor means for photoelectrically detecting light emitted from the second white light source and reflected by the other surface of the coin and producing color image data of the other surface of the coin, second color image data storing means for storing the color data of the other surface of the coin produced by the second color sensor means, and coin damage degree discriminating means, the coin damage degree discriminating means including first damage degree discriminating means for calculating chromaticity data and lightness data of the one surface of the coin based on R data, G data and B data corresponding to the primaries of light in the color image data of the one surface of the coin stored in the first color image data storing means, comparing the thus calculated chromaticity data and lightness data with the reference chromaticity data and the reference lightness data of coins of each denomination stored in the reference data storing means and discriminating the damage degree of the one surface of the coin and second damage degree discriminating means for calculating chromaticity data and lightness data of the other surface of the coin based on R data, G data and B data corresponding to the primaries of light in the image pattern data of the other surface of the coin stored in the second color image data storing means, comparing the thus calculated chromaticity data and lightness data with the reference chromaticity data and the reference lightness data of coins of each denomination stored in the reference data storing means and discriminating the damage degree of the other surface of the coin.

According to this preferred aspect of the present invention, since the coin damage degree discriminating means including first damage degree discriminating means for calculating chromaticity data and lightness data of the one surface of the coin based on R data, G data and B data corresponding to the primaries of light in the color image data of the one surface of the coin stored in the first color image data storing means, comparing the thus calculated chromaticity data and lightness data with the reference chromaticity data and the reference lightness data of coins of each denomination stored in the reference data storing means and discriminating the damage degree of the one surface of the coin and second damage degree discriminating means for calculating chromaticity data and lightness data of the other surface of the coin based on R data, G data and B data corresponding to the primaries of light in the image pattern data of the other surface of the coin stored in the second color image data storing means, comparing the thus calculated chromaticity data and lightness data with the reference chromaticity data and the reference lightness data of coins of each denomination stored in the reference data storing means and discriminating the damage degree of the other surface of the coin, it is possible to reliably discriminate whether or not the coin is damaged to higher than a predetermined level.

In a further preferred aspect of the present invention, the reference data storing means is constituted so as to store the reference chromaticity data and the reference lightness data and the coin discriminating apparatus further includes a first R component light source for emitting light of the R component onto the one surface of the coin, a first G component light source for emitting light of G component onto the one surface of the coin, a first B component light source for emitting light of the B component onto the one surface of the coin, first photosensor means for photoelectrically detecting light emitted from the first R component light source, the first G component light source and the first B component light source and reflected by the one surface of the coin and producing R image data, G image data and B image data of the one surface of the coin, first image data storing means for storing the R image data, the G image data and the B image data of the one surface of the coin produced by the first photosensor means, a second R component light source for emitting light of the R component onto the other surface of the coin, a second G component light source for emitting light of G component onto the other surface of the coin, a second B component light source for emitting light of the B component onto the other surface of the coin, second photosensor means for photoelectrically detecting light emitted from the second R component light source, the second G component light source and the second B component light source and reflected by the other surface of the coin and producing R image data, G image data and B image data of the other surface of the coin, second image data storing means for storing the R image data, the G image data and the B image data of the other surface of the coin produced by the second photosensor means, and coin damage degree discriminating means, the coin damage degree discriminating means including first damage degree discriminating means for calculating chromaticity data and lightness data of the one surface of the coin based on the R image data, the G image data and the B image data of the one surface of the coin stored in the first image data storing means, comparing the thus calculated chromaticity data and lightness data with the reference chromaticity data and the reference lightness data of coins of each denomination stored in the reference data storing means and discriminating the damage degree of the one surface of the coin and second damage degree discriminating means for calculating chromaticity data and lightness data of the other surface of the coin based on the R image data, the G image data and the B image data of the other surface of the coin stored in the second image data storing means, comparing the thus calculated chromaticity data and lightness data with the reference chromaticity data and the reference lightness data of coins of each denomination stored in the reference data storing means and discriminating the damage degree of the other surface of the coin.

According to this further preferred aspect of the present invention, since the coin damage degree discriminating means including first damage degree discriminating means for calculating chromaticity data and lightness data of the one surface of the coin based on the R image data, the G image data and the B image data of the one surface of the coin stored in the first image data storing means, comparing the thus calculated chromaticity data and lightness data with the reference chromaticity data and the reference lightness data of coins of each denomination stored in the reference data storing means and discriminating the damage degree of the one surface of the coin and second damage degree discriminating means for calculating chromaticity data and lightness data of the other surface of the coin based on the R image data, the G image data and the B image data of the other surface of the coin stored in the second image data storing means, comparing the thus calculated chromaticity data and lightness data with the reference chromaticity data and the reference lightness data of coins of each denomination stored in the reference data storing means and discriminating the damage degree of the other surface of the coin, it is possible to reliably discriminate whether or not the coin is damaged to higher than a predetermined level.

In a further preferred aspect of the present invention, the coin discriminating apparatus further includes magnetic sensor means disposed upstream of the first light source with respect to a direction of transportation of coins for detecting magnetic properties of coins, a reference magnetic data memory for storing reference magnetic data indicating the magnetic properties of coins of each denomination, and tentative denomination discriminating means for discriminating the denomination of a coin based on the reference magnetic data of coins of each denomination stored in the reference magnetic data memory and the magnetic properties of the coin detected by the magnetic sensor means, the reference data storing means storing reference image pattern data of coins of each denomination, the discriminating means including first discriminating means for discriminating the denomination of the coin based on the image pattern data of the one surface of the coin and second discriminating means for discriminating the denomination of the coin based on the image pattern data of the other surface of the coin, the first discriminating means including first denomination discriminating means for discriminating the denomination of the coin in accordance with diameter of the coin based on the image pattern data of the one surface of the coin stored in the first pattern data storing means and second denomination discriminating means for discriminating whether or not the coin is acceptable based on a result of discrimination made by the tentative denomination discriminating means and a result of discrimination made by the first denomination discriminating means, reading, based on the result of discrimination made by the tentative denomination discriminating means and the result of discrimination made by the first denomination discriminating means, the reference image pattern data of the corresponding denomination from the reference data storing means and comparing the thus read reference image pattern data with the image pattern data of the one surface of the coin stored in the first pattern data storing means, thereby discriminating the denomination of the coin, the second discriminating means including third denomination discriminating means for discriminating the denomination of the coin in accordance with diameter of the coin based on the image pattern data of the other surface of the coin stored in the second pattern data storing means and fourth denomination discriminating means for discriminating whether or not the coin is acceptable based on a result of discrimination made by the tentative denomination discriminating means and a result of discrimination made by the third denomination discriminating means, reading, based on the result of discrimination made by the tentative denomination discriminating means and the result of discrimination made by the third denomination discriminating means, the reference image pattern data of the corresponding denomination from the reference data storing means and comparing the thus read reference image pattern data with the image pattern data of the other surface of the coin stored in the second pattern data storing means, thereby discriminating the denomination of the coin.

According to this further preferred aspect of this present invention, the coin discriminating apparatus is constituted so that based on the result of the discrimination made by the tentative denomination discriminating means based on the magnetic properties of the coin and the result of discrimination made by the first denomination discriminating means in accordance with the diameter of the coin based on the image pattern data of one surface of the coin stored in the first pattern data storing means, the second denomination discriminating means of the first discriminating means reads the reference image pattern data of coins of the corresponding denomination from the reference data storing means and compares the thus read reference image pattern data with the image pattern data of the one surface of the coin stored in the first pattern data storing means, thereby discriminating the denomination of coin, and that based on the result of the discrimination made by the tentative denomination discriminating means based on the magnetic properties of the coin and the result of discrimination made by the third denomination discriminating means in accordance with the diameter of the coin based on the image pattern data of the other surface of the coin stored in second pattern data storing means, the fourth denomination discriminating means of the second discriminating means reads the reference image pattern data of coins of the corresponding denomination from the reference data storing means and compares the thus read reference image pattern data with the image pattern data of the other surface of the coin stored in the second pattern data storing means, thereby discriminating the denomination of coin. Therefore, it is possible to quickly compare the image pattern data of the one surface of the coin with the reference image pattern data of coins of the corresponding denomination and compare the image pattern data of the other surface of the coin with the reference image pattern data of coins of the corresponding denomination. Further, since whether or not the coin is acceptable and the denomination of the coin are discriminated based on the magnetic properties of the coin, the diameter of the coin and the patterns of both surfaces of the coin, the discrimination accuracy can be improved.

In a further preferred aspect of the present invention, the discriminating means further includes denomination discrimination means for discriminating, when the result of discrimination made by the second denomination discriminating means of the first discriminating means and the result of discrimination made by the fourth denomination discriminating means of the second discriminating means coincide with each other, that the denomination of coin agrees with the thus discriminated denomination and discriminating that the coin is unacceptable, when they do not coincide with each other.

According to this further preferred aspect of the present invention, since the denomination discrimination means discriminates whether or not the coin is acceptable and the denomination of the coin based on the result of discrimination made by the first discriminating means and the result of discrimination made by the second discriminating means, the discrimination accuracy can be improved. Specifically, for example, when the first discriminating means discriminates that the pattern data of one surface of the coin coincides with the pattern of the obverse surface of coins of a certain denomination and the second discriminating means discriminates that the pattern data of the other surface of the coin coincide with the pattern of the reverse surface of the coin of the denomination, or in the case where Euro coins are to be discriminated, only when one of the first discriminating means and the second discriminating means discriminates that a common pattern is formed on one side surface of the coin and the other of the first discriminating means and the second discriminating means discriminates that a pattern peculiar to an issuing country is formed on the other side surface of the coin, it is discriminated that the coin is acceptable and that the denomination of the coin agrees with the thus discriminated denomination. Therefore, the discrimination accuracy can be improved.

The above and other objects and features of the present invention will become apparent from the following description made with reference to the accompanying drawings.

BRIEF DESCRIPTION OF THE DRAWINGS

FIG. 5 is a block diagram of a second discriminating means.

FIG. 6 is a block diagram of a third discriminating means.

FIG. 8 is a block diagram of a second discriminating means.

FIG. 9 is a block diagram of a third discriminating means.

DESCRIPTION OF THE PREFERRED EMBODIMENTS

Figure 1:
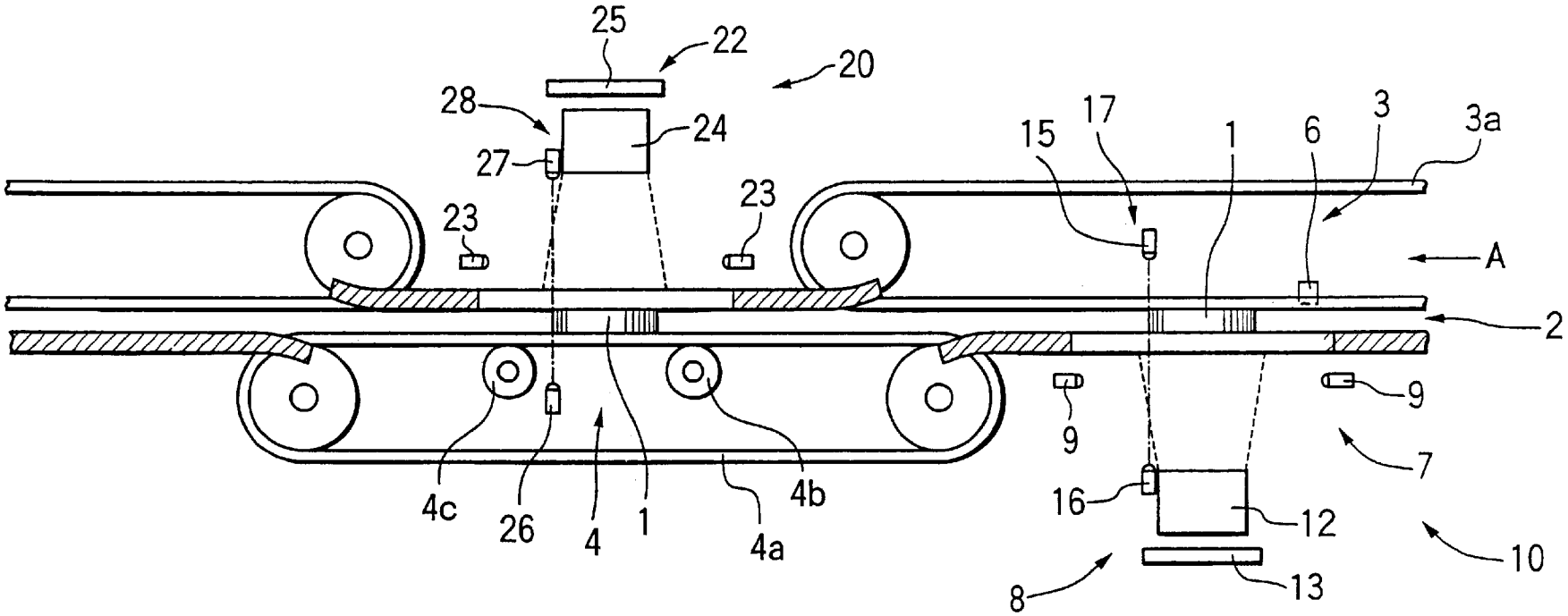
FIG. 1 is a schematic front view of a coin discriminating apparatus which is an embodiment of the present invention.

As shown in FIG. 1, a coin passage 2 through which coins 1 are transported is formed with a first transparent passage portion 3 and a second transparent passage portion 4 both made of glass, acrylic resin or the like.

Figure 2:
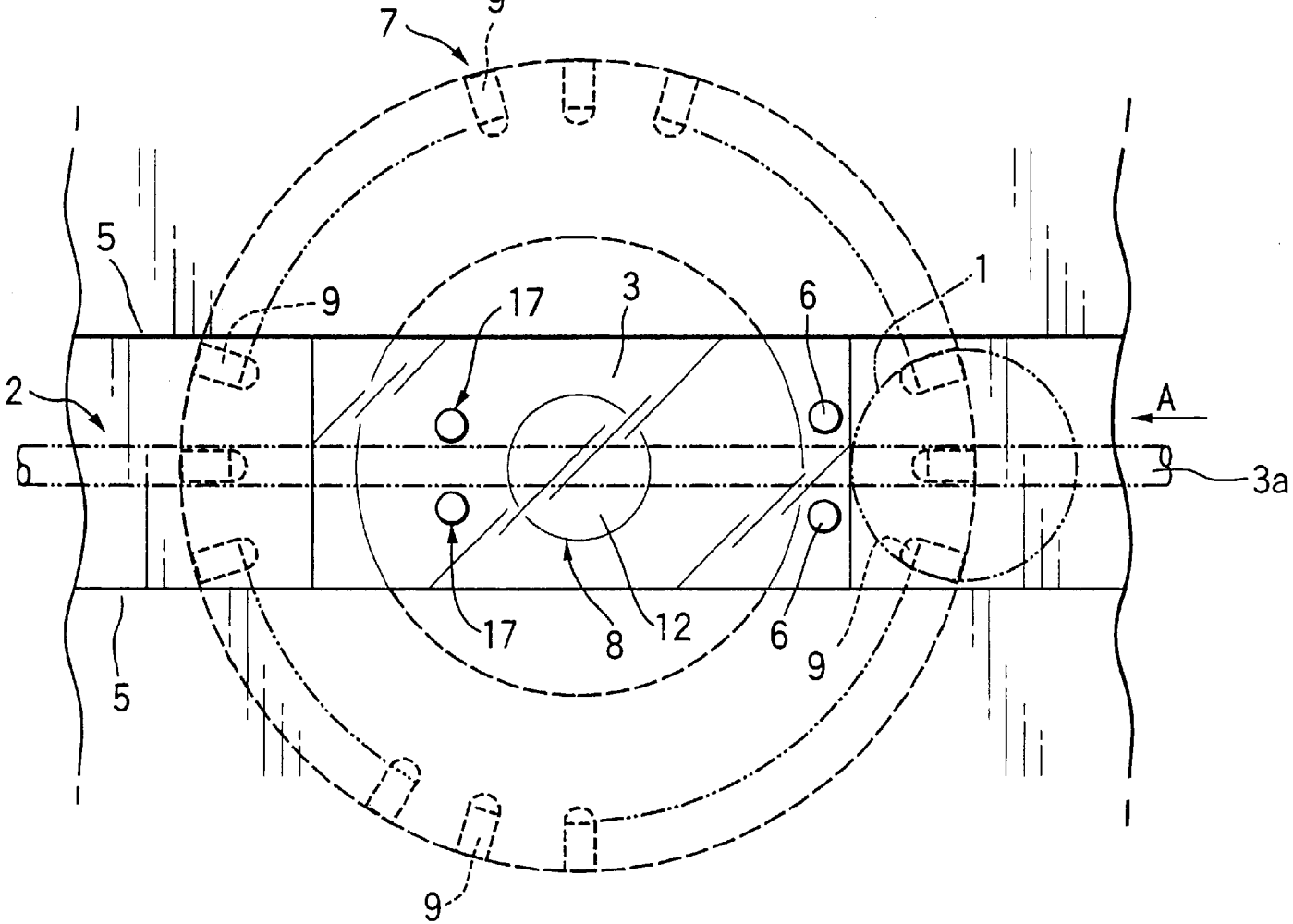
FIG. 2 is a schematic plan view of a first transparent passage portion.
Figure 3:
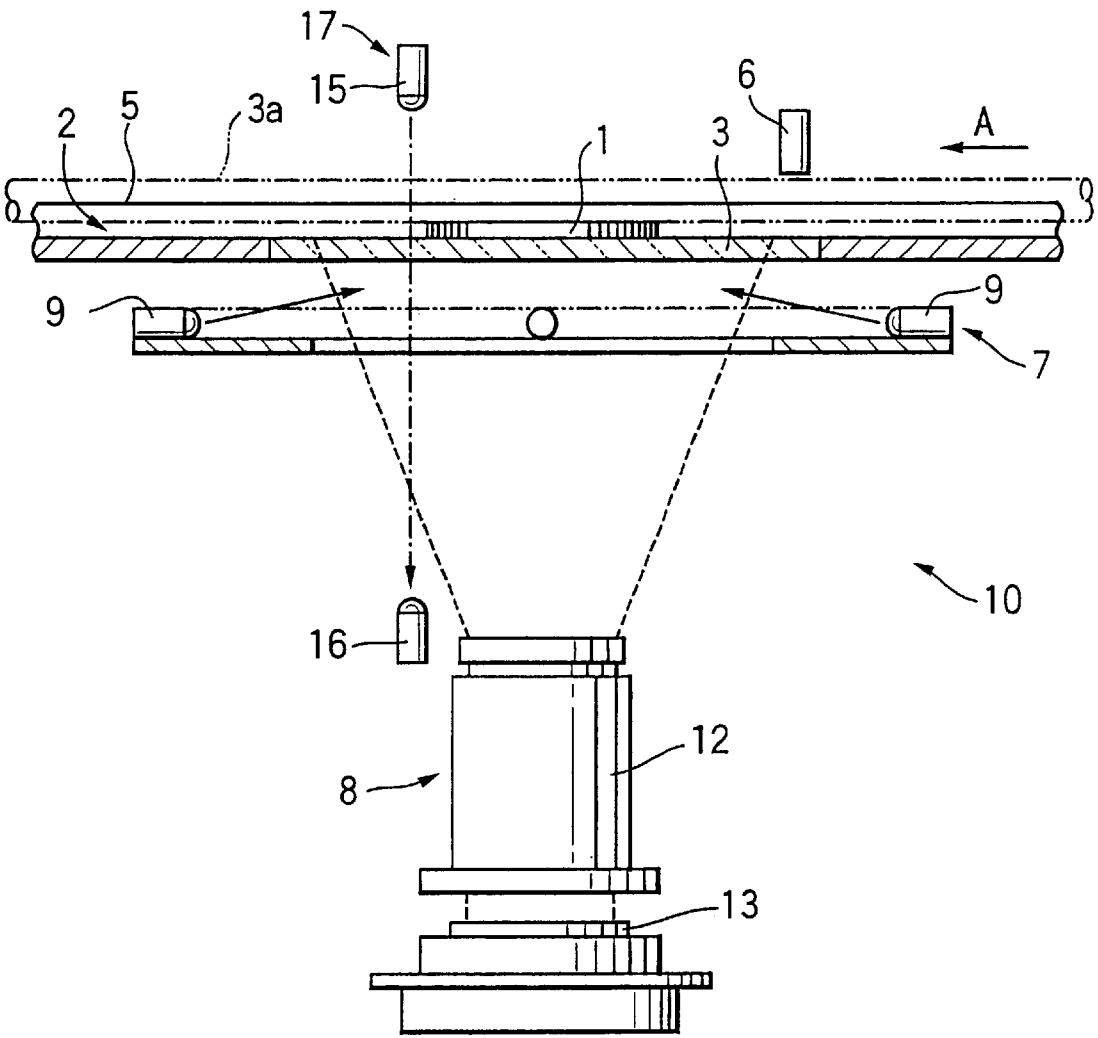
FIG. 3 is a schematic side view showing the details in the vicinity of a first transparent passage portion.

FIG. 2 is a schematic plan view of a first transparent passage portion and FIG. 3 is a schematic side view showing the details in the vicinity of a first transparent passage portion.

As shown in FIGS. 2 and 3, a coin 1 is pressed onto the surface of a coin passage 2 by a transporting belt 3*a* and fed to the first transparent passage portion 3 in the coin passage 2 along a pair of guide rails 5, 5 in the direction indicated by an arrow A. A pair of magnetic sensors 6, 6 are provided for detecting magnetic properties of the coin 1 upstream of the first transparent passage portion 3 with respect to the coin transporting direction. The coin 1 is fed onto the first transparent passage portion 3, while being pressed onto the upper surface of the first transparent passage portion 3 by the transporting belt 3*a*. Below the first transparent passage portion 3, a first light emitting means 7 is provided for emitting light toward the coin 1 passing through the first transparent passage portion 3 and a first image data producing means 8 is further provided below the first light emitting means 7 for receiving light emitted from the first light emitting means 7 and reflected by the coin 1 and producing image data. A first pattern data detection unit 10 is constituted by the first light emitting means 7 and the first image data producing means 8.

As shown in FIG. 2, the first light emitting means 7 is provided with a plurality of light emitting elements 9 such as light emitting diodes (LEDs) disposed on a circle whose center is at the center portion of the first transparent passage portion 3. Each light emitting element 9 is disposed in such a manner that the optical axis thereof is directed at a small angle with respect to the horizontal direction toward a predetermined point on a vertical axis passing through the center of a circle whose center coincides with the center portion of the first transparent passage portion 3, whereby light is projected onto the coin 1 passing through the first transparent passage portion 3 at a shallow angle with respect to the surface of the coin 1.

The first image data producing means 8 includes a lens system 12 disposed so that the optical axis thereof coincides with the vertical axis passing through the center of the circle whose center coincides with the center portion of the first transparent passage portion 3, a color sensor 13 disposed below the lens system 12 so that the focus point thereof is located on the upper surface of the first transparent passage portion 3 and adapted for photoelectrically detecting light emitted from the light emitting elements 9 and reflected by the surface of the coin 1, and an A/D converter (not shown) for converting image data of the lower surface of the coin 1 obtained by photoelectrically detecting by the color sensor 13 into digital signals, thereby producing digitized image data of the lower surface of the coin 1. In this embodiment, a two-dimensional CCD type color sensor is used as the color sensor 13.

On the immediately downstream side of the first image data producing means 8, two timing sensors 17, 17 each of which includes a light emitting element 15 and a light receiving element 16 are provided so that light emitted from the light emitting element 15 can be detected through the first transparent passage portion 3 by the light receiving element 16 and each is constituted so as to output a timing signal when the light receiving element 16 does not receive light emitted from the light emitting element 15. Each of the timing sensors 17 is disposed with respect to the first image data producing means 8 so that the center of the coin 1 is located at the center of the first transparent passage portion 3 when light emitted from the light emitting element 15 is blocked by the coin 1 being transported on the surface of the first transparent passage portion 3 and is not received by the light receiving element 16, thereby outputting a timing signal.

As shown in FIG. 1, a second transparent passage portion 4 is provided on the downstream side of the first transparent passage portion 3 and a second pattern data detection unit 20 is disposed above the second transparent passage portion 4. The coin 1 is transported while being pressed onto the lower surface of the second transparent passage portion 4 by a transporting belt. A plurality of back-up rollers 4*b*, 4*c* are provided in order to prevent the transporting belt 4*a* from being deflected downward due to the dead load thereof.

The second pattern data detection unit 20 includes a second light emitting means 21 disposed above the second transparent passage portion 4 for projecting light onto the coin 1 passing through the second transparent passage portion 4 and a second image data producing means 22 disposed above the second transparent passage portion 4 for receiving light emitted from the second light emitting means 21 and reflected by the coin 1 and producing image data. The second light emitting means 21 is constituted in a similar manner to the first light emitting means 7 except that it is disposed above the second transparent passage portion 4 and emits light downwardly and includes a plurality of light emitting elements 23 such as light emitting diodes (LEDs) arranged on the circle whose center coincides with the center portion of the second transparent passage portion 4. Each light emitting element 23 is disposed in such a manner that the optical axis thereof is directed at a small angle with respect to the horizontal direction toward a predetermined point on a vertical axis passing through the center of the circle whose center coincides with the center portion of the second transparent passage portion 4, whereby light is projected onto the coin 1 passing through the second transparent passage portion 4 at a shallow angle with respect to the surface of the coin 1.

The second image data producing means 22 includes a lens system 24 disposed so that the optical axis thereof coincides with the vertical axis passing through the center of the circle whose center coincides with the center portion of the second transparent passage portion 4, a color sensor 25 disposed above the lens system 12 so that the focus point thereof is located on the upper surface of the second transparent passage portion 4 and adapted for photoelectrically detecting light emitted from the light emitting elements 23 and reflected by the surface of the coin 1, and an A/D converter (not shown) for converting image data of the upper surface of the coin 1 obtained by photoelectrically detecting by the color sensor 25 into digital signals, thereby producing digitized image data of the upper surface of the coin 1. In this embodiment, a two-dimensional CCD type color sensor is used as the color sensor 25.

On the immediately downstream side of the second image data producing means, 22 two timing sensors 28, 28 each of which includes a light emitting element 26 and a light receiving element 27 are provided so that light emitted from the light emitting element 26 can be detected through the second transparent passage portion 4 by the light receiving element 27 and each is constituted so as to output a timing signal when the light receiving element 27 does not receive light emitted from the light emitting element 26. Each of the timing sensors 28 is disposed with respect to the second image data producing means 22 so that the center of the coin 1 is located at the center of the second transparent passage portion 4 when light emitted from the light emitting element 26 is blocked by the coin 1 being transported on the surface of the second transparent passage portion 4 and is not received by the light receiving element 27, thereby outputting a timing signal.

Figure 4:
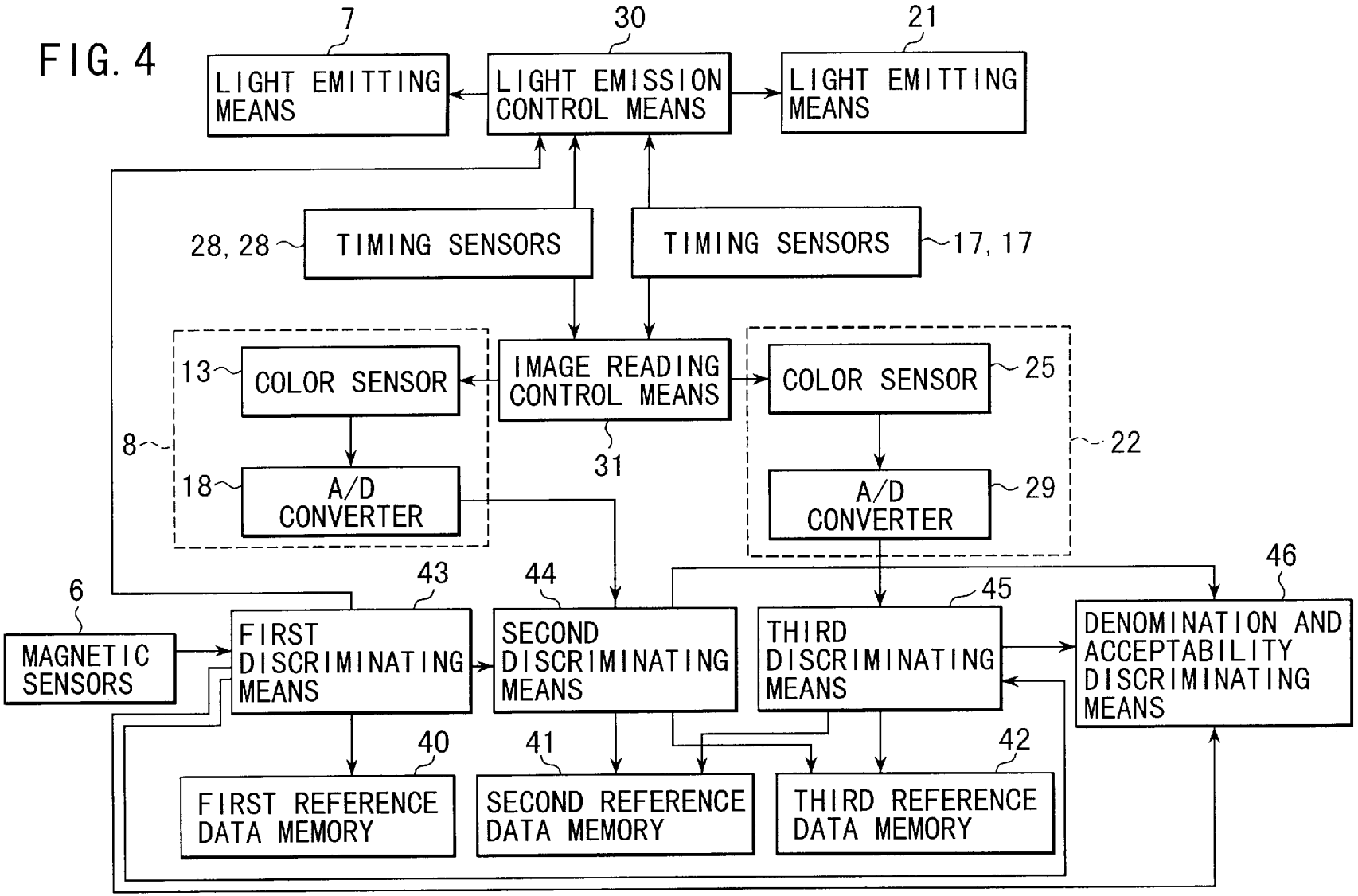
FIG. 4 is a block diagram of detection, control and discrimination systems of a coin discriminating apparatus which is an embodiment of the present invention.

FIG. 4 is a block diagram of detection, control and discrimination systems of a coin discriminating apparatus which is an embodiment of the present invention.

As shown in FIG. 4, the detection system of the coin discriminating apparatus includes the two timing sensors 17, 17 for detecting a coin 1 fed to the first transparent passage portion 3 and the two timing sensors 28, 28 for detecting a coin fed to the second transparent passage portion 4.

As shown in FIG. 4, the control system of the coin discriminating apparatus includes light emission control means 30 which outputs a light emission signal to the first light emitting means 7 when the timing signal from the timing sensors 17, 17 is received and causes it to emit light and illuminate the coin 1 located on the upper surface of the first transparent passage portion 3 and outputs a light emission signal to the second light emitting means 21 when the timing signal from the timing sensors 28, 28 is received and causes it to emit light and illuminate the coin 1 located on the upper surface of the second transparent passage portion 4, and image reading control means 31 for permitting the color sensor 13 of the first image data producing means 8 to start detecting the light reflected from the surface of the coin 1 when the timing signal from the timing sensors 17, 17 is received and permitting the color sensor 25 of the second image data producing means 22 to start detecting the light reflected from the surface of the coin 1 when the timing signal from the timing sensors 28, 28 is received.

In FIG. 4, the discriminating system of the coin discriminating apparatus includes a first reference data memory 40 for storing reference magnetic data indicating magnetic properties of coins of each denomination; a second reference data memory 41 for storing reference data relating to the diameter of coins of each denomination, reference chromaticity data of coins of each denomination and reference lightness data of coins of each denomination; a third reference data memory 42 for storing reference ratio data showing the ratio of data "0" in the binary image pattern data groups corresponding to a plurality of annular areas on the surface of each denomination of coins, first discriminating means 43 which accesses the first reference data memory 40 in accordance with detection signals from the magnetic sensors 6, 6 and compares the reference magnetic data which indicate the magnetic properties of each denomination stored in the first reference data memory 40 with the magnetic data of the coin 1 input from the magnetic sensors 6, 6, thereby determining the denomination of the coin 1; second discriminating means 44 for discriminating the denomination of the coin 1 and the damage degree of the lower surface of the coin 1 based on the result of discrimination made by the first discriminating means 43, the reference data relating to the diameter of the coin of each denomination, reference chromaticity data of coins of each denomination and reference lightness data of coins of each denomination stored in the second reference data memory 41, reference ratio data stored in the third reference data memory 42 and image pattern data of the lower surface of the coin 1 photoelectrically detected by the color sensor 13 and digitized by the A/D converter 18; third discriminating means 45 for discriminating the denomination of the coin 1 and the damage degree of the upper surface of the coin 1 based on the result of discrimination made by the first discriminating means 43, the reference data relating to the diameter of the coin of each denomination, reference chromaticity data of coins of each denomination and reference lightness data of coins of each denomination stored in the second reference data memory 41, reference ratio data stored in the third reference data memory 42 and image pattern data of the upper surface of the coin 1 photoelectrically detected by the color sensor 25 and digitized by the A/D converter 29; and denomination and acceptability determining means 46 for finally discriminating whether or not the coin 1 is acceptable and the denomination of the coin 1 based on the results of discrimination made by the first discriminating means 43, the second discriminating means 44 and the third discriminating means 45.

Although not shown in FIG. 4, a display means is provided for displaying whether or not the coin 1 is acceptable and the damage degree of the coin 1 exceeds a predetermined level.

In this embodiment, a denomination discrimination signal is output from the first discriminating means 43 to the light emission control means 30 and the light emission control means 30 is constituted so as to control the amount of light emitted from the light emitting elements 9 and the light emitting elements 23 in accordance with the denomination discrimination signal input from the first discriminating means 43 based on the denomination of the coin 1 discriminated by the first discriminating means 43. In the third reference data memory 42, the reference ratio data of the binary image pattern data groups corresponding to each annular area of obverse and reverse surfaces of all denominations to be processed are stored.

FIG. 5 is a block diagram of the second discriminating means 44.

As shown in FIG. 5, the second discriminating means 44 includes an image pattern data memory 50 for mapping and storing the image pattern data of the lower surface of the coin 1 photoelectrically detected by the color sensor 13 and digitized by the A/D converter 18 into an orthogonal coordinate system, i.e., an x-y coordinate system; a first denomination discriminating section 51 which accesses the second reference data memory 41 and compares the reference data relating to the diameter of the coin of each denomination stored in the second reference data memory 41 with the image pattern data of the lower surface of the coin 1 read from the image pattern data memory 50, thereby determining the denomination of the coin 1 based on the diameter of the coin 1 and outputting a denomination discrimination signal; a second denomination discriminating section 53 for discriminating the denomination of the coin 1 based on a denomination discrimination signal input from the first discriminating means 43 and a denomination discrimination signal input from the first denomination discriminating section 51 and outputting a denomination discrimination signal; a coin damage discriminating section 52 for calculating chromaticity data and lightness data of the coin 1 based on R, G, B data corresponding to the primaries of light, namely, red, green and blue light, in the image pattern data of the lower surface of the coin 1 stored in the image pattern data memory 50, comparing them with the reference chromaticity data and reference lightness data of the coin of the denomination discriminated by the second denomination discriminating section 53 and stored in the second reference data memory 41 based on the denomination discrimination signal input from the second denomination discriminating section 53, discriminating the damage degree of the coin 1 and outputting a damage discrimination signal to the denomination and acceptability determining section 46; a center coordinate determining section 54 for obtaining the center coordinates of the image pattern data of the lower surface of the coin 1 mapped and stored in the image pattern data memory 50; a binary data producing section 55 which binarizes the image pattern data of the lower surface of the coin 1 mapped and stored in the image pattern data memory 50 and groups the binarized image pattern data into binary image pattern data groups corresponding to a plurality of annular areas of the surface of the coin 1 determined for each denomination based on a denomination discrimination signal input from the second denomination discriminating section 53 and a center coordinate signal input from the center coordinate determining section 54, obtains the number of "0" data in the binary image pattern data groups corresponding to each annular area, obtains the ratio of the "0" data in the entire data, thereby producing ratio data for each binary image pattern data group corresponding to each annular area of the surface of the coin 1; and a denomination determining section 56 which accesses the third reference data memory 42 for storing reference ratio data that indicate the ratio of the "0" data in the binary image pattern data groups corresponding to the plurality of annular areas of the coin surface of each denomination, reads the ratio data in the binary image pattern data groups corresponding to each annular area of the coin surface of the corresponding denomination according to the denomination discrimination signal input from the second denomination discriminating section 53, compares the ratio data read from the third reference data memory 42 with the ratio data of each binary image pattern data group corresponding to each annular area of the lower surface of the coin 1 input from the binary data producing section 55, thereby determining whether or not the coin 1 is acceptable and the denomination of the coin 1 and outputting a denomination determination signal to the denomination and acceptability determining means 46.

FIG. 6 is a block diagram of the third discriminating means 43.

As shown in FIG. 6, the third discriminating means 45 includes an image pattern data memory 60 for mapping and storing the image pattern data of the upper surface of the coin 1 photoelectrically detected by the color sensor 25 and digitized by the A/D converter 29 into the orthogonal coordinate system, i.e., the x-y coordinate system; a first denomination discriminating section 61 which accesses the second reference data memory 41 and compares the reference data relating to the diameter of the coin of each denomination stored in the second reference data memory 41 with the image pattern data of the upper surface of the coin 1 read from the image pattern data memory 60, thereby determining the denomination of the coin 1 based on the diameter of the coin 1 and outputting a denomination discrimination signal; a second denomination discriminating section 63 for discriminating the denomination of the coin 1 based on a denomination discrimination signal input from the first discriminating means 43 and a denomination discrimination signal input from the first denomination discriminating section 61 and outputting a denomination discrimination signal; a coin damage discriminating section 62 for calculating chromaticity data and lightness data of the coin 1 based on R, G, B data corresponding to the primaries of light, namely, red, green and blue light, in the image pattern data of the upper surface of the coin 1 stored in the image pattern data memory 60, comparing them with the reference chromaticity data and reference lightness data of the coin of the denomination discriminated by the second denomination discriminating section 63 and stored in the second reference data memory 41 based on the denomination discrimination signal input from the second denomination discriminating section 63, discriminating the damage degree of the coin 1 and outputting a damage discrimination signal to the denomination and acceptability determining section 46; a center coordinate determining section 64 for obtaining the center coordinates of the image pattern data of the upper surface of the coin 1 mapped and stored in the image pattern data memory 60; a binary data producing section 65 which binarizes the image pattern data of the upper surface of the coin 1 mapped and stored in the image pattern data memory 60 and groups the binarized image pattern data into binary image pattern data groups corresponding to a plurality of annular areas of the surface of the coin 1 determined for each denomination based on a denomination discrimination signal input from the second denomination discriminating section 63 and a center coordinate signal input from the center coordinate determining section 64, obtains the number of "0" data in the binary image pattern data groups corresponding to each annular area, obtains the ratio of the "0" data in the entire data, thereby producing ratio data for each binary image pattern data group corresponding to each annular area of the surface of the coin 1; and a denomination determining section 66 which accesses the third reference data memory 42 for storing reference ratio data that indicate the ratio of the "0" data in the binary image pattern data groups corresponding to the plurality of annular areas of the coin surface of each denomination, reads the ratio data in the binary image pattern data groups corresponding to each annular area of the coin surface of the corresponding denomination according to the denomination discrimination signal input from the second denomination discriminating section 63, compares the ratio data read from the third reference data memory 42 with the ratio data of each binary image pattern data group corresponding to each annular area of the upper surface of the coin 1 input from the binary data producing section 65, thereby determining whether or not the coin 1 is acceptable and the denomination of the coin 1 and outputting a denomination determination signal to the denomination and acceptability determining means 46.

The thus constituted coin discriminating apparatus according to the embodiment of the present invention discriminates whether or not a coin 1 is acceptable, whether or not the coin 1 is damaged to higher than a predetermined level and the denomination of the coin 1.

The coin 1 is fed in the coin passage 2 along a pair of guide rails 5, 5 in the direction indicated by an arrow A. the magnetic properties of the coin 1 are detected by the pair of magnetic sensors 6, 6 and the detection signals are output to the first discriminating means 43.

The first discriminating means 43 accesses the first reference data memory 40 when the detection signals are input from the magnetic sensors 6, 6, reads the reference magnetic data which indicate the magnetic properties of each denomination stored in the first reference data memory 40, discriminates the denomination of the coin 1 by comparing the reference magnetic data read from the first reference data memory 40 with the magnetic data of the coin 1 input from the magnetic sensors 6, 6 and outputs denomination discrimination signals to the second discriminating means 44, the third discriminating means 45 and the light emission control means 30.

When the coin 1 is further fed in the coin passage 2 to the first transparent passage portion 3 and blocks light emitted from the light emitting element 15 of each timing sensor 17, whereby the light receiving element 16 of each timing sensor 17 does not receive the light emitted from the corresponding light emitting element 15, timing signals are output from the timing sensors 17, 17 to the light emission control means 30 and the image reading control means 31.

When the timing signals are input from the timing sensors 17, 17, the light emission control means 30 outputs a light emission signal to the light emitting means 7 based on the denomination discrimination signal from the first discriminating means 43 and causes the light emitting elements 9 to emit the amount of light that corresponds to the denomination of the coin 1 discriminated by the first discriminating means 43 toward the lower surface of the coin 1 located on the first transparent passage portion 3. The reason why the amount of emitted light from the light emitting elements 9 is controlled based on the discriminating result of the denomination of the coin 1 by the first discriminating means 43 is because the amount of reflected light changes depending upon the material of the coin 1. If the same amount of light is emitted toward the coin 1, the image pattern of the coin 1 cannot be accurately detected. That is, when the coin is made of a material having high light reflectivity such as nickel, aluminum or the like, it becomes difficult to accurately produce the binary data corresponding to the pattern of the surface of the coin 1 by detecting the reflected light from the surface of the coin 1. That is because the total amount of detected light becomes large and saturated if a large amount of light is illuminated. On the other hand, when the coin is made of a material having low light reflectivity such as copper, brass or the like, the binary data corresponding to the pattern on the surface of the coin 1 cannot be accurately produced by detecting the reflected light from the surface of the coin 1. That is because the total amount of detected light is too little if a small amount of light is illuminated. Thus, the light emission control means 30 is constituted such that when the coin 1 of the denomination discriminated by the first discriminating means 43 is made of a material having high light reflectivity such as nickel, aluminum or the like, the light emission control means 30 outputs a light emission signal to the light emitting means 7 so that the light emitting elements emits low intensity of light. On the other hand, it is constituted such that when the coin 1 of the denomination discriminated by the first discriminating means 43 is made of a material having low light reflectivity such as copper, brass or the like, the light emission control means 30 outputs the light emission signal to the light emitting means 7 so that the light emitting elements emits high intensity of light.

The image reading control means 31 causes the color sensor 13 of the first image data producing means 8 to start detecting the light emitted from the light emitting elements 9 and reflected on the lower surface of the coin 1 when the timing signals from the timing sensors 17, 17 are input.

Since the light emitting means 7 is disposed so as to be able to illuminate the coin 1 which advances on the first transparent passage portion 3 at a shallow angle, the light is reflected according to the raised and depressed pattern of the lower surface of the coin 1. The light reflected from the surface of the coin 1 is directed toward the color sensor 13 by the lens system 12 and photoelectrically detected by the color sensor 13, whereby the image pattern data of the surface of the coin 1 are produced by the color sensor 13. The image pattern data of the surface of the coin 1 produced by the color sensor 13 are digitized by the A/D converter 18. The digitized image pattern data are mapped and stored in the orthogonal coordinate system, namely, x-y coordinate system in the image pattern data memory 50.

When the image pattern data of the lower surface of the coin 1 are stored in the image pattern data memory 50, the first denomination discriminating section 51 of the second discriminating means 44 accesses the second reference data memory 41. It reads the data stored in the with regard to the diameter of the coin 1 and also the image pattern data stored in the image pattern data memory 50. By comparing those data, the first denomination discriminating section 51 of the second discriminating means 44 determines the denomination of the coin 1 and outputs the denomination discrimination signal to the second denomination discriminating section 53. There are some coins whose diameters are only slightly different from each other even though their denominations are different. When coins having a slightly larger diameter are worn out, their diameter can happen to coincide. Therefore, in some cases, the denomination of the coin 1 cannot be detected accurately by detecting its diameter. In this embodiment, the first discriminating means 43 determines the denomination of the coin 1 based on the magnetic properties of the coin 1 and outputs the denomination discrimination signal to the second denomination discriminating section 53. The first denomination discriminating section 51 of the second discriminating means 44 determines the denomination of the coin 1 based on the diameter of the coin 1 and outputs the denomination discrimination signal to the second denomination discriminating section 53. When the denominations of the coin 1 determined by the first discriminating means 43 and the first denomination discriminating section 51 of the second discriminating means 44 based on these denomination discrimination signals do not coincide, it is constituted to determine that the coin 1 cannot be accepted. Therefore, when the first denomination discriminating section 51 of the second discriminating means 44 determines only one kind of denomination of the coin 1 based on the diameter of the coin 1, produces the denomination discrimination signal and outputs it to the second denomination discriminating section 53, there is a possibility that the second denomination discriminating section 53 determines that the coin 1 is not acceptable even though the coin 1 is an acceptable coin. Accordingly, in this embodiment, the first denomination discriminating section 51 of the second discriminating means 44 selects two denominations whose diameters are the closest and the second closest to the diameter of the detected coin 1 and outputs the denomination discrimination signal to the second denomination discriminating section 53.

The second denomination discriminating section 53 determines the denomination of the coin 1 based on the denomination discrimination signal input from the first discriminating means 43 and the denomination discrimination signal input from the first denomination discriminating section 51 of the second discriminating means 44. When the determined results of the first discriminating means 43 and the first denomination discriminating section 51 of the second discriminating means 44 coincide, the second denomination discriminating section 53 outputs the denomination discrimination signal to the coin damage discriminating section 52, the binary data producing section 55 and the denomination determining section 56. When they do not coincide, the coin 1 is a counterfeit coin or a foreign coin and therefore, it determines that it is not acceptable and an unacceptable signal is output to the display means (not shown).

The coin damage discriminating section 52 reads the image pattern data of the lower surface of the coin 1 stored in the image pattern data memory 50 and calculates the chromaticity data and the lightness data of the coin 1 based on the R, G and B data in the image pattern data. Further, the coin damage discriminating section 52 accesses the second reference data memory 41, reads, based on the denomination discrimination signal input from the second denomination discriminating section 53, the reference chromaticity data and the reference lightness data of the coin having the denomination discriminated by the second denomination discriminating section 53 and compares the reference chromaticity data and the reference lightness data read from the second reference data memory 41 with the calculated chromaticity data and lightness data of the coin 1, thereby discriminating whether or not the coin 1 is damaged to higher than a predetermined level. More specifically, when the coin 1 is damaged to higher than a predetermined level, the color of the coin surface changes so that the difference between the chromaticity data of the coin 1 and the reference chromaticity data exceeds a predetermined level and the coin surface becomes dark so that the difference between the lightness data of the coin 1 and the reference lightness data exceeds a predetermined level. Therefore, the coin damage discriminating section 52 can discriminate whether or not the coin 1 is damaged to higher than a predetermined level by comparing the calculated chromaticity data and lightness data of the coin 1 with the reference chromaticity data and the reference lightness data. When the coin damage discriminating section 52 determines that the coin 1 is damaged to higher than a predetermined level, it outputs a damage determination signal to the denomination and acceptability discriminating means 46. At the same time, the coin damage discriminating section 52 outputs the damage determination signal to the display means (not shown) and cause it to display that the coin 1 is damaged to higher than a predetermined level.

On the other hand, the center coordinate determining section 54 determines the center coordinate of the image pattern data mapped and stored in the orthogonal coordinate system, namely, the x-y coordinate system and stored in the image pattern data memory 50 and outputs the center coordinate to the binary data producing section 55. The binary data producing section 55 reads the image pattern data of the lower surface of the coin 1 mapped and stored in the image pattern data memory 50 and binarizes them. The binary data producing section 55 groups the binarized image pattern data into the binary image pattern data groups of the denomination corresponding to the plurality of annular areas of the surface of the coin 1 based on the denomination discrimination signal input from the second denomination discriminating section 53 and the center coordinate input from the center coordinate determining section 54. The binary data producing section 55 further obtains the number of the "0" data in each binary image pattern data group corresponding to each annular area, obtains the ratio of the "0" data with respect to all the data, produces the ratio data of each binary image pattern data group corresponding to each annular area of the surface of the coin 1 and outputs the ratio data to the denomination determining section 56.

When the denomination determining section 56 receives the denomination discrimination signal from the second denomination discriminating section 53, it accesses the third reference data memory 42, at first, reads the reference ratio data of the reverse surface of the coin of the corresponding denomination from the reference ratio data stored in the third reference data memory 42 in accordance with the denomination discrimination signal input from the second denomination discriminating section 53, and compares the reference ratio data with the ratio data input from the binary data producing section 55, thereby discriminating the denomination of the coin 1.

When the denomination of the coin 1 is discriminated, the denomination determining section 56 calculates the absolute value Di (i=1 to n, n is the number of annular areas of the coin 1 which are predetermined for each denomination) of the difference between the reference ratio data of each binary image pattern group corresponding to each annular area of the coin 1 and the detected ratio data input from the binary data producing section 55. The denomination determining section 56 then determines whether or not the absolute values Di of the differences between the reference ratio data of each binary image pattern group corresponding to each annular area of the coin 1 and the detected ratio data are less than a predetermined value D0. As a result, when the absolute values Di of the differences between the reference ratio data of binary image pattern groups corresponding to all annular areas of the coin 1 and the detected ratio data are less than a predetermined value D0, the denomination determining section 56 further integrates the absolute values Di of the differences between the reference ratio data and the ratio data over all of the binary image pattern data groups corresponding to the annular areas of the coin 1, and determines whether or not the resulted integrated value I is less than a predetermined value I0. As a result, when the integrated value I is less than the predetermined value I0, the denomination determining section 56 determines that the coin 1 is the coin of the denomination determined by the second denomination discriminating section 53. Now, it should be noted that if the denomination of the coin 1 coincides with the denomination determined by the second denomination discriminating section 53, theoretically, the absolute value Di and the integrated value I become 0. However, because the surface of the coin 1 may be worn out or a detecting error may exist, they may not be equal to 0 even if the determined denominations coincide. Therefore, in this embodiment, when Di is less than D0 and, at the same time, I is less than I0, it is determined that the coin 1 is the coin of the denomination determined by the second denomination discriminating section 53.

When at least one absolute value Di of the differences between the reference ratio data of the binary image pattern data group corresponding to at least one of annular areas of the coin 1 and the detected ratio data are not less than the predetermined value D0, or when the absolute values Di of the differences between the reference ratio data of all binary image pattern data groups corresponding to all annular areas of the coin 1 are less than the predetermined value D0 and at the same time, the integrated value I is not less than the predetermined value I0, the denomination determining section 56 cannot determine that the denomination of the coin 1 is same as the denomination determined by the second denomination discriminating section 53. However, the coin 1 cannot be always fed such that its obverse surface faces upward and there are cases where the obverse surface of the coin 1 faces downward while it is advanced in the coin passage 2. As a result, there is a possibility that the surface pattern of the obverse surface of the coin 1 may be detected by the color sensor 13. Therefore, to determine that the coin 1 is not acceptable when the detected ratio data of the coin 1 do not coincide with the reference ratio data of the reverse surface of the coin of the denomination determined by the second denomination discriminating section 53 will significantly lower discriminating accuracy.

Thus, the denomination determining section 56 further accesses the third reference data memory 42, reads the reference ratio data of the obverse surface of the coin of the denomination determined by the second denomination discriminating section 53, and, in the exactly same manner as described above, it determines whether or not the absolute values Di of the differences between the reference ratio data of each binary image pattern group corresponding to each annular area of the coin 1 and the detected ratio data are less than a predetermined value D0. When the absolute values Di of the differences between the reference ratio data of all the binary image pattern groups corresponding to each annular area of the coin 1 and the detected ratio data are less than a predetermined value D0, the denomination determining section 56 integrates the absolute values Di of the differences between the reference ratio data of all the binary image pattern groups corresponding to each annular area of the coin 1, and determines whether or not the resulted integrated value I is less than the predetermined value I0. As a result, when the integrated value I is less than the predetermined value I0, the denomination determining section 56 determines that the coin 1 is the coin of the denomination determined by the second denomination discriminating section 53.

On the other hand, when at least one of absolute values Di of the differences between the reference ratio data of the binary image pattern groups corresponding to each annular area of the obverse surface of the coin 1 and the detected ratio data are not less than a predetermined value D0, or when the absolute values Di of the differences between the reference ratio data of the binary image pattern groups corresponding to all annular areas of the obverse surface of the coin 1 and the detected ratio data are less than a predetermined value D0 and at the same time, the integrated value I is not less than the predetermined value I0, it means that, as a result of comparing the reference ratio data of the coin of the denomination whose magnetic properties and diameter are closest among the denominations with the detected ratio data, the surface patterns of the obverse surface and the reverse surface of the coin 1 are different from the surface patterns of the coin of the denomination determined by the second denomination discriminating section 53. Therefore, since the coin 1 is either a counterfeit coin or a foreign coin and it is determined that it is not acceptable, the denomination determining section 56 outputs the unacceptable signal to the display means (not shown) and causes it to display that the coin 1 is not acceptable.

On the other hand, when the denomination determining section 56 determines that the coin 1 is acceptable, it outputs a denomination determination signal to the denomination and acceptability determining means 46.

The coin 1 is further fed to the second transparent passage portion 4 in the coin passage 2 and when light emitted from the light emitting element 26 of each timing sensor 28 is blocked by the coin 1 and the light receiving element 27 does not receive the light emitted from the light emitting element 26, timing signals are output from the timing sensors 28, 28 to the light emission control means 30 and the image reading control means 31.

When the light emission control means 30 receives the timing signals from the timing sensors 28, 28, it outputs a light emission signal to the light emitting means 21 based on the denomination discrimination signal from the first discriminating means 43 and causes the light emitting elements 23 to emit the amount of light that corresponds to the denomination of the coin 1 discriminated by the first discriminating means 43 toward the upper surface of the coin 1 located on the second transparent passage portion 4.

When the image reading control means 31 receives the timing signals from the timing sensors 28, it causes the color sensor 25 of the second image data producing means 22 to start detecting the light emitted from the light emitting elements 23 and reflected on the upper surface of the coin 1.

The amount of light emitted from the light emitting elements 23 is controlled by the light emission control means 30 based on the denomination discrimination signal input from the first discriminating means 43 in the exactly same manner as described above as to the light emitting elements 9 of the first light emitting means 7.

Since the light emitting means 21 is disposed so as to be able to illuminate the coin 1 which advances on the second transparent passage portion 4 at a shallow angle, the light is reflected according to the raised and depressed pattern of the upper surface of the coin 1. The light reflected from the surface of the coin 1 is directed toward the color sensor 25 by the lens system 24 and photoelectrically detected by the color sensor 25, whereby the image pattern data of the surface of the coin 1 are produced by the color sensor 25. The image pattern data of the surface of the coin 1 produced by the color sensor 25 are digitized by the A/D converter 29. The digitized image pattern data are mapped and stored in the orthogonal coordinate system, namely, x-y coordinate system in the image pattern data memory 60.

When the image pattern data of the upper surface of the coin 1 are stored in the image pattern data memory 60, the first denomination discriminating section 61 of the third discriminating means 45 accesses the second reference data memory 41. It reads the data stored in the second reference data memory 41 with regard to the diameter of the coin 1 and also the image pattern data stored in the image pattern data memory 60. By comparing those data, the first denomination discriminating section 61 of the third discriminating means 45 determines the denomination of the coin 1 and outputs a denomination discrimination signal to the second denomination discriminating section 63. In this embodiment, based on the detected diameter of the coin 1, the first denomination discriminating section 61 of the third discriminating means 45 selects two denominations, whose diameters are the closest and the second closest to the diameter of the detected coin 1 and outputs the denomination discrimination signal to the second denomination discriminating section 63.

The second denomination discriminating section 63 determines the denomination of the coin 1 based on the denomination discrimination signal input from the first discriminating means 43 and the denomination discrimination signal input from the first denomination discriminating section 61 of the third discriminating means 45. When the determined results of the first discriminating means 43 and the first denomination discriminating section 61 of the third discriminating means 45 coincide, the second denomination discriminating section 63 outputs a denomination discrimination signal to the coin damage discriminating section 62, the binary data producing section 65 and the denomination determining section 66. When they do not coincide, the coin 1 is a counterfeit coin or a foreign coin and, therefore, it determines that it is not acceptable and an unacceptable signal is output to the display means (not shown).

The coin damage discriminating section 62 reads the image pattern data of the upper surface of the coin 1 stored in the image pattern data memory 60 and calculates the chromaticity data and the lightness data of the coin 1 based on the R, G and B data in the image pattern data. Further, the coin damage discriminating section 62 accesses the second reference data memory 41, reads, based on the denomination discrimination signal input from the second denomination discriminating section 63, the reference chromaticity data and the reference lightness data of the coin having the denomination discriminated by the second denomination discriminating section 63 and compares the reference chromaticity data and the reference lightness data read from the second reference data memory 41 with the calculated chromaticity data and lightness data of the coin 1, thereby discriminating whether or not the coin 1 is damaged to higher than a predetermined level. When the coin damage discriminating section 62 determines that the coin 1 is damaged to higher than a predetermined level, it outputs a damage determination signal to the denomination and acceptability discriminating means 46. At the same time, the coin damage discriminating section 62 outputs the damage determination signal to the display means (not shown) and cause it to display that the coin 1 is damaged to higher than a predetermined level.

On the other hand, the center coordinate determining section 64 determines the center coordinate of the image pattern data mapped and stored in the orthogonal coordinate system, namely, the x-y coordinate system, and stored in the image pattern data memory 60 and outputs the center coordinate to the binary data producing section 65. The binary data producing section 65 reads the image pattern data of the upper surface of the coin 1 mapped and stored in the image pattern data memory 60 and binarizes them. The binary data producing section 65 groups the binarized image pattern data into the binary image pattern data groups of the denomination corresponding to the plurality of annular areas of the surface of the coin 1 based on the denomination discrimination signal input from the second denomination discriminating section 63 and the center coordinate input from the center coordinate determining section 64. The binary data producing section 55 further obtains the number of the "0" data in each binary image pattern data group corresponding to each annular area, obtains the ratio of the "0" data with respect to all the data, produces the ratio data of each binary image pattern data group corresponding to each annular area of the surface of the coin 1 and outputs the ratio data to the denomination determining section 66.

When the denomination determining section 66 receives the denomination discrimination signal from the second denomination discriminating section 63, it accesses the third reference data memory 42, reads the reference ratio data of the obverse and reverse surfaces of the coin of the corresponding denomination from the reference ratio data stored in the third reference data memory 42 in accordance with the denomination discrimination signal input from the second denomination discriminating section 63, and compares the reference ratio data with the ratio data input from the binary data producing section 65, thereby discriminating the denomination of the coin 1 in the exactly same manner as described above as to the denomination determining section 56 of the second discriminating means 44.

As a result, when the denomination determining section 66 determines that the coin 1 is a counterfeit coin or a foreign coin and that it is not acceptable, it outputs an unacceptable signal to the display means (not shown) and causes it to display that the coin 1 is not acceptable. On the other hand, when the denomination determining section 66 determines that the coin 1 is acceptable, it outputs a denomination determination signal to the denomination and acceptability determining means 46.

The denomination and acceptability determining means 46 carries out a denomination based on the denomination discrimination signal input from the first discriminating means 43 and based on the magnetic properties of the coin 1, the denomination discrimination signal input from the denomination determining section 56 of the second discriminating means 44 and based on the diameter data and the image pattern data of the coin 1, the presence of the damage discrimination signal input from the coin damage discriminating section 52 and based on the chromaticity data and the lightness data of the coin 1, the denomination discrimination signal input from the denomination determining section 66 of the third discriminating means 45 and based on the diameter data and the image pattern data of the coin 1 and the presence of the damage discrimination signal input from the coin damage discriminating section 62 and based on the chromaticity data and the lightness data of the coin 1. When the denomination and acceptability determining means 46 finds that the denominations determined by the first discriminating means 43, the second discriminating means 44 and the third discriminating means 45 coincide with each other, it discriminates that the coin 1 is acceptable. On the other hand, when they do not coincide with each other, the denomination and acceptability determining means 46 discriminates that the coin 1 is either a counterfeit coin or a foreign coin and is not acceptable and outputs an unacceptable signal to the display means (not shown) to cause it to display that the coin 1 is not acceptable. More specifically, for example, when the second discriminating means 44 discriminates that the pattern data of the lower surface of the coin 1 coincide with the reference pattern of the obverse surface of a coin of a certain denomination and the third discriminating means 45 determines that the pattern data of the upper surface of the coin 1 coincide with the reference pattern of the reverse surface of the coin of the denomination or in the case where Euro coins are to be discriminated, when one of the second discriminating means 44 and the third discriminating means 45 discriminates that a common pattern is formed on one side surface of the coin 1 and the other of the second discriminating means 44 and the third discriminating means 45 discriminates that a pattern peculiar to an issuing country is formed on the other side surface of the coin 1, the denomination and acceptability determining means 46 determines that the coin 1 is acceptable only when the denomination of the coin 1 determined by the second discriminating means 44 and the third discriminating means 45 coincides with the denomination of the coin 1 determined by the first discriminating means 43 and determines that the coin 1 is the coin of the denomination determined by the first discriminating means 43, the second discriminating means 44 and the third discriminating means 45. Otherwise, the denomination and acceptability determining means 46 determines that the coin 1 is an unacceptable coin.

In this manner, coins discriminated as unacceptable are sorted and collected separately from coins discriminated as acceptable. Further, even though it is discriminated that a coin is acceptable, when it is discriminated that at least one surface thereof is damaged to higher than a predetermined level, it is collected separately from coins discriminated as acceptable.

According to the above described embodiment, patterns of both surfaces of the coin 1 are detected for discriminating whether or not the coin 1 is acceptable. Therefore, it is possible to sort coins such as Euro coins on one surface of which a common pattern is formed and on the other surface of which a different pattern is formed depending upon the issuing countries, into coins of each issuing country, as occasion demands. Further, since patterns of both surfaces of a coin 1 are detected for discriminating whether or not the coin 1 is damaged to higher than a predetermined level, it is possible to reliably discriminate the coin one of the surfaces of which is damaged to higher than a predetermined level as a damaged coin and collect it.

Furthermore, according to the above described embodiment, the first discriminating means 43 discriminates the denomination of a coin 1 based on magnetic properties of the coin 1 detected by the magnetic sensors 6, 6, the first denomination discriminating section 51 of the second discriminating means 44 discriminates the denomination of the coin 1 based on the diameter of the coin 1 and the second denomination discriminating section 53 of the second discriminating means 44 is constituted so as to tentatively determine the denomination of the coin 1 based on the discriminating results made by the first discriminating means 43 and the first denomination discriminating section 51 of the second discriminating means 44. The denomination determining section 56 of the second discriminating means 44 discriminates the denomination of the coin 1 by comparing the pattern data of the coin 1 with only the reference data of the coin of the denomination determined by the first denomination discriminating section 51 of the second discriminating means 44 and the third discriminating means 45 discriminates the denomination of the coin 1 in the same manner as in the second discriminating means 44. Whether or not the coin 1 is acceptable and the denomination of the coin 1 are finally discriminated based on the discriminating results made by the first discriminating means 43, the second discriminating means 44 and the third discriminating means 45. Therefore, it is possible to shorten the time required to make discrimination of coins and discriminate whether or not the coin 1 is acceptable and the denomination of the coin 1 with high accuracy in comparison with the case where the coin discrimination is made by comparing the pattern data of the coin 1 with reference data of coins of all denominations.

Moreover, according to the above described embodiment, when the light reflectivity of the material constituting the coin 1 is low, control is effected such that the amount of light emitted from the light emitting elements 9, 23 which illuminates the coin 1 is increased, and when the light reflectivity of the material constituting the coin 1 is high, control is effected such that the amount of light emitted from the light emitting elements 9, 23 which illuminates the coin 1 is decreased. As a result, irrespective of the material, i.e., whether or not the coin 1 is made of a material having a high or low light reflectivity, it is always possible to produce the binary data in accordance with the surface pattern of the coin 1 and accurately determine the denomination of the coin 1 and whether or not the coin 1 is acceptable. Further, by comparing the obtained data by calculating the ratio of the "0" data in each pattern data group corresponding to each annular area of the coin 1 with the reference ratio data obtained in advance, the denomination of the coin 1 and whether or not the coin 1 is acceptable are determined. Therefore, even in the case where the coin 1 is rotated with respect to the reference position, without rotating the resulted pattern data of the coin 1 in order to compare with the reference pattern data, it is possible to determine the denomination of the coin 1 and whether or not the coin 1 is acceptable in a shorter time.

Figure 7:
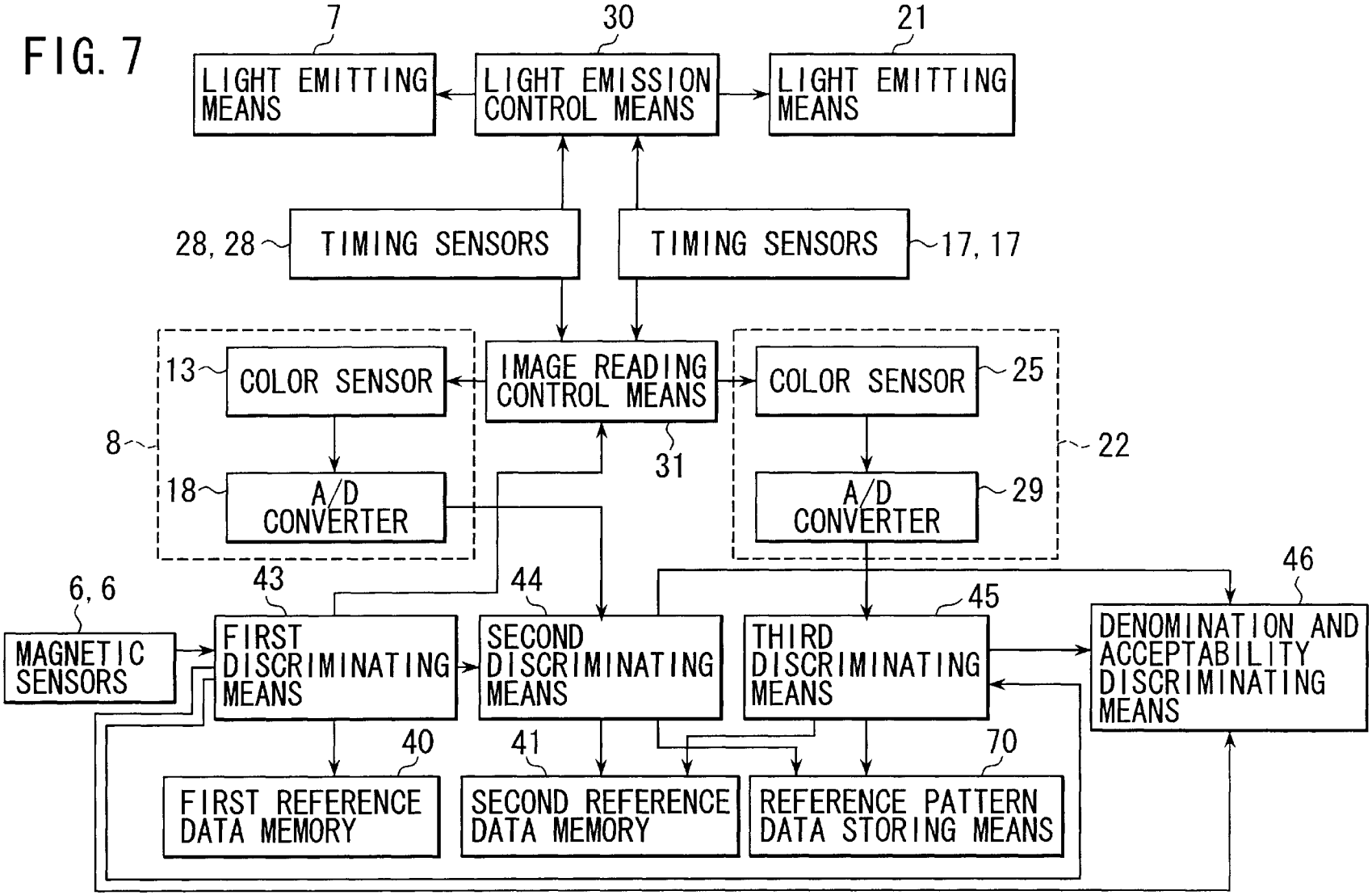
FIG. 7 is a block diagram of detection, control and discrimination systems of a coin discriminating apparatus which is another embodiment of the present invention.

FIG. 7 is a block diagram of detection, control and discrimination systems of a coin discriminating apparatus which is another embodiment of the present invention.

In FIG. 7, the detection system of the coin discriminating apparatus includes the timing sensors 17, 17, 28, 28 the and image data producing means 8, 22 as in the preferred embodiment described above.

In FIG. 7, the control system of the coin discriminating apparatus includes the light emission control means 30 and the image reading control means 31 as in the preferred embodiment described above. However, unlike in the preferred embodiment described above, in this embodiment, the denomination discrimination signal from the first discriminating means 43 is not input to the light emission control means 30 but is input to the image reading control means 31.

In FIG. 7, the discriminating system of the coin discriminating apparatus includes the first reference data memory 40 for storing reference magnetic data indicating magnetic properties of coins of each denomination; the second reference data memory 41 for storing reference data relating to the diameter of coins of each denomination, reference chromaticity data of coins of each denomination and reference lightness data of coins of each denomination; reference pattern data storing means 70 for storing reference pattern data of coins of each denomination; the first discriminating means 43 which accesses the first reference data memory 40 in accordance with detection signals from the magnetic sensors 6, 6 and compares the reference magnetic data which indicate the magnetic properties of each denomination stored in the first reference data memory 40 with the magnetic data of the coin 1 input from the magnetic sensors 6, 6, thereby determining the denomination of the coin 1; second discriminating means 44 for discriminating the denomination of the coin 1 and the damage degree of the lower surface of the coin 1 based on the result of discrimination made by the first discriminating means 43, the reference data relating to the diameter of the coin of each denomination, reference chromaticity data of coins of each denomination and reference lightness data of coins of each denomination stored in the second reference data memory 41, reference pattern data stored in the reference pattern data storing means 70 and image pattern data of the lower surface of the coin 1 photoelectrically detected by the color sensor 13 and digitized by the A/D converter 18; third discriminating means 45 for discriminating the denomination of the coin 1 and the damage degree of the upper surface of the coin 1 based on the result of discrimination made by the first discriminating means 43, the reference data relating to the diameter of the coin of each denomination, reference chromaticity data of coins of each denomination and reference lightness data of coins of each denomination stored in the second reference data memory 41, reference pattern data stored in the reference pattern data storing means 70 and image pattern data of the upper surface of the coin 1 photoelectrically detected by the color sensor 25 and digitized by the A/D converter 29; and denomination and acceptability determining means 46 for finally discriminating whether or not the coin 1 is acceptable and the denomination of the coin 1 based on the results of discrimination made by the first discriminating means 43, the second discriminating means 44 and the third discriminating means 45.

In this embodiment, the reference pattern data storing means 70 is constituted such that it maps and stores the reference pattern data of both sides of the coin 1 for each denomination into an r-θ coordinate system.

FIG. 8 is a block diagram of the second discriminating means 44.

As shown in FIG. 8, the second discriminating means 44 includes an image pattern data memory 50 for mapping and storing the image pattern data of the lower surface of the coin 1 photoelectrically detected by the color sensor 13 and digitized by the A/D converter 18 into the orthogonal coordinate system, i.e., an x-y coordinate system; a first denomination discriminating section 51 which accesses the second reference data memory 41 and compares the reference data relating to the diameter of the coin of each denomination stored in the second reference data memory 41 with the image pattern data of the lower surface of the coin 1 read from the image pattern data memory 50, thereby determining the denomination of the coin 1 based on the diameter of the coin 1 and outputting a denomination discrimination signal; a second denomination discriminating section 53 for discriminating the denomination of the coin 1 based on a denomination discrimination signal input from the first discriminating means 43 and a denomination discrimination signal input from the first denomination discriminating section 51 and outputting a denomination discrimination signal; a coin damage discriminating section 52 for calculating chromaticity data and lightness data of the coin 1 based on R, G, B data corresponding to the primaries of light, namely, red, green and blue light, in the image pattern data of the lower surface of the coin 1 stored in the image pattern data memory 50, comparing them with the reference chromaticity data and reference lightness data of the coin of the denomination discriminated by the second denomination discriminating section 53 and stored in the second reference data memory 41 based on the denomination discrimination signal input from the second denomination discriminating section 53, discriminating the damage degree of the coin 1 and outputting a damage discrimination signal to the denomination and acceptability determining section 46; a center coordinate determining section 54 for obtaining the center coordinates of the image pattern data of the lower surface of the coin 1 mapped and stored in the image pattern data memory 50; pattern data converting means 71 for converting pattern data by transforming into the polar coordinate system, namely, the r-θ coordinate system, based on the center coordinate of the pattern data calculated by the center coordinate determining section 54; pattern data comparing means 72 for determining whether or not the coin 1 is acceptable and the denomination of the coin 1, by comparing the converted pattern data transformed into the r-θ coordinate system by the pattern data converting means 71 with the reference pattern data stored in the reference pattern data storing means 70 and outputting the results of the discrimination to the denomination and acceptability determining means 46.

FIG. 9 is a block diagram of the third discriminating means 45.

As shown in FIG. 9, the third discriminating means 45 includes an image pattern data memory 60 for mapping and storing the image pattern data of the upper surface of the coin 1 photoelectrically detected by the color sensor 25 and digitized by the A/D converter 29 into the orthogonal coordinate system, i.e., the x-y coordinate system; a first denomination discriminating section 61 which accesses the second reference data memory 41 and compares the reference data relating to the diameter of the coin of each denomination stored in the second reference data memory 41 with the image pattern data of the upper surface of the coin 1 read from the image pattern data memory 60, thereby determining the denomination of the coin 1 based on the diameter of the coin 1 and outputting a denomination discrimination signal; a second denomination discriminating section 63 for discriminating the denomination of the coin 1 based on a denomination discrimination signal input from the first discriminating means 43 and a denomination discrimination signal input from the first denomination discriminating section 61 and outputting a denomination discrimination signal; a coin damage discriminating section 62 for calculating chromaticity data and lightness data of the coin 1 based on R, G, B data corresponding to the primaries of light, namely, red, green and blue light, in the image pattern data of the upper surface of the coin 1 stored in the image pattern data memory 60, comparing them with the reference chromaticity data and reference lightness data of the coin of the denomination discriminated by the second denomination discriminating section 63 and stored in the second reference data memory 41 based on the denomination discrimination signal input from the second denomination discriminating section 63, discriminating the damage degree of the coin 1 and outputting a damage discrimination signal to the denomination and acceptability determining section 46; a center coordinate determining section 64 for obtaining the center coordinates of the image pattern data of the upper surface of the coin 1 mapped and stored in the image pattern data memory 60; pattern data converting means 76 for converting pattern data by transforming them into the polar coordinate system, namely, the r-θ coordinate system, based on the center coordinate of the pattern data calculated by the center coordinate determining section 64; pattern data comparing means 77 for determining whether or not the coin 1 is acceptable and the denomination of the coin 1, by comparing the converted pattern data transformed into the r-θ coordinate system by the pattern data converting means 76 with the reference pattern data stored in the reference pattern data storing means 70 and outputting the results of the discrimination to the denomination and acceptability determining means 46.

Figure 10:
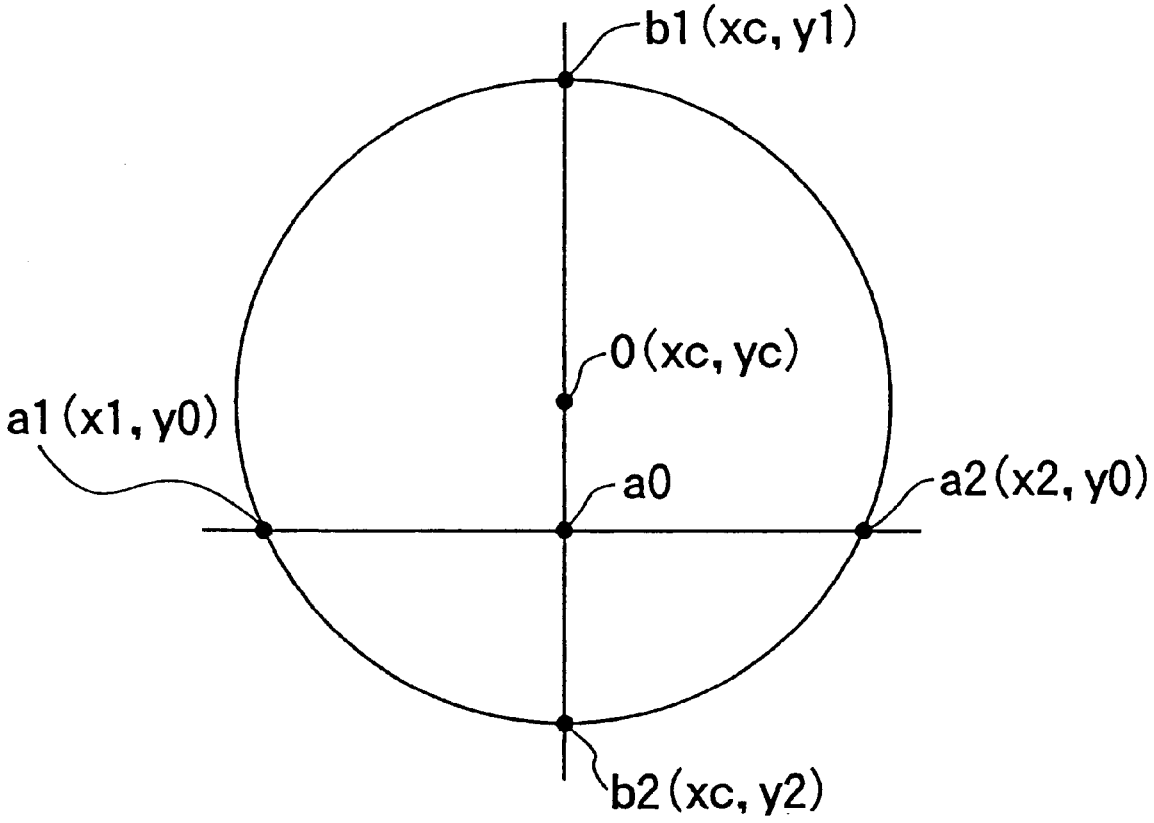
FIG. 10 is a schematic view showing a method for calculating the center coordinate of pattern data effected by center coordinate calculating section.

FIG. 10 is a schematic view showing a method for determining the center coordinate of pattern data effected by the center coordinate determining means 54.

As shown in FIG. 10, the pattern data of the coin 1 produced by the color sensor 13 are mapped in the x-y coordinate system and stored in the image pattern data memory 50. The center coordinate determining section 54 determines x-coordinates x1 and x2 of boundary data a1 and a2 whose y-coordinate is y0 of the pattern data mapped and stored in the image pattern data memory 50 and determines an x-coordinate xc=(x1+x2)/2 of a center data a0 between the boundary data a1 and a2. Then, the center coordinate determining section 54 draws an imaginary straight line from the data a0 perpendicular to a straight line extending through the boundary data a1 and a2 to determine y-coordinates y1 and y2 of boundary data b1 and b2 which correspond to the points of intersection of the imaginary straight line and the boundary of the pattern data and determines a y-coordinate yc=(y1+y2)/2 of center data O between the boundary data b1 and b2. The thus determined coordinates (xc, yc) of the data O corresponds to the center coordinate of the pattern data of the coin 1 mapped in the x-y coordinate system and the data O corresponds to the data center of the pattern data of the coin 1 mapped in the x-y coordinate system.

The method for determining the center coordinate of pattern data effected by the center coordinate determining means 64 is exactly the same as that effected by the center coordinate determining means 54.

Figure 11:
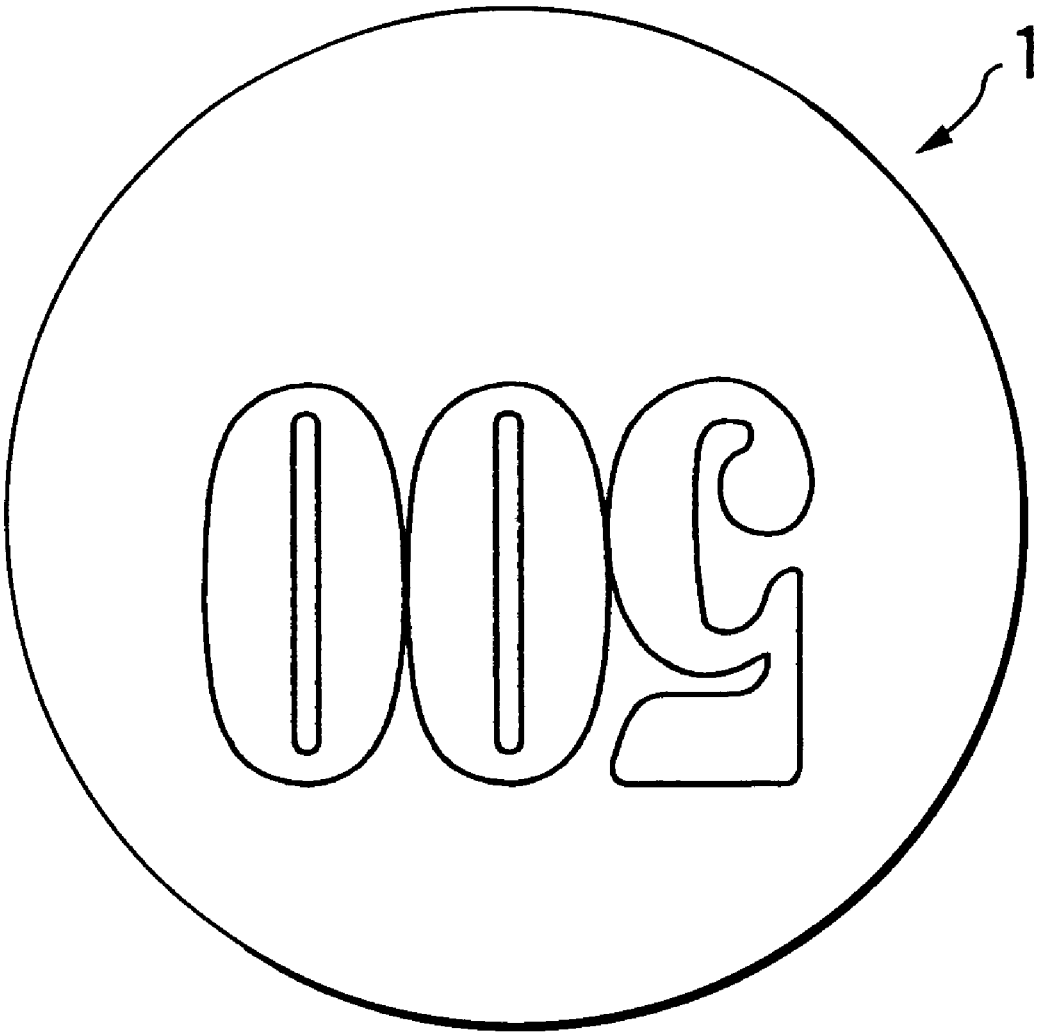
FIG. 11 is a view showing one example of pattern data of a coin produced by a color sensor and mapped and stored in a image pattern data memory.
Figure 12:
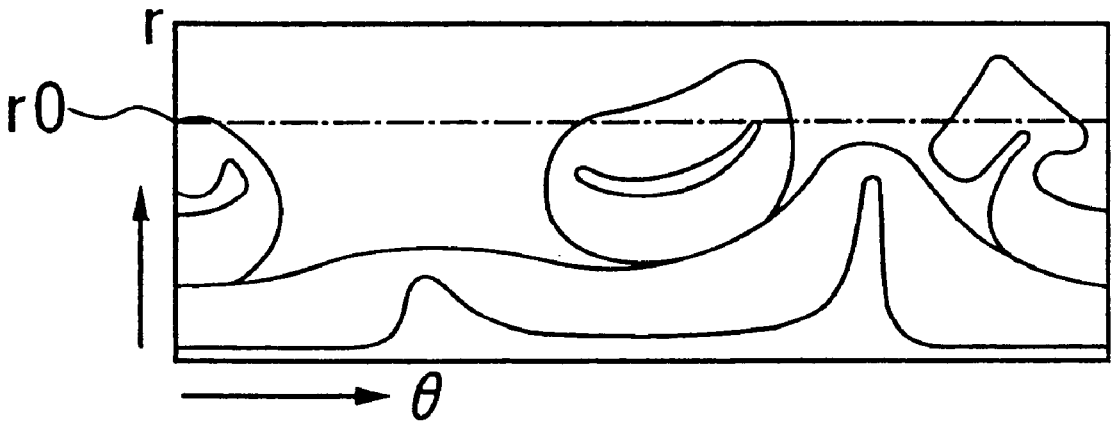
FIG. 12 is a view showing converted pattern data produced by transforming the pattern data shown in FIG. 11 into a polar coordinate system by pattern data converting.

FIG. 11 is a view showing one example of pattern data of the coin 1 produced by the color sensor 13 and mapped and stored in the image pattern data memory 50 and FIG. 12 is a view showing converted pattern data produced by transforming the pattern data shown in FIG. 11 into the r-θ coordinate system by pattern data converting means 71 based upon the center coordinate (xc, yc) of the pattern data of the coin 1 determined by the center coordinate determining section 54. In FIG. 12, the ordinate represents the distance r from the data center O in the x-y coordinate system and the abscissa represents an angle θ about the data center O. An example of pattern data of the coin 1 produced by the color sensor 25 and mapped and stored in the image pattern data memory 60 is similar to the above and an example of converted pattern data produced by transforming the pattern data into the r-θ coordinate system by pattern data converting means 76.

The converted pattern data transformed into the r-θ coordinate system by the pattern data converting means 71 in this manner are input to the pattern data comparing means 72. On the other hand, a denomination discrimination signal produced by the second denomination discriminating section 53 is input to the reference pattern data storing means 70. In response, the reference pattern data storing means 70 selects the reference pattern data of the denomination corresponding to the denomination discrimination signal from among the reference pattern data of coins mapped in the r-θ coordinate system and stored therein and outputs it to the pattern data comparing means 72.

The processing of pattern data effected by the third discriminating means 45 is the same as that effected by the second discriminating means 44.

Figure 13:
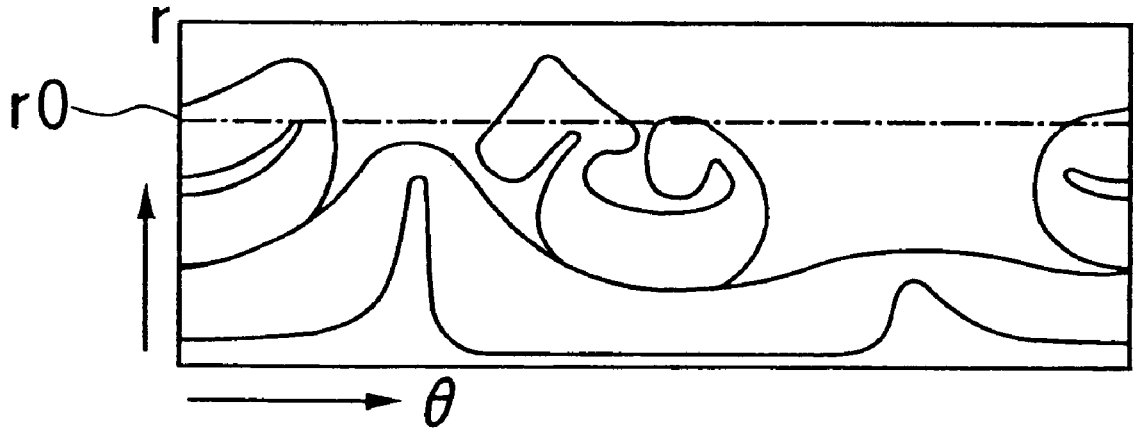
FIG. 13 a view showing reference pattern data of the coin mapped in a polar coordinate system shown in FIG. 11.

FIG. 13 shows an example of the reference pattern data of the coin 1 shown in FIG. 11 and mapped in the r-θ coordinate system. This data corresponds to the converted pattern data shown in FIG. 12. Since the converted pattern data shown in FIG. 12 are obtained in the pattern data converting means 71 by transforming the pattern data in the x-y coordinate system into the r-θ coordinate system based on the center coordinates (xc, yc) of the pattern data of the coin 1 determined by the center coordinate determining section 54, the zero point of the ordinate, namely, the zero point of the r-axis coincides with the zero point of the reference pattern data shown in FIG. 13. However, since the orientation of the coin 1 to be discriminated is usually offset angularly (rotationally) from that of the coin 1 used for producing the reference pattern data, the pattern data in FIG. 12 and the reference pattern data in FIG. 13 at the same θ value are normally obtained from different portions of the coin 1. Accordingly, it is impossible to discriminate whether or not the coin 1 is acceptable and the denomination of the coin 1 by directly comparing the converted pattern data in FIG. 12 and the reference pattern data in FIG. 13 and, therefore, it is necessary to correct the converted pattern data prior to the comparison so that the zero point of the converted pattern data in the θ axis coincides with the zero point of the reference pattern data in the θ axis.

In view of the above, the pattern data comparing means 72 reads the pattern data values at a predetermined distance r0 from the data center of the converted pattern data shown in FIG. 12, namely, reads the pattern data values whose ordinate values are equal to a predetermined value r0 over 360 degrees, and reads the pattern data values at a predetermined distance r0 from the data center of the reference pattern data shown in FIG. 13, namely, reads the pattern data values whose ordinate values are equal to a predetermined value r0 over 360 degrees. Then, the pattern data comparing means 72 compares the two sets of pattern data values, thereby correcting the deviation of the converted pattern data in the θ axis caused by the angular offset of the coin 1.

Figure 14:
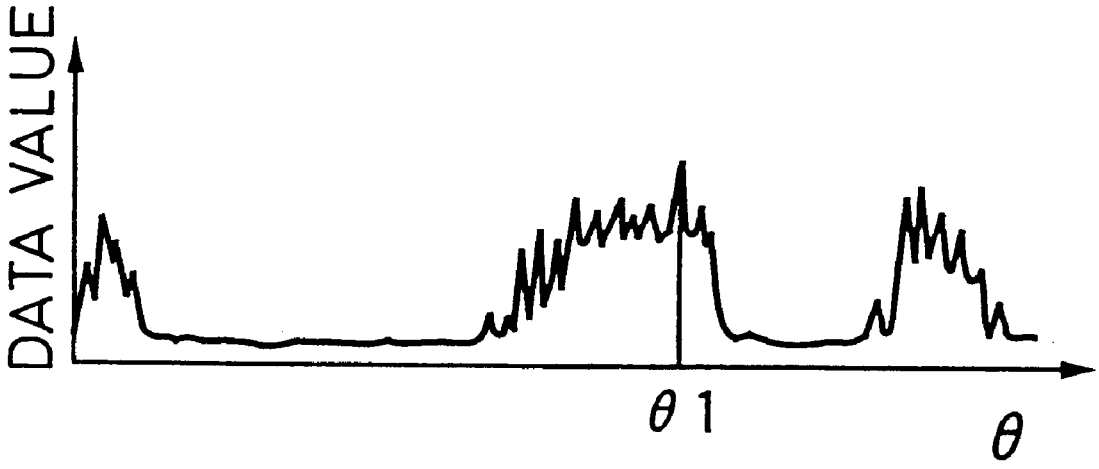
FIG. 14 is a graph showing pattern data values obtained by reading the converted pattern data shown in FIG. 12 over 360 degrees at a predetermined distance r0 from a data center.
Figure 15:
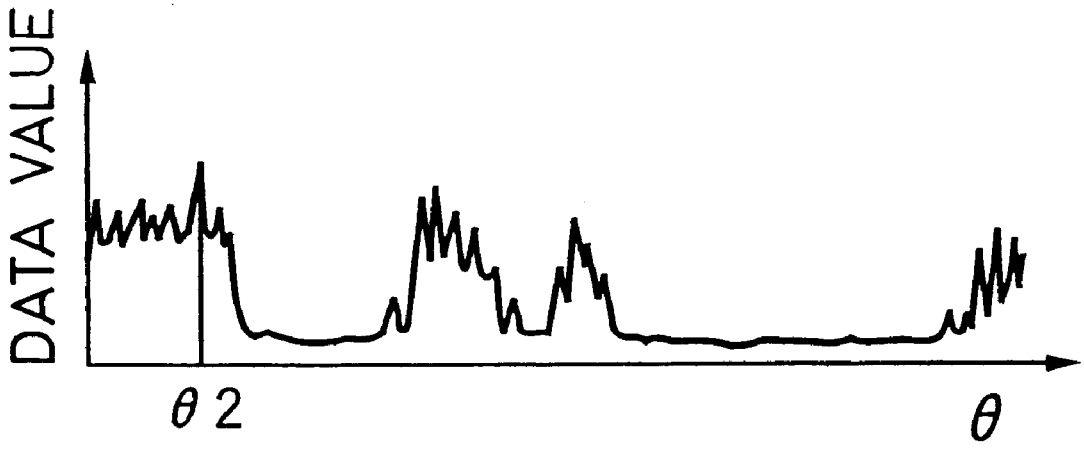
FIG. 15 is a graph showing pattern data value obtained by reading reference pattern data shown in FIG. 13 over 360 degrees at a predetermined distance r0 from the data center.

FIG. 14 is a graph showing pattern data values obtained by reading the converted pattern data shown in FIG. 12 over 360 degrees at a predetermined distance r0 from the data center and FIG. 15 is a graph showing pattern data values obtained by reading reference pattern data shown in FIG. 13 over 360 degrees at a predetermined distance r0 from the data center. In FIGS. 14 and 15, the ordinate represents data values and the abscissa represents the angle.

Coins 1 are fed through the coin passage 2 guided by the pair of guide rails 5, 5 and, therefore, the center of the coin 1 passes along a predetermined locus on the first transparent passage portion 3. On the contrary, the coin 1 is usually offset angularly the coin used to produce the reference pattern data. Therefore, since the sets of pattern data at the same θ value in FIGS. 12 and 13 are normally obtained from different portions of the coin 1, it is necessary to correct the converted pattern data prior to the comparison so that the zero point of the converted pattern data in the θ axis coincides with the zero point of the reference pattern data in the θ axis.

Figure 16:
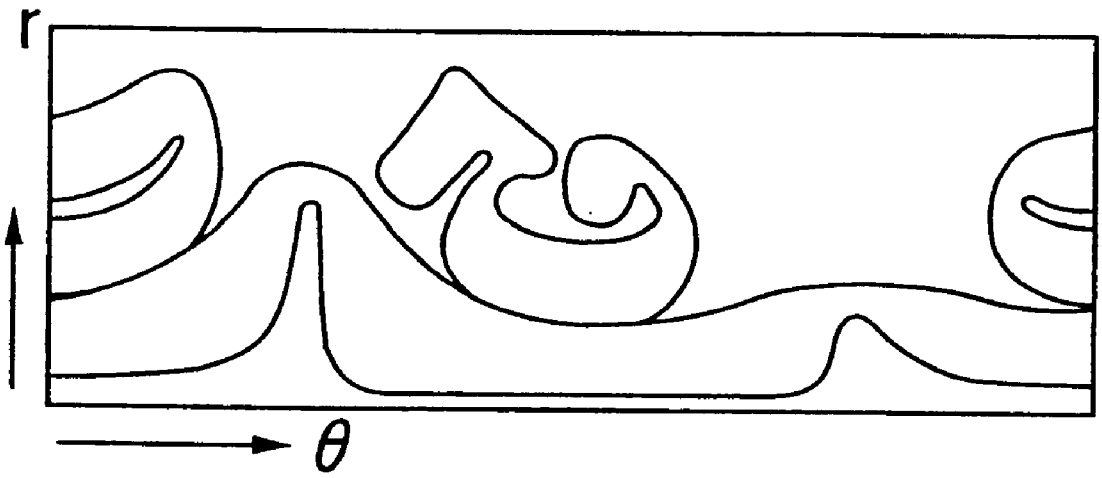
FIG. 16 is a view showing converted pattern data after remapping.

Accordingly, the pattern data comparing means 72 obtains θ values θ1 and θ2 at which the pattern data value shown in FIG. 14 and the pattern data value shown in FIG. 15 are maximum respectively and remaps the converted pattern data shown in FIG. 11 so that θ1 becomes equal to θ2. FIG. 16 shows the thus remapped converted pattern data.

The pattern data comparing means 72 compares the converted pattern data remapped in the above described manner and shown in FIG. 16 with the reference pattern data shown in FIG. 13 and discriminates whether or not the coin 1 is the coin of the denomination determined by the second denomination discriminating section 53 or whether or not the coin 1 is acceptable, in accordance with the extent of how well the converted pattern data coincides with the reference pattern data.

The remapping processing effected by the pattern data comparing means 77 in the third discriminating means 45 is the same as that effected by the pattern data comparing means 72 in the second discriminating means 44.

The thus constituted coin discriminating apparatus according to this embodiment discriminates coins in the following manner.

The coin 1 is fed in the coin passage 2 along a pair of guide rails 5, 5 in the direction indicated by an arrow A. the magnetic properties of the coin 1 are detected by the pair of magnetic sensors 6, 6 and the detection signals are output to the first discriminating means 43.

The first discriminating means 43 accesses the first reference data memory 40 when the detection signals are input from the magnetic sensors 6, 6, reads the reference magnetic data which indicate the magnetic properties of each denomination stored in the first reference data memory 40, discriminates the denomination of the coin 1 by comparing the reference magnetic data read from the first reference data memory 40 with the magnetic data of the coin 1 input from the magnetic sensors 6, 6 and outputs denomination discrimination signals to the second discriminating means 44, the third discriminating means 45 and the light emission control means 30.

When the coin 1 is further fed in the coin passage 2 to the first transparent passage portion 3 and blocks light emitted from the light emitting element 15 of each timing sensor 17, whereby the light receiving element 16 of each timing sensor 17 does not receive the light emitted from the corresponding light emitting element 15, timing signals are output from the timing sensors 17, 17 to the light emission control means 30 and the image reading control means 31.

When the timing signals are input from the timing sensors 17, 17, the light emission control means 30 outputs a light emission signal to the light emitting means 7 and causes the light emitting elements 9 to emit light toward the lower surface of the coin 1 located on the first transparent passage portion 3.

When the image reading control means 31 receives the timing signals from the timing sensors 17, 17, in accordance with the denomination discrimination signal input from the first discriminating means 43, if the image reading control means 31 judges that the coin 1 is made of a material having high light reflectivity such as nickel, aluminum or the like, it outputs a reading operation start signal to the color sensor 13 when a predetermined time period has passed, thereby causing it to read light reflected by the coin 1. On the other hand, if the image reading control means 31 judges that the coin 1 is made of a material having low light reflectivity such as copper, brass or the like, it immediately outputs the reading operation start signal to the color sensor 13, thereby causing it to read light reflected by the coin 1. The image reading is thus controlled based on the discrimination result of the denomination of the coin 1 by the first discriminating means 43 when the color sensor 13 starts. This is because the amount of reflected light changes depending upon the material of the coin 1. If the same amount of light is emitted toward the coin 1, the image pattern of the coin 1 cannot be accurately detected. That is, when the coin is made of a material having high light reflectivity such as nickel, aluminum or the like, it becomes difficult to accurately produce the image pattern of the surface of the coin 1 by detecting the reflected light from the surface of the coin 1. This is because the total amount of detected light becomes large and saturated if the light receiving time is long. On the other hand, when the coin is made of a material having low light reflectivity such as copper, brass or the like, the image pattern of the surface of the coin 1 cannot be accurately produced by detecting the reflected light from the surface of the coin 1. This is because the total amount of detected light is too little if the light receiving time is short. Thus, the image reading control means 31 is constituted such that when the coin 1 of the denomination discriminated by the first discriminating means 43 is made of a material having high light reflectivity such as nickel, aluminum or the like, the image reading control means 31 effects control so that the color sensor 13 detects the reflected light from the coin 1 for a shorter time period. On the other hand, it is constituted such that when the coin 1 of the denomination discriminated by the first discriminating means 43 is made of a material having low light reflectivity such as copper, brass or the like, the image reading control means 31 effects control so that the color sensor 13 detects the reflected light from the coin 1 for a longer time period.

The pattern data of the lower surface of the coin 1 produced by the color sensor 13 and digitized by the A/D converter 18 are mapped and stored in the x-y coordinate system and stored in the image pattern data memory 50. FIG. 11 shows one example of image pattern data of the coin 1 mapped and stored in the image pattern data memory 50.

When the image pattern data of the lower surface of the coin 1 are stored in the image pattern data memory 50, the first denomination discriminating section 51 of the second discriminating means 44 accesses the second reference data memory 41. It reads the data stored in the second reference data memory 41 with regard to the diameter of the coin 1 and also the image pattern data stored in the image pattern data memory 50. By comparing these data, the first denomination discriminating section 51 of the second discriminating means 43 determines the denomination of the coin 1 and outputs a denomination discrimination signal to the second denomination discriminating section 53.

In this embodiment, the first denomination discriminating section 51 of the second discriminating means 44 selects two denominations whose diameters are the closest and the second closest to the diameter of the detected coin 1 and outputs the denomination discrimination signal to the second denomination discriminating section 53.

The second denomination discriminating section 53 determines the denomination of the coin 1 based on the denomination discrimination signal input from the first discriminating means 43 and the denomination discrimination signal input from the first denomination discriminating section 51 of the second discriminating means 44. When the determined results of the first discriminating means 43 and the first denomination discriminating section 51 of the second discriminating means 44 coincide, the second denomination discriminating section 53 outputs a denomination discrimination signal to the coin damage discriminating section 52, the pattern data converting means 71 and the pattern data comparing means 72.

In the same manner as in the above described embodiment, the coin damage discriminating section 52 reads the image pattern data of the lower surface of the coin 1 stored in the image pattern data memory 50 and calculates the chromaticity data and the lightness data of the coin. Further, the coin damage discriminating section 52 accesses the second reference data memory 41, reads, based on the denomination discrimination signal input from the second denomination discriminating section 53, the reference chromaticity data and the reference lightness data of the coin having the denomination discriminated by the second denomination discriminating section 53 and compares the reference chromaticity data and the reference lightness data read from the second reference data memory 41 with the calculated chromaticity data and lightness data of the coin 1, thereby discriminating whether or not the coin 1 is damaged to higher than a predetermined level. As a result, when the coin damage discriminating section 52 determines that the coin 1 is damaged to higher than a predetermined level, it outputs a damage determination signal to the denomination and acceptability discriminating means 46. At the same time, the coin damage discriminating section 52 outputs the damage determination signal to the display means (not shown) and cause it to display that the coin 1 is damaged to higher than a predetermined level.

On the other hand, the center coordinate determining section 54 determines the center coordinate (xc, yc) of the image pattern data mapped and stored in the x-y coordinate system and stored in the image pattern data memory 50 and outputs the center coordinate (xc, yc) to the pattern data converting means 71.

Based on the center coordinates (xc, yc) of the pattern data of the coin 1 input from the center coordinate determining means 54, the pattern data converting means 71 transforms the pattern data of the coin 1 mapped in the x-y coordinate system and stored in the image pattern data memory 50 into an r-θ coordinate system. FIG. 12 shows the converted pattern data thus transformed into the r-θ coordinate system.

On the other hand, based upon the denomination discrimination signal input from the second denomination discriminating section 53 of the second discriminating means 44, the reference pattern data storing means 70 selects the reference pattern data of the reverse surface of the coin 1 corresponding to the denomination from among the reference pattern data mapped into the r-θ coordinate system and stored therein and outputs it to the pattern data comparing means 72. FIG. 13 shows one example of the reference pattern data output from the reference pattern data storing means 70 to the pattern data comparing means 72.

Since the pattern data cannot be produced by the color sensor 13 with the coin 1 in a predetermined angular orientation and the coin 1 is normally offset angularly from the coin 1 used for producing the reference pattern data, as is clear from FIGS. 12 and 13, the converted pattern data is normally offset along the abscissa, namely, the θ axis, with respect to the reference pattern data. Therefore, it is necessary to correct the deviation of the converted pattern data in the θ direction and discriminate the coin 1 by comparing the converted pattern data with the reference pattern data.

Accordingly, the pattern data comparing means 72 reads the pattern data values of the converted pattern data shown in FIG. 12 over 360 degrees whose ordinate values are equal to a predetermined value r0 and reads the pattern data values of the reference pattern data shown in FIG. 13 over 360 degrees whose ordinate values are equal to a predetermined value r0.

FIGS. 14 and 15 are graphs obtained by plotting the thus read converted pattern data values and reference pattern data values whose ordinate values are equal to a predetermined value r0. The pattern data comparing means 72 further calculates θ values at which the converted pattern data values and the reference pattern data values become maximum respectively. The thus obtained θ value is θ1 in FIG. 14 and the θ value is θ2 in FIG. 15.

When θ1 and θ2 are obtained in this manner, the pattern data comparing means 72 remaps the converted pattern data so that θ1 becomes equal to θ2. FIG. 16 shows an example of the converted pattern data thus remapped by the pattern data comparing means 72. Since the deviation of the converted pattern data in the θ direction caused by the angular offset of the coin 1 has been corrected by remapping the converted pattern data, it is possible for the pattern data comparing means 72 to discriminate whether the denomination of the coin 1 coincides with that determined by the second denomination discriminating section 53 of the second discriminating means 44 and whether or not the coin 1 is an unacceptable coin such as a counterfeit coin, a foreign coin or the like by pattern matching the converted pattern data with the reference pattern data.

However, since it is impossible to feed the coin 1 so that one surface thereof always faces upward, if the coin is fed in such a manner that the reverse surface faces upward, the remapped converted pattern data never coincides with the reference pattern data of the reverse surface of the coin 1 of the denomination determined by the second denomination discriminating section 53 of the second discriminating means 44. Therefore, when the remapped converted pattern data does not coincides with the reference pattern data of the reverse surface of the coin 1 of the denomination selected in accordance with the denomination discrimination signal input from the second denomination discriminating section 53 of the second discriminating means 44, if the coin 1 is immediately discriminated as a counterfeit coin or a foreign coin, the coin discrimination accuracy becomes lowered.

Accordingly, in this embodiment, the converted pattern data is first compared with the reference pattern data of the reverse surface of the coin 1 of the denomination determined by the second denomination discriminating section 53 and if they do not coincide, the converted pattern data is compared with the reference pattern data of the obverse surface of the coin 1 of the denomination in the same manner, thereby discriminating whether the denomination of the coin 1 coincides with that tentatively determined by the second denomination discriminating section 53 and whether or not the coin 1 is an unacceptable coin such as a counterfeit coin, a foreign coin or the like.

As a result, when the pattern data comparing means 72 discriminates that the coin 1 is an unacceptable coin, it causes the display means (not shown) to display such fact and when the pattern data comparing means 72 discriminates that the coin 1 is a coin of denomination discriminated by the second denomination discriminating section 53 of the second discriminating means 44, it outputs the denomination discrimination signal to the denomination and acceptability determining means 46.

The coin 1 is further fed to the second transparent passage portion 4 in the coin passage 2 and when light emitted from the light emitting element 26 of each timing sensor 28 is blocked by the coin 1 and the light receiving element 27 does not receive the light emitted from the light emitting element 26, timing signals are output from the timing sensors 28, 28 to the light emission control means 30 and the image reading control means 31.

When the timing signals are input from the timing sensors 28, 28, the light emission control means 30 outputs a light emission signal to the light emitting elements 23 and causes them to emit light toward the upper surface of the coin 1 located on the second transparent passage portion 4.

When the image reading control means 31 receives the timing signals from the timing sensors 28, 28, it causes the color sensor 25 of the second image data producing means 22 to start detecting light emitted from the light emitting elements 23 and reflected by the upper surface of the coin 1.

At the same time, in response to the input of the timing signals from the timing sensors 28, 28, the image reading control means 31 controls the image reading start time in accordance with the material of the coin 1 determined based on the denomination discrimination signal input from the first discriminating means 43 in the same manner as the control of the image reading start time of the color sensor 13.

Since the light emitting means 21 is disposed so as to be able to illuminate the coin 1 which advances on the second transparent passage portion 4 at a shallow angle, the light is reflected according to the raised and depressed pattern of the upper surface of the coin 1. The light reflected from the surface of the coin 1 is directed toward the color sensor 25 by the lens system 24 and photoelectrically detected by the color sensor 25, whereby the image pattern data of the surface of the coin 1 are produced by the color sensor 25. The image pattern data of the surface of the coin 1 produced by the color sensor 25 are digitized by the A/D converter 29. The digitized image pattern data are mapped and stored in the orthogonal coordinate system, namely, the x-y coordinate system, in the image pattern data memory 60.

When the image pattern data of the upper surface of the coin 1 are stored in the image pattern data memory 60, the first denomination discriminating section 61 of the third discriminating means 45 accesses the second reference data memory 41. It reads the data stored in the second reference data memory 41 with regard to the diameter of the coin 1 and also the image pattern data stored in the image pattern data memory 60. By comparing these data, the first denomination discriminating section 61 of the third discriminating means 45 determines the denomination of the coin 1 and outputs the denomination discrimination signal to the second denomination discriminating section 63.

In this embodiment, based on the detected diameter of the coin 1, the first denomination discriminating section 61 of the third discriminating means 45 selects two denominations, whose diameters are the closest and the second closest to the diameter of the detected coin 1 and outputs the denomination discrimination signal to the second denomination discriminating section 63.

The second denomination discriminating section 63 determines the denomination of the coin 1 based on the denomination discrimination signal input from the first discriminating means 43 and the denomination discrimination signal input from the first denomination discriminating section 61 of the third discriminating means 45. When the determined results of the first discriminating means 43 and the first denomination discriminating section 61 of the third discriminating means 45 coincide, the second denomination discriminating section 63 outputs a denomination discrimination signal to the pattern data converting means 76, the pattern data comparing means 77 and the coin damage discriminating section 62.

In the same manner as in the above described embodiment, the coin damage discriminating section 62 reads the image pattern data of the upper surface of the coin 1 stored in the image pattern data memory 60 and calculates the chromaticity data and the lightness data of the coin 1 based on the R, G and B data in the image pattern data. Further, the coin damage discriminating section 62 accesses the second reference data memory 41, reads, based on the denomination discrimination signal input from the second denomination discriminating section 63, the reference chromaticity data and the reference lightness data of the coin having the denomination discriminated by the second denomination discriminating section 63 and compares the reference chromaticity data and the reference lightness data read from the second reference data memory 41 with the calculated chromaticity data and lightness data of the coin 1, thereby discriminating whether or not the coin 1 is damaged to higher than a predetermined level. When the coin damage discriminating section 62 determines that the coin 1 is damaged to higher than a predetermined level, it outputs a damage determination signal to the denomination and acceptability discriminating means 46. At the same time, the coin damage discriminating section 62 outputs the damage determination signal to the display means (not shown) and cause it to display that the coin 1 is damaged to higher than a predetermined level.

On the other hand, the center coordinate determining section 64 determines the center coordinate (xc, yc) of the image pattern data mapped and stored in the x-y coordinate system and stored in the image pattern data memory 60 and outputs the center coordinate (xc, yc) to the pattern data converting means 76.

Based on the center coordinates (xc, yc) of the pattern data of the coin 1 input from the center coordinate determining means 64, the pattern data converting means 76 transforms the pattern data of the coin 1 mapped in the x-y coordinate system and stored in the image pattern data memory 60 into an r-θ coordinate system.

On the other hand, based upon the denomination discrimination signal input from the second denomination discriminating section 63 of the third discriminating means 45, the reference pattern data storing means 70 selects the reference pattern data of the reverse surface of the coin 1 corresponding to the denomination from among the reference pattern data mapped into the r-θ coordinate system and stored therein and outputs it to the pattern data comparing means 77.

In the same manner as the pattern data comparing means 72 of the second discriminating means 44, the pattern data comparing means 76 of the third discriminating means 45 corrects the deviation of the converted pattern data in the θ direction and remaps the converted pattern data. By pattern matching the thus corrected converted pattern data with the reference pattern data, the pattern data comparing means 77 of the third discriminating means 45 then discriminates whether or not the coin 1 is the coin of the denomination discriminated by the second denomination discriminating section 63 of the third discriminating means 45 and whether or not the coin 1 is an unacceptable coin such as a counterfeit coin, a foreign coin or the like.

As a result, when the pattern data comparing means 77 discriminates that the coin 1 is an unacceptable coin, it causes the display means (not shown) to display such fact and when it discriminates that the coin 1 is the coin of the denomination discriminated by the second denomination discriminating section 63 of the third discriminating means 45, it outputs the denomination discrimination signal to the denomination and acceptability determining means 46.

The denomination and acceptability determining means 46 carries out a denomination based on the denomination discrimination signal input from the first discriminating means 43 and based on the magnetic properties of the coin 1, the denomination discrimination signal input from the pattern data comparing means 72 of the second discriminating means 44 and based on the diameter data and the image pattern data of the coin 1, the presence of the damage discrimination signal input from the coin damage discriminating section 52 and based on the chromaticity data and the lightness data of the coin 1, the denomination discrimination signal input from the pattern data comparing means 77 of the third discriminating means 45 and based on the diameter data and the image pattern data of the coin 1 and the presence of the damage discrimination signal input from the coin damage discriminating section 62 and based on the chromaticity data and the lightness data of the coin 1. When the denomination and acceptability determining means 46 finds that the denominations determined by the first discriminating means 43, the second discriminating means 44 and the third discriminating means 45 coincide with each other, it discriminates that the coin 1 is acceptable. On the other hand, when they do not coincide with each other, the denomination and acceptability determining means 46 discriminates that the coin 1 is either a counterfeit coin or a foreign coin and is not acceptable and outputs an unacceptable signal to the display means (not shown) to cause it to display that the coin 1 is not acceptable. More specifically, for example, when the second discriminating means 44 discriminates that the pattern data of the lower surface of the coin 1 coincide with the reference pattern of the obverse surface of a coin of a certain denomination and the third discriminating means 45 determines that the pattern data of the upper surface of the coin 1 coincide with the reference pattern of the reverse surface of the coin of the denomination or in the case where Euro coins are to be discriminated, when one of the second discriminating means 44 and the third discriminating means 45 discriminates that a common pattern is formed on one side surface of the coin 1 and the other of the second discriminating means 44 and the third discriminating means 45 discriminates that a pattern peculiar to an issuing country is formed on the other side surface of the coin 1, the denomination and acceptability determining means 46 determines that the coin 1 is acceptable only when the denomination of the coin 1 determined by the second discriminating means 44 and the third discriminating means 45 coincides with the denomination of the coin 1 determined by the first discriminating means 43 and determines that the coin 1 is the coin of the denomination determined by the first discriminating means 43, the second discriminating means 44 and the third discriminating means 45. Otherwise, the denomination and acceptability determining means 46 determines that the coin 1 is an unacceptable coin.

In this manner, coins discriminated as unacceptable are sorted and collected separately from coins discriminated as acceptable. Further, even though it is discriminated that a coin is acceptable, when it is discriminated that at least one surface thereof is damaged to higher than a predetermined level, it is collected separately from coins discriminated as acceptable.

According to the above described embodiment, patterns of both surfaces of the coin 1 are detected for discriminating whether or not the coin 1 is acceptable. Therefore, it is possible to sort coins such as Euro coins, on one surface of which a common pattern is formed and on the other surface of which a different pattern is formed depending upon the issuing countries, into coins of each issuing country, as occasion demands. Further, since patterns of both surfaces of a coin 1 are detected for discriminating whether or not the coin 1 is damaged to higher than a predetermined level, it is possible to reliably discriminate the coin one of the surfaces of which is damaged to higher than a predetermined level as a damaged coin and collect it.

Furthermore, according to the above described embodiment, the first discriminating means 43 discriminates the denomination of a coin 1 based on magnetic properties of the coin 1 detected by the magnetic sensors 6, 6, the first denomination discriminating section 51 of the second discriminating means 44 discriminates the denomination of the coin 1 based on the diameter of the coin 1 and the second denomination discriminating section 53 of the second discriminating means 44 is constituted so as to tentatively determine the denomination of the coin 1 based on the discrimination results made by the first discriminating means 43 and the first denomination discriminating section 51 of the second discriminating means 44. The denomination determining section 56 of the second discriminating means 44 discriminates the denomination of the coin 1 by comparing the pattern data of the coin 1 with only the reference data of the coin of the denomination determined by the first denomination discriminating section 51 of the second discriminating means 44 and the third discriminating means 45 discriminates the denomination of the coin 1 in the same manner as in the second discriminating means 44. Whether or not the coin 1 is acceptable and the denomination of the coin 1 are finally discriminated based on the discriminating results made by the first discriminating means 43, the second discriminating means 44 and the third discriminating means 45. Therefore, it is possible to shorten the time required to make discrimination of coins and discriminate whether or not the coin 1 is acceptable and the denomination of the coin 1 with high accuracy in comparison with the case where the coin discrimination is made by comparing the pattern data of the coin 1 with reference data of coins of all denominations.

Moreover, according to the previous embodiment, the denomination of the coin 1 and whether or not the coin 1 is acceptable are discriminated based on only the ratio of the "0" data in the binary image pattern data groups corresponding to each annular area of the coin 1. Therefore, even though the coin 1 is a counterfeit coin or a foreign coin and an unacceptable coin, the ratio data which corresponds to the ratio of the "0" data in the binary image pattern data groups corresponding to each annular area of the coin 1 may perchance to coincide with the reference ratio data of the coin of the denomination determined by the second denomination discriminating sections 53, 63. However, according to this embodiment, since the coin 1 is discriminated by detecting the pattern of the entire surface of the coin 1 to produce the pattern data and comparing the thus produced pattern data with the reference pattern data of coin of the denomination determined by the second denomination discriminating sections 53, 63, the discriminating accuracy of the coin 1 can be improved.

Further, according to the above described embodiment, the deviation of the converted pattern data in the θ direction caused by the angular offset of a coin 1 can be corrected only by obtaining the values θ1 and θ2 at which the respective data values of the converted pattern data and the reference pattern data become maximum and remapping the converted pattern data so that θ1 becomes equal to θ2. It is therefore possible to shorten the time for calculation, whereby coins 1 can be discriminated at high speed. Moreover, when the coin 1 is made of a material having low light reflectivity, the color sensors 13, 25 are controlled so as to detect light reflected from the coin 1 for a long time and when the coin 1 is made of a material having high light reflectivity, the color sensors 13, 25 are controlled so as to detect light reflected from the coin 1 for a short time. Therefore, irrespective whether the coin 1 is made of a material having a high or low light reflectivity, it is always possible to produce the converted pattern data in accordance with the surface pattern of the coin 1 and accurately determine the denomination of the coin 1 and whether or not the coin 1 is acceptable.

Figure 17:
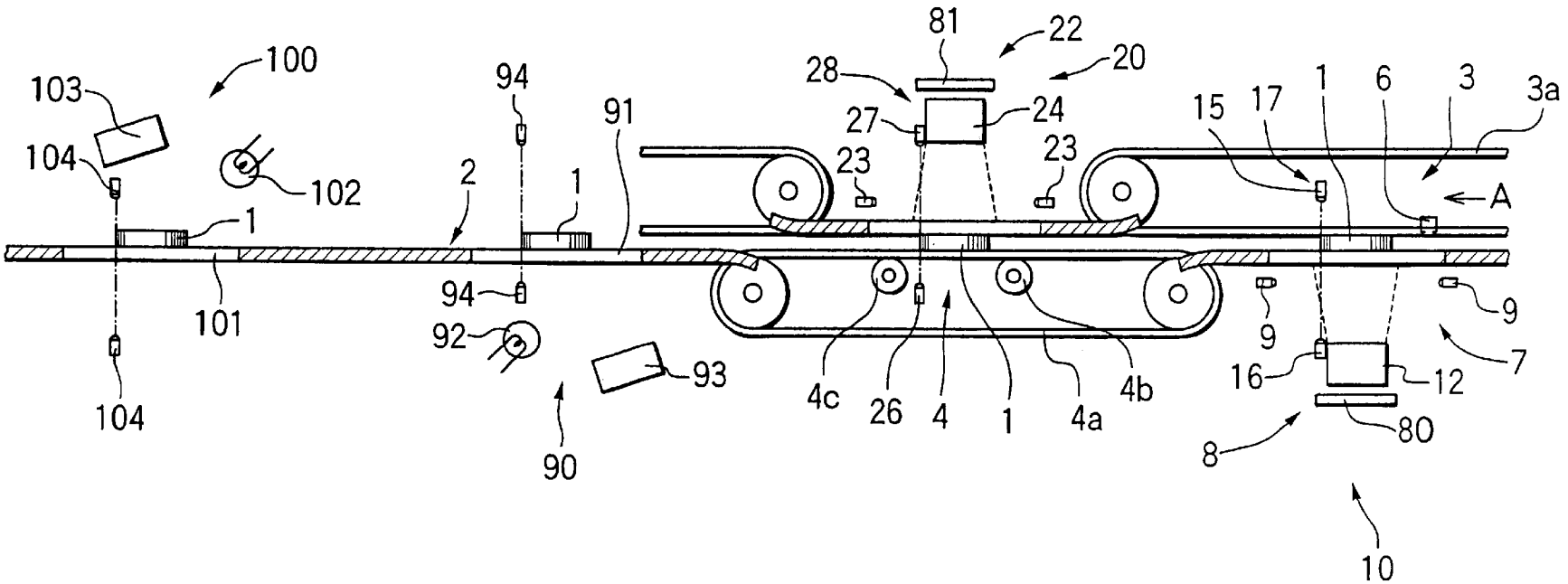
FIG. 17 is a schematic front view of a coin discriminating apparatus which is another embodiment of the present invention.

FIG. 17 is a block diagram of detection, control and discrimination systems of a coin discriminating apparatus which is another embodiment of the present invention.

As shown in FIG. 17, the coin discriminating apparatus according to this embodiment is provided with a monochromatic type CCD 80 instead of the color sensor 13 of the first pattern data detection unit 10 and a monochromatic type CCD 81 instead of the color sensor 25 of the second pattern data detection unit 20, and a first coin damage discriminating unit 90 and a second coin damage discriminating unit 100 are provided downstream of the second pattern data detection unit 20 in the coin passage 2. In this embodiment, the second discriminating means 44 and the third discriminating means 45 are not provided with the coin damage discriminating section 52 and the coin damage discriminating section 62 so that the first pattern data detection unit 10 and the second pattern data detection unit 20 are adapted for only discriminating whether or not the coin 1 is acceptable and the denomination of the coin 1, and whether or not the coin 1 is damaged to higher than a predetermined level is discriminated by the first coin damage discriminating unit 90 and the second coin damage discriminating unit 100.

Although not shown in FIG. 17, in the same manner as in the embodiment shown in FIG. 1, a transporting belt belt for transporting the coin 1 is disposed above the first transparent passage portion 3 in the first pattern data detection unit 10 and a transporting belt is disposed below the second transparent passage portion 4 in the second pattern data detection unit 20. Further, a transporting belt is disposed above a third transparent passage portion 91 in the first coin damage discriminating unit 90 and a transporting belt is disposed below a fourth transparent passage portion 101 in the second coin damage discriminating unit 100.

As shown in FIG. 17, the first coin damage discriminating unit 90 includes a white light source 92 below the third transparent passage portion 91 formed in the coin passage 2 and a single-detection element type color sensor 93 is provided at a position where light emitted from the white light source 92 and reflected by the lower surface of the coin 1 can be detected. The second coin damage discriminating unit 100 includes a white light source 102 above the fourth transparent passage portion 101 formed in the coin passage 2 and a single-detection element type color sensor 103 is provided at a position where light emitted from the white light source 102 and reflected by the upper surface of the coin 1 can be detected. The first coin damage discriminating unit 90 and the second coin damage discriminating unit 100 are provided with timing sensors 94, 94 and timing sensors 104, 104 like the first pattern data detection unit 10 and the second pattern data detection unit 20.

Figure 18:
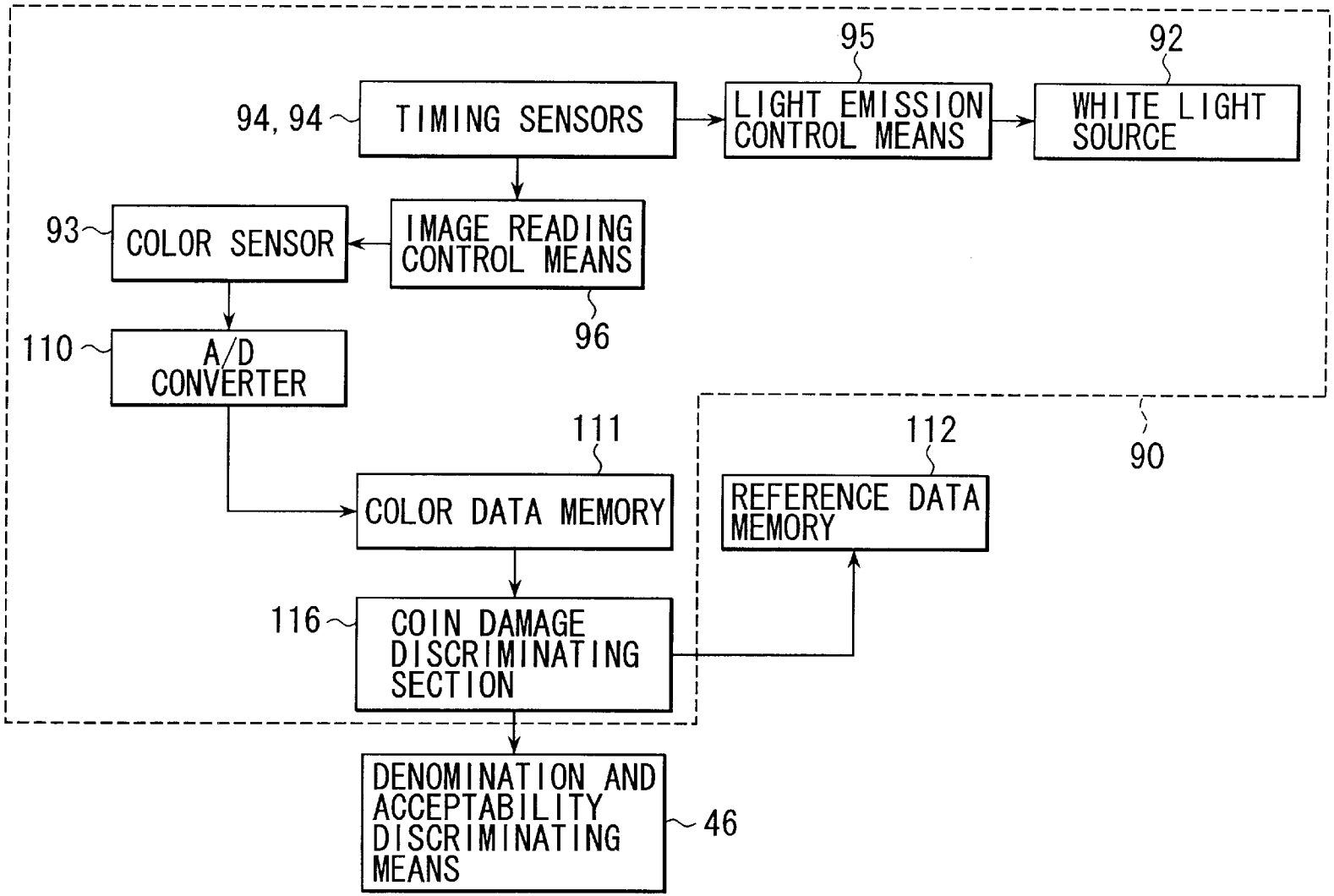
FIG. 18 is a block diagram of detection, control and discrimination systems of a first coin damage discriminating unit.

FIG. 18 is a block diagram of detection, control and discrimination systems of the first coin damage discriminating unit 90.

As shown in FIG. 18, the detection system of the first coin damage discriminating unit 90 includes the timing sensors 94, 94.

As shown in FIG. 18, the control system of the first coin damage discriminating unit 90 includes light emission control means 95 for controlling the white light source 92 in accordance with detection signals from the timing sensors 94, 94 and image reading control means 96 for controlling the color sensor 93 in accordance with detection signals from the timing sensors 94, 94.

As shown in FIG. 18, the discrimination system of the first coin damage discriminating unit 90 includes a color data memory 111 for storing color data of the lower surface of the coin 1 photoelectrically detected by the color sensor 93 and digitized by an A/D converter 110, a reference data memory 112 for storing reference chromaticity data and reference lightness data of coins of each denomination, and a coin damage discriminating section 116 for calculating chromaticity data and lightness data of the lower surface of the coin 1 based on R data, G data and B data in the color data of the lower surface of the coin 1 stored in the color data memory 111, comparing the thus calculated chromaticity data and lightness data with the reference chromaticity data and the reference lightness data stored in the reference data memory 112, determining whether or not the coin 1 is damaged to higher than a predetermined level in the same manner as in the coin damage discriminating section 52 and the coin damage discriminating section 62, outputting a damage discrimination signal to the denomination and acceptability determining means 46 when it determines that the coin 1 is damaged to higher than a predetermined level, and causing a display means (not shown) to display that the coin 1 is damaged to higher than a predetermined level.

Figure 19:
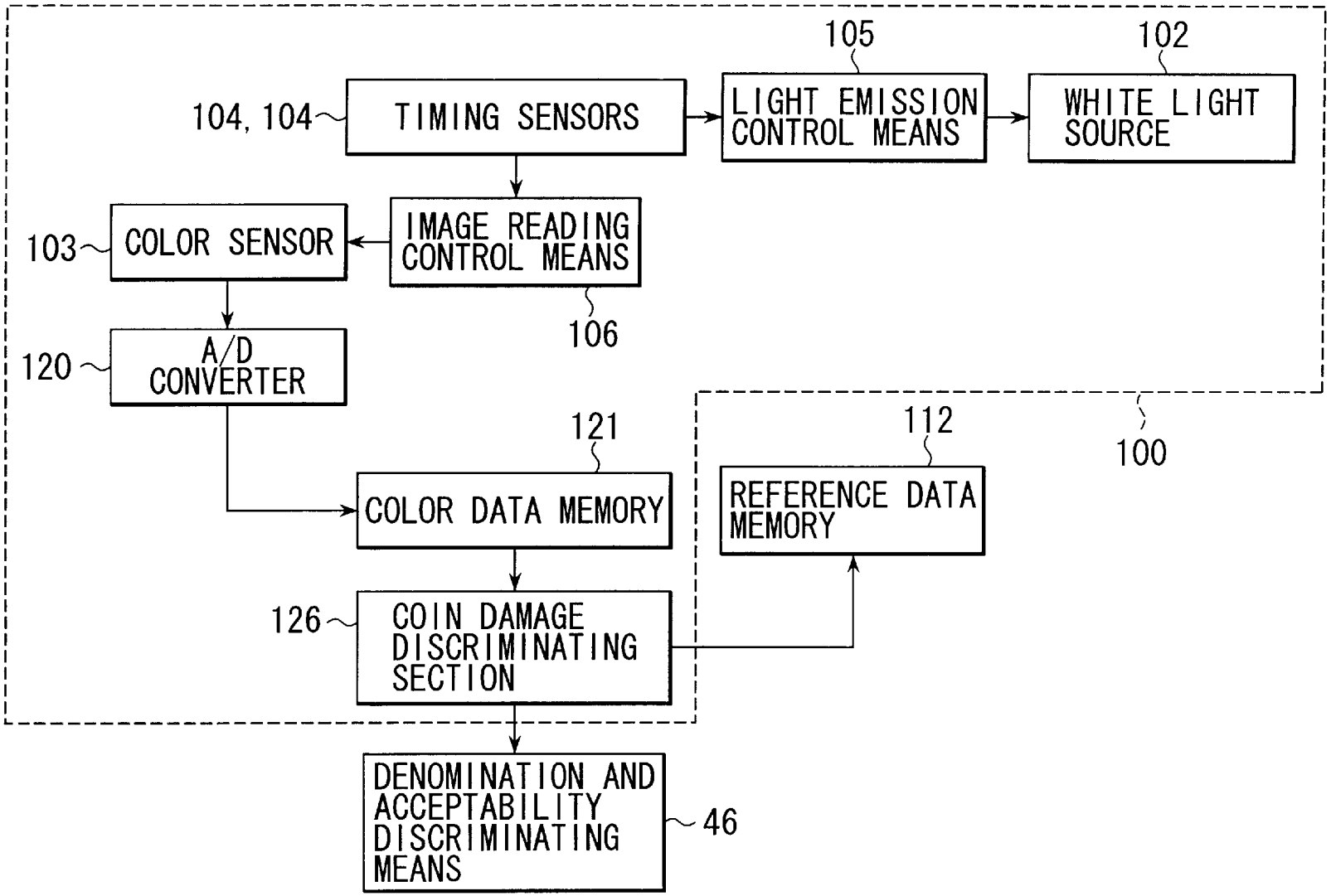
FIG. 19 is a block diagram of detection, control and discrimination systems of a second coin damage discriminating unit.

FIG. 19 is a block diagram of detection, control and discrimination systems of the second coin damage discriminating unit 100.

As shown in FIG. 19, the detection system of the second coin damage discriminating unit 100 includes the timing sensors 104, 104.

As shown in FIG. 19, the control system of the second coin damage discriminating unit 100 includes light emission control means 105 for controlling the white light source 102 in accordance with detection signals from the timing sensors 104, 104 and image reading control means 106 for controlling the color sensor 103 in accordance with detection signals from the timing sensors 104, 104.

As shown in FIG. 19, the discrimination system of the second coin damage discriminating unit 100 includes a color data memory 121 for storing color data of the upper surface of the coin 1 photoelectrically detected by the color sensor 103 and digitized by an A/D converter 120, and a coin damage discriminating section 126 for calculating chromaticity data and lightness data of the lower surface of the coin 1 based on R data, G data and B data in the color data of the upper surface of the coin 1 stored in the color data memory 121, comparing the thus calculated chromaticity data and lightness data with the reference chromaticity data and the reference lightness data stored in the reference data memory 112, determining whether or not the coin 1 is damaged to higher than a predetermined level in the same manner as in the coin damage discriminating section 52 and the coin damage discriminating section 62, outputting a damage discrimination signal to the denomination and acceptability determining means 46 when it determines that the coin 1 is damaged to higher than a predetermined level, and causing a display means (not shown) to display that the coin 1 is damaged to higher than a predetermined level.

In the thus constituted coin discriminating apparatus according to this embodiment, the first coin damage discriminating unit 90 and the second coin damage discriminating unit 100 discriminate whether or not the coin 1 is damaged to higher than a predetermined level in the following manner.

When the timing sensors 94, 94 detect the coin 1, detection signals are output to the light emission control means 95 and the image reading control means 96.

When the timing signals are input from the timing sensors 94, 94, the light emission control means 95 turns on the white light source 92 at a predetermined time and the image reading control means 96 causes the color sensor 80 to start detecting light at a predetermined time.

Light emitted from the white light source 92 and reflected by the lower surface of the coin 1 is photoelectrically detected by the color sensor 93 and color data are produced. The color data produced by the color sensor 93 are digitized by the A/D converter 110 and stored in the color data memory 111 as color data of the lower surface of the coin 1.

The coin damage discriminating section 116 reads, in accordance with the detection signals from the first pattern data detection unit 10 and the second pattern data detection unit 20, the reference chromaticity data and the reference lightness data of coins of the denomination discriminated by the first pattern data detection unit 10 and the second pattern data detection unit 20 from the reference data memory 112, calculates chromaticity data of the lower surface of the coin 1 based on the R data, G data and B data in the color data of the lower surface of the coin 1 stored in the color data memory 111, compares the thus calculated chromaticity data of the lower surface of the coin 1 with the reference chromaticity data, thereby discriminating the coin 1 based on the chromaticity data and outputs a denomination discrimination signal to the denomination and acceptability determining means 46. The coin damage discriminating section 116 further calculates lightness data of the lower surface of the coin 1 based on the R data, G data and B data in the color data of the lower surface of the coin 1 stored in the color data memory 111, compares the thus calculated chromaticity data and the lightness data of the lower surface of the coin 1 with the reference chromaticity data and the reference lightness data, determines whether or not the lower surface of the coin 1 is damaged to higher than a predetermined level in the same manner as in the coin damage discriminating section 52 and the coin damage discriminating section 62. As a result, when the coin damage discriminating section 116 determines that the lower surface of the coin 1 is damaged to higher than a predetermined level, it outputs a coin damage discrimination signal to the denomination and acceptability determining means 46 and the display means (not shown), thereby causing the display means to display that the lower surface of the coin 1 is damaged to higher than a predetermined level.

The coin 1 is further fed downstream in the coin passage and when the timing sensors 104, 104 detect the coin 1, detection signals are output to the light emission control means 105 and the image reading control means 106.

When the timing signals are input from the timing sensors 104, 104, the light emission control means 105 turns on the white light source 102 at a predetermined timing and the image reading control means 106 causes the color sensor 103 to start detecting light at a predetermined timing.

Light emitted from the white light source 102 and reflected by the upper surface of the coin 1 is photoelectrically detected by the color sensor 103 and color data are produced. The color data produced by the color sensor 103 are digitized by the A/D converter 120 and stored in the color data memory 121 as color data of the upper surface of the coin 1.

The coin damage discriminating section 126 reads, in accordance with the detection signals from the first pattern data detection unit 10 and the second pattern data detection unit 20, the reference chromaticity data and the reference lightness data of coins of the denomination discriminated by the first pattern data detection unit 10 and the second pattern data detection unit 20 from the reference data memory 112, calculates chromaticity data of the upper surface of the coin 1 based on the R data, G data and B data in the color data of the lower surface of the coin 1 stored in the color data memory 121, compares the thus calculated chromaticity data of the upper surface of the coin 1 with the reference chromaticity data, thereby discriminating the coin 1 based on the chromaticity data and outputs a denomination discrimination signal to the denomination and acceptability determining means 46. The coin damage discriminating section 126 further calculates lightness data of the upper surface of the coin 1 based on the R data, G data and B data in the color data of the upper surface of the coin 1 stored in the color data memory 121, compares the thus calculated chromaticity data and the lightness data of the upper surface of the coin 1 with the reference chromaticity data and the reference lightness data, determines whether or not the upper surface of the coin 1 is damaged to higher than a predetermined level in the same manner as in the coin damage discriminating section 52 and the coin damage discriminating section 62. As a result, when the coin damage discriminating section 126 determines that the upper surface of the coin 1 is damaged to higher than a predetermined level, it outputs a coin damage discrimination signal to the denomination and acceptability determining means 46 and the display means (not shown), thereby causing the display means to display that the upper surface of the coin 1 is damaged to higher than a predetermined level.

Even though the denominations of coins are different, the compositions and materials may perchance to coincide with each other, and therefore, when the denomination of the coin 1 is discriminated based on the chromaticity data, two or more denominations may match. In such a case, the coin damage discriminating section 116 and the coin damage discriminating section 126 are constituted so as to output two or more denomination discrimination signals to the denomination and acceptability determining means 46.

The denomination and acceptability determining means 46 finally discriminates whether or not the coin 1 is acceptable and the denomination of the coin 1 based on the denomination discrimination signals input from the coin damage discriminating section 116 and the coin damage discriminating section 126, in addition to the result of the discrimination made based on magnetic properties of the coin 1 detected by the magnetic sensors 6, 6, and the results of discrimination made by the first pattern data detection unit 10 and the second pattern data detection unit 20 based on the diameter of the coin 1 and the patterns of the obverse and reverse surfaces of the coin 1.

According to the above described embodiment, the first pattern data detection unit 10 and the second pattern data detection unit 20 detect the patterns of both surfaces of the coin 1 and the first coin damage discriminating unit 90 and the second coin damage discriminating unit 100 detect the chromaticity data of the obverse and reverse surfaces of the coin 1, thereby discriminating whether or not the coin 1 is acceptable and the denomination of the coin 1. Therefore, it is possible to sort coins such as Euro coins, on one surface of which a common pattern is formed and on the other surface of which a different pattern is formed, depending upon the issuing countries into coins of each issuing country, as occasions demand. Further, since both surfaces of the coin 1 are detected by the first coin damage discriminating unit 90 and the second coin damage discriminating unit 100 for discriminating whether or not the coin 1 is damaged to higher than a predetermined level, it is possible to reliably discriminate the coin one of the surfaces of which is damaged to higher than a predetermined level as a damaged coin and collect it.

Figure 20:
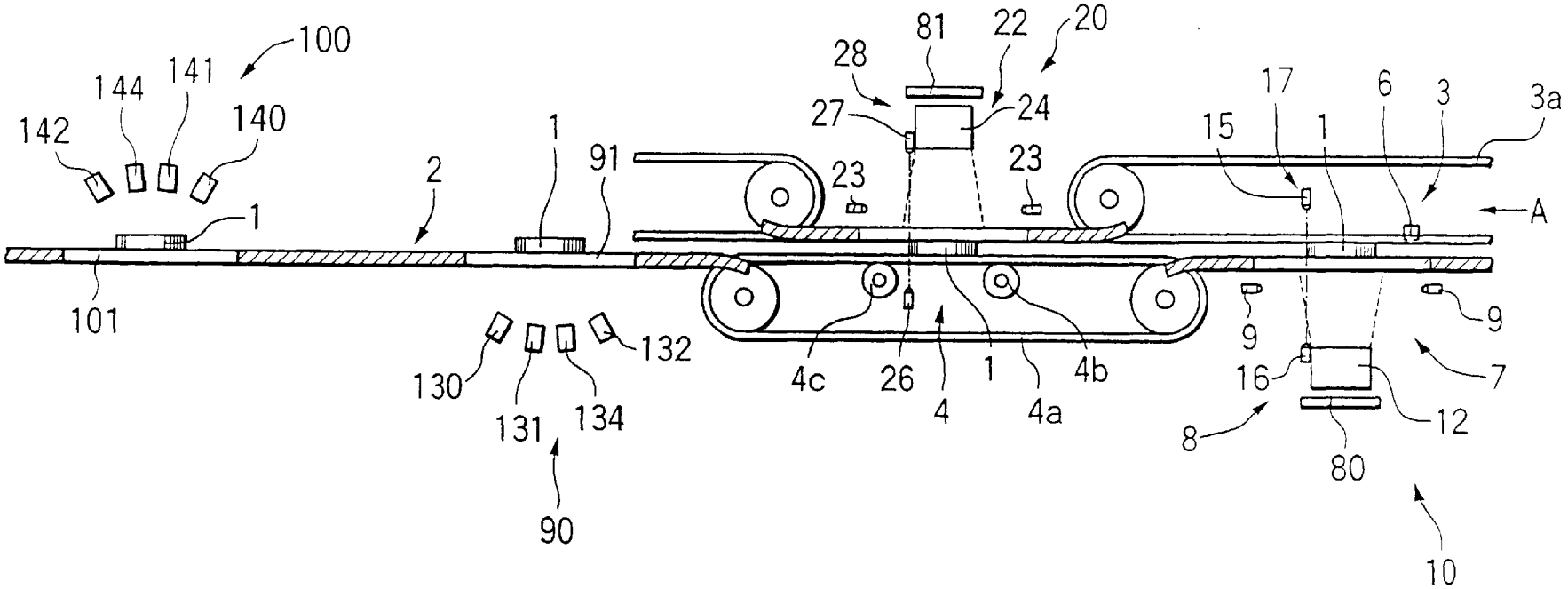
FIG. 20 is a schematic front view of a coin discriminating apparatus which is a further embodiment of the present invention.

FIG. 20 is a schematic front view of a coin discriminating apparatus which is a further embodiment of the present invention.

As shown in FIG. 20, similarly to the coin discriminating apparatus shown in FIGS. 17 to 19, the coin discriminating apparatus according to this embodiment is provided with a monochromatic type CCD 80 instead of the color sensor 13 of the first pattern data detection unit 10 and a monochromatic type CCD 81 instead of the color sensor 25 of the second pattern data detection unit 20 and a first coin damage discriminating unit 90 and a second coin damage discriminating unit 100 are provided downstream of the second pattern data detection unit 20 in the coin passage 2. In this embodiment, the second discriminating means 44 and the third discriminating means 45 are not provided with the coin damage discriminating section 52 and the coin damage discriminating section 62 so that the first pattern data detection unit 10 and the second pattern data detection unit 20 are adapted for only discriminating whether or not the coin 1 is acceptable and the denomination of the coin 1, and whether or not the coin 1 is damaged to higher than a predetermined level is discriminated by the first coin damage discriminating unit 90 and the second coin damage discriminating unit 100.

Although not shown in FIG. 20, in the same manner as in the embodiment shown in FIG. 1, a transporting belt for transporting the coin 1 is disposed above the first transparent passage portion 3 in the first pattern data detection unit 10 and a transporting belt is disposed below the second transparent passage portion 4 in the second pattern data detection unit 20. Further, a transporting belt is disposed above a third transparent passage portion 91 in the first coin damage discriminating unit 90 and a transporting belt is disposed below a fourth transparent passage portion 101 in the second coin damage discriminating unit 100.

As shown in FIG. 20, unlike the first coin damage discriminating unit 90 shown in FIGS. 17 to 19, the first coin damage discriminating unit 90 includes a first LED light source 130 for emitting light corresponding to R component, a second LED light source 131 for emitting light corresponding to G component and a third LED light source 132 for emitting light corresponding to B component instead of the white light source 92, and a photosensor 134 instead of the color sensor 93. Further, unlike the second coin damage discriminating unit 100 shown in FIGS. 17 to 19, the second coin damage discriminating unit 100 includes a first LED light source 140 for emitting light corresponding to R component, a second LED light source 141 for emitting light corresponding to G component and a third LED light source 142 for emitting light corresponding to B component instead of the white light source 102, and a photosensor 144 instead of the color sensor 103.

Figure 21:
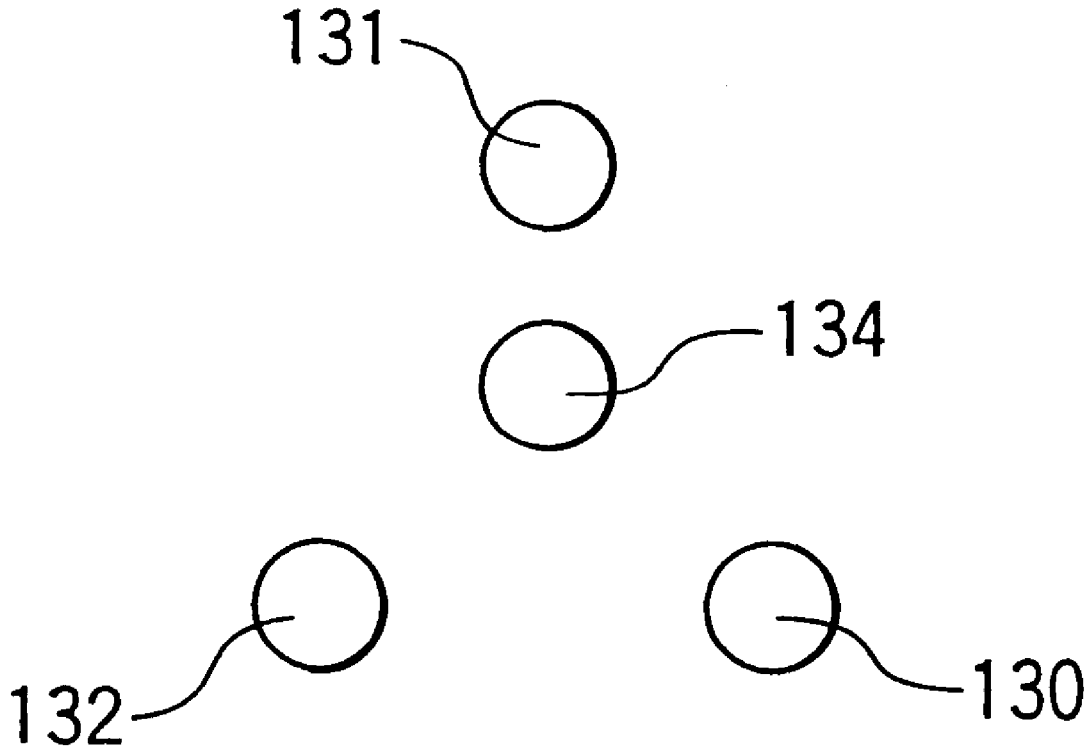
FIG. 21 is a schematic plan view showing the arrangement of a first LED light source, a second LED light source, a third LED light source and a photosensor in a first coin damage discriminating unit.

FIG. 21 is a schematic plan view showing the arrangement of the first LED light source 130, the second LED light source 131, the third LED light source 132 and the photosensor 134 in the first coin damage discriminating unit 90.

As shown in FIG. 21, the first LED light source 130, the second LED light source 131 and the third LED light source 132 are disposed around the photosensor 134 and spaced from each other by 120 degrees so that light emitted by each of the LED light source and reflected from the coin 1 can enter the photosensor 134 under the same condition.

Figure 22:
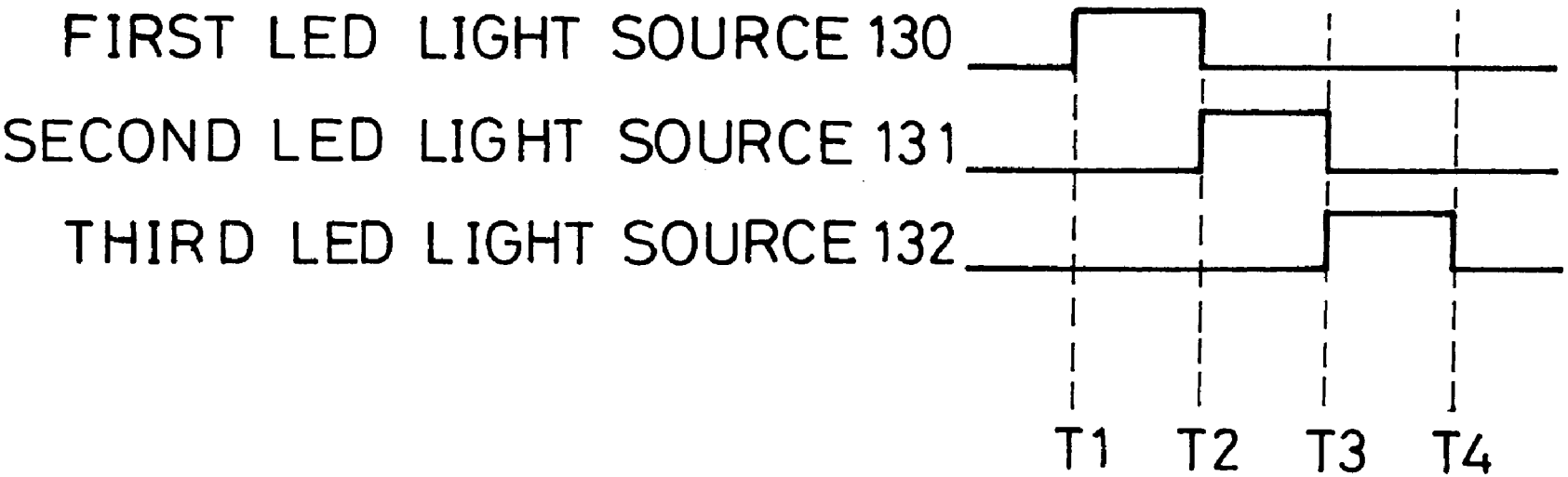
FIG. 22 is a chart showing light emission timing of a first LED light source, a second LED light source and a third LED light source.

FIG. 22 is a chart showing light emission timing of the first LED light source 130, the second LED light source 131 and the third LED light source 132.

As shown in FIG. 22, the first LED light source 130 is turned on from the time T1 to the time T2 so that the lower surface of the coin 1 is illuminated with light of R component and the reflected light is detected by the photosensor 134 and the second LED light source 131 is turned on from the time T2 to the time T3 so that the lower surface of the coin 1 is illuminated with light of G component and the reflected light is detected by the photosensor 134. Further, the third LED light source 132 is turned on from the time T3 to the time T4 so that the lower surface of the coin 1 is illuminated with light of B component and the reflected light is detected by the photosensor 134.

The arrangement of the first LED light source 140, the second LED light source 141, the third LED light source 142 and the photosensor 144 in the second coin damage discriminating unit 100 is the same as that in the first coin damage discriminating unit 90 and the timing for turning on the first LED light source 140, the second LED light source 141 and the third LED light source 142 in the second coin damage discriminating unit 100 is the same as that in the first coin damage discriminating unit 90.

The first coin damage discriminating unit 90 and the second coin damage discriminating unit 100 are provided with the timing sensors 94, 94 and the timing sensors 104, 104, respectively, like the first pattern data detection unit 10 and the second pattern data detection unit 20.

Figure 23:
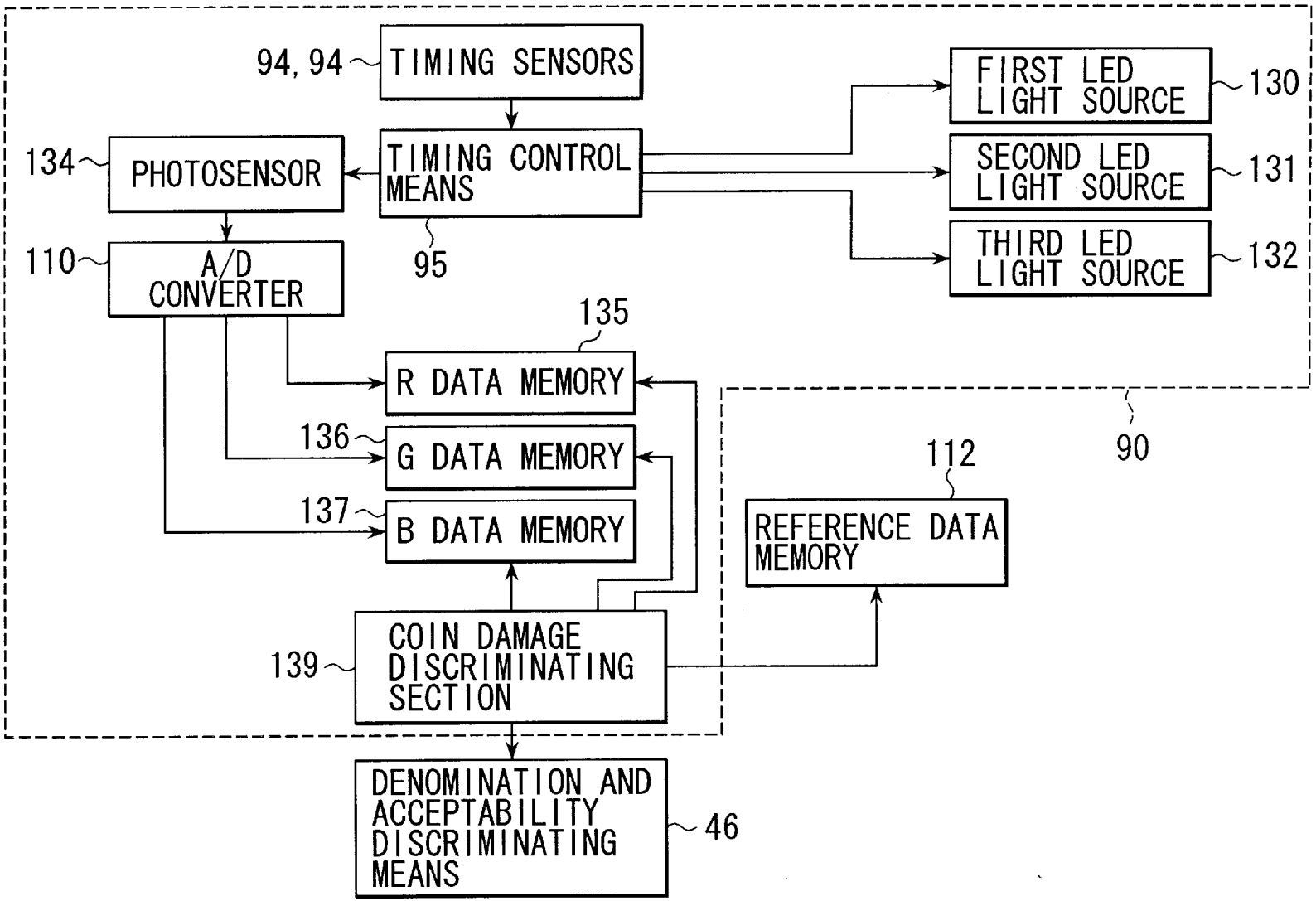
FIG. 23 is a block diagram of detection, control and discrimination systems of a first coin damage discriminating unit.

FIG. 23 is a block diagram of detection, control and discrimination systems of the first coin damage discriminating unit 90.

As shown in FIG. 23, the detection system of the first coin damage discriminating unit 90 includes the timing sensors 94, 94.

As shown in FIG. 23, the control system of the first coin damage discriminating unit 90 includes timing control means 95 for controlling the first LED light source 130, the second LED light source 131 and the third LED light source 132 in accordance with detection signals from the timing sensors 94, 94 and controlling the photosensor 134 in accordance with detection signals from the timing sensors 94, 94.

As shown in FIG. 23, the discrimination system of the first coin damage discriminating unit 90 includes an R data memory 135 for storing R data of the lower surface of the coin 1 obtained by photoelectrically detecting light reflected from the lower surface of the coin 1 by the photosensor 134 and digitizing the detected data by the A/D converter 110, a G data memory 136 for storing G data of the lower surface of the coin 1 obtained in the same manner, a B data memory 137 for storing B data of the lower surface of the coin 1 obtained in the same manner, a reference data memory 112 for storing reference chromaticity data and reference lightness data of coins of each denomination, and a coin damage discriminating section 139 for calculating chromaticity data of the lower surface of the coin 1 based on R data stored in the R data memory 135, G data stored in the G data memory 136 and B data stored in the B data memory 137, comparing the thus calculated chromaticity data with the reference chromaticity data stored in the reference data memory 112, thereby determining the denomination of the coin 1 based on the chromaticity data, and outputting the denomination discrimination signal to the denomination and acceptability determining means 46. The coin damage discriminating section 139 is further adapted for calculating lightness data of the lower surface of the coin 1 based on R data stored in the R data memory 135, G data stored in the G data memory 136 and B data stored in the B data memory 137, comparing the thus calculated chromaticity data and lightness data of the lower surface of the coin 1 with the reference chromaticity data and the reference lightness data stored in the reference data memory 112, determining whether or not the coin 1 is damaged to higher than a predetermined level in the same manner as in the coin damage discriminating section 52 and the coin damage discriminating section 62, outputting a damage discrimination signal to the denomination and acceptability determining means 46 when it determines that the coin 1 is damaged to higher than a predetermined level, and causing a display means (not shown) to display that the coin 1 is damaged to higher than a predetermined level.

In this embodiment, the first LED light source 130, the second LED light source 131, the third LED light source 132 and the photosensor 134 are controlled by the timing control means 95. The reason why they are controlled by a single timing control means 95 is because this ensures that R data obtained by the photosensor 134 detecting light emitted from the first LED light source 130 for emitting light corresponding to R component, reflected by the coin 1 and digitized by the A/D converter 110 are stored as detected data in the R data memory 135, that G data obtained by the photosensor 134 detecting light emitted from the second LED light source 131 for emitting light corresponding to G component, reflected by the coin 1 and digitized by the A/D converter 110 are stored as detected data in the G data memory 136, and that B data obtained by the photosensor 134 detecting light emitted from the third LED light source 132 for emitting light corresponding to B component, reflected by the coin 1 and digitized by the A/D converter 110 are stored as detected data in the B data memory 137.

Figure 24:
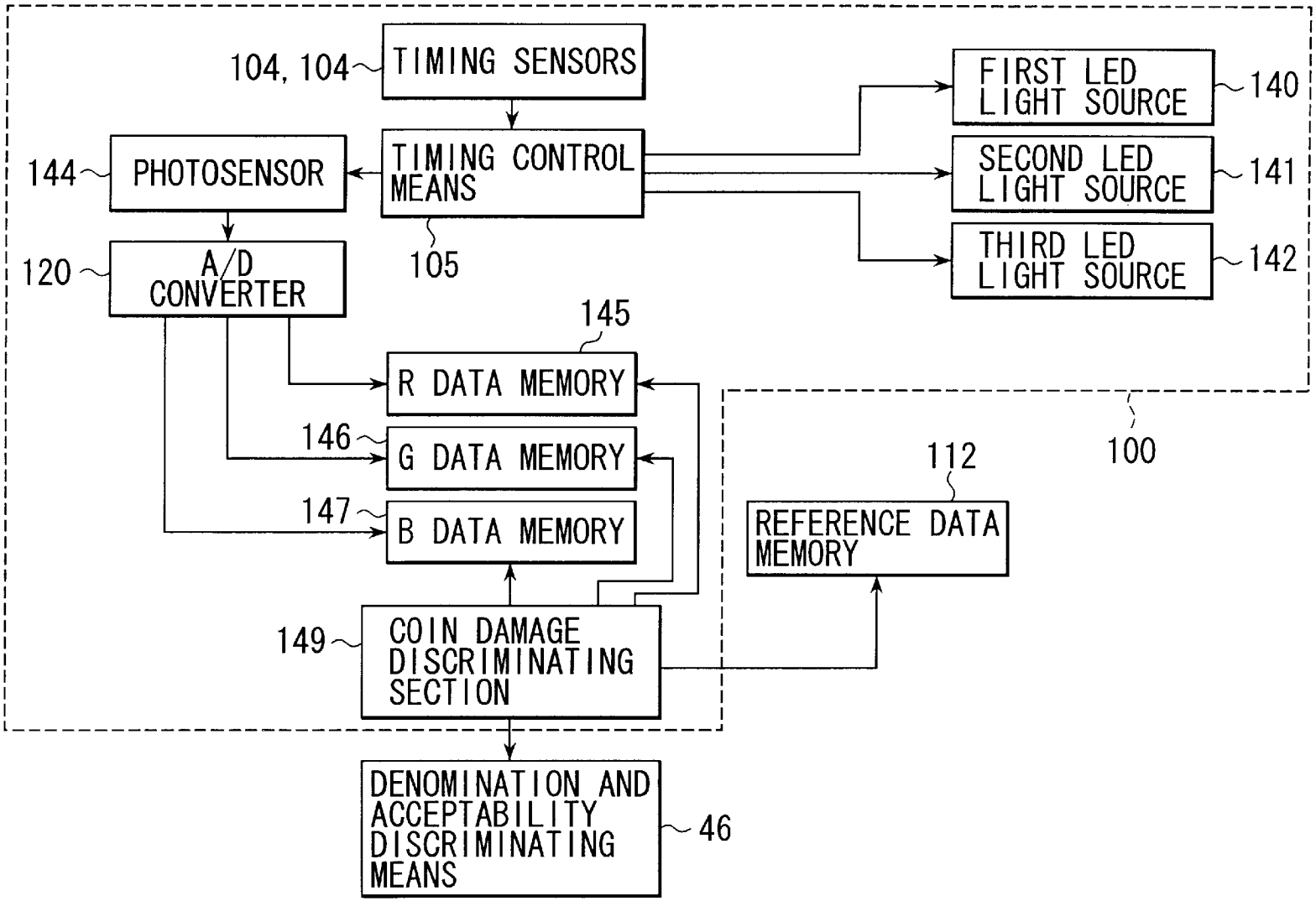
FIG. 24 is a block diagram of detection, control and discrimination systems of a second coin damage discriminating unit.

FIG. 24 is a block diagram of detection, control and discrimination systems of the second coin damage discriminating unit 100.

As shown in FIG. 24, the detection system of the second coin damage discriminating unit 100 includes the timing sensors 104, 104.

As shown in FIG. 24, the control system of the second coin damage discriminating unit 100 includes timing control means 105 for controlling the first LED light source 140, the second LED light source 141 and the third LED light source 142 in accordance with detection signals from the timing sensors 104, 104 and controlling the photosensor 144 in accordance with detection signals from the timing sensors 104, 104.

As shown in FIG. 24, the discrimination system of the second coin damage discriminating unit 100 includes an R data memory 145 for storing R data of the upper surface of the coin 1 obtained by photoelectrically detecting light reflected from the upper surface of the coin 1 by the photosensor 144 and digitizing the detected data by the A/D converter 120, a G data memory 146 for storing G data of the upper surface of the coin 1 obtained in the same manner, a B data memory 147 for storing B data of the upper surface of the coin 1 obtained in the same manner, and a coin damage discriminating section 149 for calculating chromaticity data of the lower surface of the coin 1 based on R data stored in the R data memory 145, G data stored in the G data memory 146 and B data stored in the B data memory 147, comparing the thus calculated chromaticity data with the reference chromaticity data stored in the reference data memory 112, thereby determining the denomination of the coin 1 based on the chromaticity data, and outputting a denomination discrimination signal to the denomination and acceptability determining means 46. The coin damage discriminating section 149 is further adapted for calculating lightness data of the upper surface of the coin 1 based on R data stored in the R data memory 145, G data stored in the G data memory 146 and B data stored in the B data memory 147, comparing the thus calculated chromaticity data and lightness data of the upper surface of the coin 1 with the reference chromaticity data and the reference lightness data stored in the reference data memory 112, determining whether or not the coin 1 is damaged to higher than a predetermined level in the same manner as in the coin damage discriminating section 52 and the coin damage discriminating section 62, outputting a damage discrimination signal to the denomination and acceptability determining means 46 when it determines that the coin 1 is damaged to higher than a predetermined level, and causing a display means (not shown) to display that the coin 1 is damaged to higher than a predetermined level.

In this embodiment, the first LED light source 140, the second LED light source 141, the third LED light source 142 and the photosensor 144 are controlled by the timing control means 105. The reason why they are controlled by a single timing control means 105 is because this ensures that R data obtained by the photosensor 144 detecting light emitted from the first LED light source 140 for emitting light corresponding to R component, reflected by the coin 1 and digitized by the A/D converter 120 are stored as detected data in the R data memory 145, that G data obtained by the photosensor 144 detecting light emitted from the second LED light source 141 for emitting light corresponding to G component, reflected by the coin 1 and digitized by the A/D converter 120 are stored as detected data in the G data memory 146, and that B data obtained by the photosensor 144 detecting light emitted from the third LED light source 142 for emitting light corresponding to B component, reflected by the coin 1 and digitized by the A/D converter 120 are stored as detected data in the B data memory 147.

In the thus constituted coin discriminating apparatus according to this embodiment, the first coin damage discriminating unit 90 and the second coin damage discriminating unit 100 discriminate whether or not the coin 1 is damaged to higher than a predetermined level in the following manner.

When the timing sensors 94, 94 detect the coin 1, the timing signals are output to the timing control means 95.

When the timing control means 95 receives the timing signals from the timing sensors 94, 94, it turns on the first LED light source 130 from the time T1 to the time T2 and simultaneously causes the photosensor 134 to start detecting light.

Light emitted from the first LED light source 130 and reflected by the lower surface of the coin 1 is photoelectrically detected by the photosensor 134 to produce R data of the lower surface of the coin 1. The thus produced R data are stored in the R data memory 135.

At the time T2, the timing control means 95 turns off the first LED light source 130 and turns on the second LED light source 131 from the time T2 to the time T3.

Light emitted from the second LED light source 131 and reflected by the lower surface of the coin 1 is photoelectrically detected by the photosensor 134 to produce G data of the lower surface of the coin 1. The thus produced G data are stored in the G data memory 136.

At the time T3, the timing control means 95 turns off the second LED light source 131 and turns on the third LED light source 132 from the time T3 to the time T4.

Light emitted from the third LED light source 132 and reflected by the lower surface of the coin 1 is photoelectrically detected by the photosensor 134 to produce B data of the lower surface of the coin 1. The thus produced B data are stored in the B data memory 137.

When the R data, the G data and the B data of the lower surface of the coin 1 have been stored in the R data memory 135, the G data memory 136 and the B data memory 137 respectively in this manner, the coin damage discriminating section 139 reads from the reference data memory 112, in accordance with the detection signals from the first pattern data detection unit 10 and the second pattern data detection unit 20, the reference chromaticity data and the reference lightness data of a coin of the denomination detected by the first pattern data detection unit 10 and the second pattern data detection unit 20 and also reads the R data, the G data and the B data from the R data memory 135, the G data memory 136 and the B data memory 137, respectively, thereby calculating the chromaticity data of the lower surface of the coin 1. The coin damage discriminating section 139 then compares the thus calculated chromaticity data of the lower surface of the coin 1 with the reference chromaticity data, thereby discriminating the denomination of the coin 1 based on the chromaticity data and outputs a denomination discrimination signal to the denomination and acceptability determining means 46. The coin damage discriminating section 139 further calculates the lightness data of the lower surface of the coin 1 based on the R data, the G date and the B data read from the R data memory 135, the G data memory 136 and the B data memory 137, respectively, compares the chromaticity data and calculates the lightness data of the lower surface of the coin 1 with the reference chromaticity data and the reference lightness data and discriminates whether the lower surface of the coin 1 is damaged to higher than a predetermined level in the same manner as in the coin damage discriminating section 52 and the coin damage discriminating section 62. As a result, when the coin damage discriminating section 139 determines that the lower surface of the coin 1 is damaged to higher than a predetermined level, it outputs the coin damage discrimination signal to the denomination and acceptability determining means 46 and the display means (not shown) and causes the display means to display that the lower surface of the coin 1 is damaged to higher than a predetermined level.

The coin 1 is further fed downstream in the coin passage 2 and when the timing sensors 104, 104 detect the coin 1, the detection signals are output to the timing control means 105.

When the timing control means 105 receives the timing signals from the timing sensors 104, 104, it turns on the first LED light source 140 from the time T1 to the time T2 and simultaneously causes the photosensor 144 to start detecting light.

Light emitted from the first LED light source 140 and reflected by the upper surface of the coin 1 is photoelectrically detected by the photosensor 144 to produce R data of the upper surface of the coin 1. The thus produced R data are stored in the R data memory 145.

At the time T2, the timing control means 105 turns off the first LED light source 140 and turns on the second LED light source 141 from the time T2 to the time T3.

Light emitted from the second LED light source 141 and reflected by the upper surface of the coin 1 is photoelectrically detected by the photosensor 144 to produce G data of the upper surface of the coin 1. The thus produced G data are stored in the G data memory 146.

At the time T3, the timing control means 105 turns off the second LED light source 141 and turns on the third LED light source 142 from the time T3 to the time T4.

Light emitted from the third LED light source 142 and reflected by the upper surface of the coin 1 is photoelectrically detected by the photosensor 144 to produce B data of the upper surface of the coin 1. The thus produced B data are stored in the B data memory 147.

When the R data, the G data and the B data of the upper surface of the coin 1 have been stored in the R data memory 145, the G data memory 146 and the B data memory 147 respectively in this manner, the coin damage discriminating section 149 reads from the reference data memory 112, in accordance with the detection signals from the first pattern data detection unit 10 and the second pattern data detection unit 20, the reference chromaticity data and the reference lightness data of a coin of the denomination detected by the first pattern data detection unit 10 and the second pattern data detection unit 20 and also reads the R data, the G data and the B data from the R data memory 145, the G data memory 146 and the B data memory 147 respectively, thereby calculating the chromaticity data of the upper surface of the coin 1. The coin damage discriminating section 149 then compares the thus calculated chromaticity data of the upper surface of the coin 1 with the reference chromaticity data, thereby discriminating the denomination of the coin 1 based on the chromaticity data and outputs a denomination discrimination signal to the denomination and acceptability determining means 46. The coin damage discriminating section 149 further calculates the lightness data of the upper surface of the coin 1 based on the R data, the G date and the B data read from the R data memory 145, the G data memory 146 and the B data memory 147 respectively, compares the chromaticity data and calculates the lightness data of the upper surface of the coin 1 with the reference chromaticity data and the reference lightness data and discriminates whether the upper surface of the coin 1 is damaged to higher than a predetermined level in the same manner as in the coin damage discriminating section 52 and the coin damage discriminating section 62. As a result, when the coin damage discriminating section 149 determines that the upper surface of the coin 1 is damaged to higher than a predetermined level, it outputs the coin damage discrimination signal to the denomination and acceptability determining means 46 and the display means (not shown) and causes the display means to display that the upper surface of the coin 1 is damaged to higher than a predetermined level.

Even though the denominations of coins are different, the compositions and materials may perchance to coincide with each other, and therefore, when the denomination of the coin 1 is discriminated based on the chromaticity data, two or more denominations may match. In this embodiment, in such a case, the coin damage discriminating section 139 and the coin damage discriminating section 149 are constituted so as to output two or more denomination discrimination signals to the denomination and acceptability determining means 46.

The denomination and acceptability determining means 46 finally discriminates whether or not the coin 1 is acceptable and the denomination of the coin 1 based on the denomination discrimination signals input from the coin damage discriminating section 139 and the coin damage discriminating section 149, in addition to the result of the discrimination made based on magnetic properties of the coin 1 detected by the magnetic sensors 6, 6, and the results of discrimination made by the first pattern data detection unit 10 and the second pattern data detection unit 20 based on the diameter of the coin 1 and the patterns of the obverse and reverse surfaces of the coin 1.

According to the above described embodiment, the first pattern data detection unit 10 and the second pattern data detection unit 20 detect the patterns of both surfaces of the coin 1 and whether or not the coin 1 is acceptable and the denomination of the coin 1 are discriminated. Therefore, it is possible to sort coins such as Euro coins, on one surface of which a common pattern is formed and on the other surface of which a different pattern is formed, depending upon the issuing countries into coins of each issuing country, as occasion demands. Further, since both surfaces of the coin 1 are detected by the first coin damage discriminating unit 90 and the second coin damage discriminating unit 100 for discriminating whether or not the coin 1 is damaged to higher than a predetermined level, it is possible to reliably discriminate the coin one of the surfaces of which is damaged to higher than a predetermined level as a damaged coin and collect it.

The present invention has thus been shown and described with reference to specific embodiments. However, it should be noted that the present invention is in no way limited to the details of the described arrangements but changes and modifications may be made without departing from the scope of the appended claims.

For example, in the above described embodiments, the denomination and acceptability determining means 46 finally discriminates whether or not the coin 1 is acceptable and the denomination of the coin 1 based on the results of discrimination made by the first discriminating means 43, the second discriminating means 44 and the third discriminating means 45. However, if the result of discrimination made by the second discriminating means 44 is input to the denomination discriminating section 66 of the third discriminating means 45 and only when the results of discrimination made by the denomination discriminating section 66 of the third discriminating means 45 and the second discriminating means 44 coincide with each other, the denomination discriminating section 66 discriminates that the coin 1 is acceptable and that the coin 1 is a coin of the denomination discriminated by the denomination discriminating section 66 and the second discriminating means 44, it is not absolutely necessary to provide the denomination and acceptability determining means 46.

Further, in the above described embodiments, the second pattern data detection unit 20 is provided downstream of the first pattern data detection unit 10 and the second coin damage discriminating unit 100 is provided downstream of the first coin damage discriminating unit 90. However, the first pattern data detection unit 10 and the second pattern data detection unit 20 may be provided on the opposite sides of the coin passage 2 so as to face each other or the first coin damage discriminating unit 90 and the second coin damage discriminating unit 100 may be provided on the opposite sides of the coin passage 2 so as to face each other. In such a case, one of the two pairs of the timing sensors 17, 17 and 28, 28 may be omitted or one of the two pairs of the timing sensors 94, 94 and 104, 104 may be omitted.

Furthermore, in the embodiment shown in FIGS. 17 to 19 and the embodiment shown in FIGS. 20 to 24, the second pattern data detection unit 20 is provided downstream of the first pattern data detection unit 10, the first coin damage discriminating unit 90 is provided downstream of the second pattern data detection unit 20 and the second coin damage discriminating unit 100 is provided downstream of the first coin damage discriminating unit 90. However, the first coin damage discriminating unit 90 may be provided downstream of the first pattern data detection unit 10, the second pattern data detection unit 20 may be provided downstream of the first coin damage discriminating unit 90 and the second coin damage discriminating unit 100 may be provided downstream of the second pattern data detection unit 20. In such a case, whether or not the coin 1 is acceptable, the denomination of the coin 1 and the degree of coin damage can be discriminated by detecting the pattern, the chromaticity and the lightness of the lower surface of the coin 1 while the coin is being transported by the transporting belt 3*a* disposed above the coin passage 2 and whether or not the coin 1 is acceptable, the denomination of the coin 1 and the degree of coin damage can be discriminated by detecting the pattern, the chromaticity and the lightness of the upper surface of the coin 1 while the coin is being transported by the transporting belt 4*a* disposed below the coin passage 2. Therefore, the structure of the transporting belts can be simplified.

Moreover, in the embodiment shown in FIGS. 17 to 19 and the embodiment shown in FIGS. 20 to 24, the single detection element type color sensors are employed as the color sensors 93, 103 and the photosensors 134, 144. Therefore, it may be constituted so that when the coin is transported to a predetermined position, light reflected from the coin 1 is detected by the color sensors 93, 103 and the photosensors 134, 144 by permanently actuating the white light sources 92, 102 and actuating the first LED light sources 130, 140, the second LED light sources 131, 141 and the third LED light sources 132, 142 in a time-sharing manner during the time period between the time T1 and the time T4 and also actuating them at the same timing after the time T4 and that the two sets of the timing sensors 94, 94, 104, 104 can be omitted by causing the color sensors 93, 103 and the photosensors 134, 144 to permanently monitor the reflected light.

Further, in the embodiment shown in FIGS. 17 to 19 and the embodiment shown in FIGS. 20 to 24, the coin damage discriminating sections 116, 126, 139, 149 calculate the chromaticity data and the lightness data of the coin 1 based on the color data of the obverse and reverse surfaces obtained from the color sensors 93, 103 and the photosensors 134, 144, read, in accordance with the detection signals from the first pattern data detection unit 10 and the second pattern data detection unit 20, the reference chromaticity and the reference lightness data of a coin of the denomination determined by the first pattern data detection unit 10 and the second pattern data detection unit 20 from the reference data memory 112, compare the calculated chromaticity data and lightness data with the reference chromaticity and the reference lightness data, thereby discriminating the denomination of the coin 1 based on the chromaticity data, output the denomination discrimination signal and discriminate the degree of damage of the coin 1 based on the chromaticity data and the lightness data. However, magnetic sensors may be respectively provided in the coin passage 2 at the upstream portions of the first coin damage determining unit 90 and the second coin damage determining unit 100 for detecting magnetic properties of the coin 1, thereby discriminating the denomination of the coin 1 and the coin damage discriminating sections 116, 126, 139, 149 may be constituted so as to read, in accordance with detection signals of the magnetic sensors, the reference chromaticity and the reference lightness data of a coin of the denomination determined by the magnetic sensors from the reference data memory 112 and compare the calculated chromaticity data and lightness data of the coin 1 with the reference chromaticity and the reference lightness data. Alternatively, the coin damage discriminating sections 116, 126, 139, 149 may be constituted so as read, based on only the color data obtained from the color sensors 93, 103 and the photosensors 134, 144, the reference chromaticity and the reference lightness data of a coin of the corresponding denomination from the reference data memory 112 and compare the calculated chromaticity data and lightness data of the coin 1 with the reference chromaticity and the reference lightness data.

Furthermore, in the above described embodiments, when the timing sensors 17, 17, 28, 28, 94, 94, 104, 104 detect the coin 1, light emission signals are output to the light emitting means 7, 21, the white light sources 92, 102, the first LED light sources 130, 140, the second LED light sources 131, 141 and the third LED light sources 132, 142, thereby illuminating the coin 1 with light and light reflected from the coin 1 is detected by the color sensors 13, 25, 93, 103 and the photosensors 134, 144. However, by permanently actuating the light emitting means 7, 21 and the white light sources 92, 102, actuating the first LED light sources 130, 140, the second LED light sources 131, 141 and the third LED light sources 132, 142 in the time-sharing manner and actuating them at the same timing in a time-sharing manner after the time T4, it may be constituted so that when the timing sensors 17, 17, 28, 28, 94, 94, 104, 104 detect the coin 1, light reflected by the coin 1 is detected by the color sensors 13, 25, 93, 103 and the photosensors 134, 144 to store the image pattern data produced by the color sensors 13, 25 in the image pattern data memories 50, 60, store the color data produced by the color sensors 93, 103 in the color data memories 111, 112 or store R data produced by the photosensors 134, 144 in the R data memories 135, 145, the G data produced by the photosensors 134, 144 in the G data memories 136, 146 and the B data produced by the photosensors 134, 144 in the B data memories 137, 147.

Moreover, in the above described embodiments, the coin damage discriminating sections 116, 126, 139, 149 calculate the chromaticity data and lightness data of the coin 1 based on the R data, G data and B data detected by the color sensors 93, 103 and the photosensors 134, 144. However, the chromaticity data of the coin 1 can be calculated from two kinds of the color data among the R data, G data and B data corresponding to the primaries of light and the lightness data of the coin 1 can be calculated from one kind of color data among the R data, G data and B data. Therefore, it is not absolutely necessary to store all of the R data, G data and R data of the coin 1 and it is not absolutely necessary to read all of the R data, G data and R data of the coin 1 and calculate the chromaticity data and lightness data of the coin 1.

Further, in this specification and the appended claims, the respective means need not necessarily be physical means and arrangements whereby the functions of the respective means are accomplished by software fall within the scope of the present invention. In addition, the function of a single means may be accomplished by two or more physical means and the functions of two or more means may be accomplished by a single physical means.

According to the present invention, it is possible to provide a coin discriminating apparatus capable of discriminating whether or not coins are acceptable and the denominations of coins with high accuracy even when coins has a common pattern on one side surface thereof but a different pattern on the other side surface thereof like Euro coins.

Further, according to the present invention, it is possible to provide a coin discriminating apparatus capable of discriminating whether or not coins are damaged to higher than a predetermined level with high accuracy.

What is claimed is:

1. A coin discriminating apparatus comprising a first light source for projecting light onto one surface of a coin being transported, a second light source for projecting light onto the other surface of a coin being transported, a first light detecting means for photoelectrically receiving light emitted from the first light source and reflected by the one surface of the coin and producing image pattern data of the one surface of the coin, first pattern data storing means for storing the image pattern data of the one surface of the coin produced by the first light detecting means, a second light detecting means for photoelectrically receiving light emitted from the second light source and reflected by the other surface of the coin and producing image pattern data of the other surface of the coin, second pattern data storing means for storing the image pattern data of the other surface of the coin produced by the second light detecting means, reference data storing means for storing reference data of coins of each denomination, discriminating means for comparing the image pattern data of the one surface of the coin stored in the first pattern data storing means with the reference data of coins of each denomination stored in the reference data storing means and comparing the image pattern data of the other surface of the coin stored in the second pattern data storing means with the reference data of coins of each denomination stored in the reference data storing means, thereby discriminating whether or not the coin is acceptable and the denomination of the coin.

2. A coin discriminating apparatus in accordance with claim 1 wherein the first light detecting means and the second light detecting means are constituted as color sensor means capable of producing color image data, the reference data storing means stores reference chromaticity data and reference lightness data of coins of each denomination, and the discriminating means further comprises first damage degree discriminating means for calculating chromaticity data and lightness data of the one surface of the coin based on R data, G data and B data corresponding to the primaries of light in the image pattern data of the one surface of the coin stored in the first pattern data storing means, comparing the thus calculated chromaticity data and lightness data with the reference chromaticity data and the reference lightness data of coins of each denomination stored in the reference data storing means and discriminating the damage degree of the one surface of the coin and second damage degree discriminating means for calculating chromaticity data and lightness data of the other surface of the coin based on R data, G data and B data corresponding to the primaries of light in the image pattern data of the other surface of the coin stored in the second pattern data storing means, comparing the thus calculated chromaticity data and lightness data with the reference chromaticity data and the reference lightness data of coins of each denomination stored in the reference data storing means and discriminating the damage degree of the other surface of the coin.

3. A coin discriminating apparatus in accordance with claim 1 wherein the reference data storing means is constituted so as to store the reference chromaticity data and the reference lightness data, the coin discriminating apparatus further comprising a first white light source for emitting white light onto the one surface of the coin, a second white light source for emitting white light onto the other surface of the coin, first color sensor means for photoelectrically detecting light emitted from the first white light source and reflected by the one surface of the coin and producing color image data of the one surface of the coin, first color image data storing means for storing the color data of the one surface of the coin produced by the first color sensor means, second color sensor means for photoelectrically detecting light emitted from the second white light source and reflected by the other surface of the coin and producing color image data of the other surface of the coin, second color image data storing means for storing the color data of the other surface of the coin produced by the second color sensor means, and coin damage degree discriminating means, the coin damage degree discriminating means comprising first damage degree discriminating means for calculating chromaticity data and lightness data of the one surface of the coin based on R data, G data and B data corresponding to the primaries of light in the color image data of the one surface of the coin stored in the first color image data storing means, comparing the thus calculated chromaticity data and lightness data with the reference chromaticity data and the reference lightness data of coins of each denomination stored in the reference data storing means and discriminating the damage degree of the one surface of the coin and second damage degree discriminating means for calculating chromaticity data and lightness data of the other surface of the coin based on R data, G data and B data corresponding to the primaries of light in the image pattern data of the other surface of the coin stored in the second color image data storing means, comparing the thus calculated chromaticity data and lightness data with the reference chromaticity data and the reference lightness data of coins of each denomination stored in the reference data storing means and discriminating the damage degree of the other surface of the coin.

4. A coin discriminating apparatus in accordance with claim 1 wherein the reference data storing means is constituted so as to store the reference chromaticity data and the reference lightness data, the coin discriminating apparatus further comprising a first R component light source for emitting light of the R component onto the one surface of the coin, a first G component light source for emitting light of G component onto the one surface of the coin, a first B component light source for emitting light of the B component onto the one surface of the coin, first photosensor means for photoelectrically detecting light emitted from the first R component light source, the first G component light source and the first B component light source and reflected by the one surface of the coin and producing R image data, G image data and B image data of the one surface of the coin, first image data storing means for storing the R image data, the G image data and the B image data of the one surface of the coin produced by the first photosensor means, a second R component light source for emitting light of the R component onto the other surface of the coin, a second G component light source for emitting light of G component onto the other surface of the coin, a second B component light source for emitting light of the B component onto the other surface of the coin, second photosensor means for photoelectrically detecting light emitted from the second R component light source, the second G component light source and the second B component light source and reflected by the other surface of the coin and producing R image data, G image data and B image data of the other surface of the coin, second image data storing means for storing the R image data, the G image data and the B image data of the other surface of the coin produced by the second photosensor means, and coin damage degree discriminating means, the coin damage degree discriminating means comprising first damage degree discriminating means for calculating chromaticity data and lightness data of the one surface of the coin based on the R image data, the G image data and the B image data of the one surface of the coin stored in the first image data storing means, comparing the thus calculated chromaticity data and lightness data with the reference chromaticity data and the reference lightness data of coins of each denomination stored in the reference data storing means and discriminating the damage degree of the one surface of the coin and second damage degree discriminating means for calculating chromaticity data and lightness data of the other surface of the coin based on the R image data, the G image data and the B image data of the other surface of the coin stored in the second image data storing means, comparing the thus calculated chromaticity data and lightness data with the reference chromaticity data and the reference lightness data of coins of each denomination stored in the reference data storing means and discriminating the damage degree of the other surface of the coin.

5. A coin discriminating apparatus in accordance with claim 1 which further comprises magnetic sensor means disposed upstream of the first light source with respect to a direction of transportation of coins for detecting magnetic properties of coins, a reference magnetic data memory for storing reference magnetic data indicating the magnetic properties of coins of each denomination, and tentative denomination discriminating means for discriminating the denomination of a coin based on the reference magnetic data of coins of each denomination stored in the reference magnetic data memory and the magnetic properties of the coin detected by the magnetic sensor means, the reference data storing means storing reference image pattern data of coins of each denomination, the discriminating means comprising first discriminating means for discriminating the denomination of the coin based on the image pattern data of the one surface of the coin and second discriminating means for discriminating the denomination of the coin based on the image pattern data of the other surface of the coin, the first discriminating means comprising first denomination discriminating means for discriminating the denomination of the coin in accordance with diameter of the coin based on the image pattern data of the one surface of the coin stored in the first pattern data storing means and second denomination discriminating means for discriminating whether or not the coin is acceptable based on a result of discrimination made by the tentative denomination discriminating means and a result of discrimination made by the first denomination discriminating means, reading, based on the result of discrimination made by the tentative denomination discriminating means and the result of discrimination made by the first denomination discriminating means, the reference image pattern data of the corresponding denomination from the reference data storing means and comparing the thus read reference image pattern data with the image pattern data of the one surface of the coin stored in the first pattern data storing means, thereby discriminating the denomination of the coin, the second discriminating means comprising third denomination discriminating means for discriminating the denomination of the coin in accordance with diameter of the coin based on the image pattern data of the other surface of the coin stored in the second pattern data storing means and fourth denomination discriminating means for discriminating whether or not the coin is acceptable based on a result of discrimination made by the tentative denomination discriminating means and a result of discrimination made by the third denomination discriminating means, reading, based on the result of discrimination made by the tentative denomination discriminating means and the result of discrimination made by the third denomination discriminating means, the reference image pattern data of the corresponding denomination from the reference data storing means and comparing the thus read reference image pattern data with the image pattern data of the other surface of the coin stored in the second pattern data storing means, thereby discriminating the denomination of the coin.

6. A coin discriminating apparatus in accordance with claim 2 which further comprises magnetic sensor means disposed upstream of the first light source with respect to a direction of transportation of coins for detecting magnetic properties of coins, a reference magnetic data memory for storing reference magnetic data indicating the magnetic properties of coins of each denomination, and tentative denomination discriminating means for discriminating the denomination of a coin based on the reference magnetic data of coins of each denomination stored in the reference magnetic data memory and the magnetic properties of the coin detected by the magnetic sensor means, the reference data storing means storing reference image pattern data of coins of each denomination, the discriminating means comprising first discriminating means for discriminating the denomination of the coin based on the image pattern data of the one surface of the coin and second discriminating means for discriminating the denomination of the coin based on the image pattern data of the other surface of the coin, the first discriminating means comprising first denomination discriminating means for discriminating the denomination of the coin in accordance with diameter of the coin based on the image pattern data of the one surface of the coin stored in the first pattern data storing means and second denomination discriminating means for discriminating whether or not the coin is acceptable based on a result of discrimination made by the tentative denomination discriminating means and a result of discrimination made by the first denomination discriminating means, reading, based on the result of discrimination made by the tentative denomination discriminating means and the result of discrimination made by the first denomination discriminating means, the reference image pattern data of the corresponding denomination from the reference data storing means and comparing the thus read reference image pattern data with the image pattern data of the one surface of the coin stored in the first pattern data storing means, thereby discriminating the denomination of the coin, the second discriminating means comprising third denomination discriminating means for discriminating the denomination of the coin in accordance with diameter of the coin based on the image pattern data of the other surface of the coin stored in the second pattern data storing means and fourth denomination discriminating means for discriminating whether or not the coin is acceptable based on a result of discrimination made by the tentative denomination discriminating means and a result of discrimination made by the third denomination discriminating means, reading, based on the result of discrimination made by the tentative denomination discriminating means and the result of discrimination made by the third denomination discriminating means, the reference image pattern data of the corresponding denomination from the reference data storing means and comparing the thus read reference image pattern data with the image pattern data of the other surface of the coin stored in the second pattern data storing means, thereby discriminating the denomination of the coin.

7. A coin discriminating apparatus in accordance with claim 3 which further comprises magnetic sensor means disposed upstream of the first light source with respect to a direction of transportation of coins for detecting magnetic properties of coins, a reference magnetic data memory for storing reference magnetic data indicating the magnetic properties of coins of each denomination, and tentative denomination discriminating means for discriminating the denomination of a coin based on the reference magnetic data of coins of each denomination stored in the reference magnetic data memory and the magnetic properties of the coin detected by the magnetic sensor means, the reference data storing means storing reference image pattern data of coins of each denomination, the discriminating means comprising first discriminating means for discriminating the denomination of the coin based on the image pattern data of the one surface of the coin and second discriminating means for discriminating the denomination of the coin based on the image pattern data of the other surface of the coin, the first discriminating means comprising first denomination discriminating means for discriminating the denomination of the coin in accordance with diameter of the coin based on the image pattern data of the one surface of the coin stored in the first pattern data storing means and second denomination discriminating means for discriminating whether or not the coin is acceptable based on a result of discrimination made by the tentative denomination discriminating means and a result of discrimination made by the first denomination discriminating means, reading, based on the result of discrimination made by the tentative denomination discriminating means and the result of discrimination made by the first denomination discriminating means, the reference image pattern data of the corresponding denomination from the reference data storing means and comparing the thus read reference image pattern data with the image pattern data of the one surface of the coin stored in the first pattern data storing means, thereby discriminating the denomination of the coin, the second discriminating means comprising third denomination discriminating means for discriminating the denomination of the coin in accordance with diameter of the coin based on the image pattern data of the other surface of the coin stored in the second pattern data storing means and fourth denomination discriminating means for discriminating whether or not the coin is acceptable based on a result of discrimination made by the tentative denomination discriminating means and a result of discrimination made by the third denomination discriminating means, reading, based on the result of discrimination made by the tentative denomination discriminating means and the result of discrimination made by the third denomination discriminating means, the reference image pattern data of the corresponding denomination from the reference data storing means and comparing the thus read reference image pattern data with the image pattern data of the other surface of the coin stored in the second pattern data storing means, thereby discriminating the denomination of the coin.

8. A coin discriminating apparatus in accordance with claim 4 which further comprises magnetic sensor means disposed upstream of the first light source with respect to a direction of transportation of coins for detecting magnetic properties of coins, a reference magnetic data memory for storing reference magnetic data indicating the magnetic properties of coins of each denomination, and tentative denomination discriminating means for discriminating the denomination of a coin based on the reference magnetic data of coins of each denomination stored in the reference magnetic data memory and the magnetic properties of the coin detected by the magnetic sensor means, the reference data storing means storing reference image pattern data of coins of each denomination, the discriminating means comprising first discriminating means for discriminating the denomination of the coin based on the image pattern data of the one surface of the coin and second discriminating means for discriminating the denomination of the coin based on the image pattern data of the other surface of the coin, the first discriminating means comprising first denomination discriminating means for discriminating the denomination of the coin in accordance with diameter of the coin based on the image pattern data of the one surface of the coin stored in the first pattern data storing means and second denomination discriminating means for discriminating whether or not the coin is acceptable based on a result of discrimination made by the tentative denomination discriminating means and a result of discrimination made by the first denomination discriminating means, reading, based on the result of discrimination made by the tentative denomination discriminating means and the result of discrimination made by the first denomination discriminating means, the reference image pattern data of the corresponding denomination from the reference data storing means and comparing the thus read reference image pattern data with the image pattern data of the one surface of the coin stored in the first pattern data storing means, thereby discriminating the denomination of the coin, the second discriminating means comprising third denomination discriminating means for discriminating the denomination of the coin in accordance with diameter of the coin based on the image pattern data of the other surface of the coin stored in the second pattern data storing means and fourth denomination discriminating means for discriminating whether or not the coin is acceptable based on a result of discrimination made by the tentative denomination discriminating means and a result of discrimination made by the third denomination discriminating means, reading, based on the result of discrimination made by the tentative denomination discriminating means and the result of discrimination made by the third denomination discriminating means, the reference image pattern data of the corresponding denomination from the reference data storing means and comparing the thus read reference image pattern data with the image pattern data of the other surface of the coin stored in the second pattern data storing means, thereby discriminating the denomination of the coin.

9. A coin discriminating apparatus in accordance with claim 5 wherein the discriminating means further comprises denomination discrimination means for discriminating, when the result of discrimination made by the second denomination discriminating means of the first discriminating means and the result of discrimination made by the fourth denomination discriminating means of the second discriminating means coincide with each other, that the denomination of coin agrees with the thus discriminated denomination and discriminating that the coin is unacceptable, when they do not coincide with each other.

10. A coin discriminating apparatus in accordance with claim 6 wherein the discriminating means further comprises denomination discrimination means for discriminating, when the result of discrimination made by the second denomination discriminating means of the first discriminating means and the result of discrimination made by the fourth denomination discriminating means of the second discriminating means coincide with each other, that the denomination of coin agrees with the thus discriminated denomination and discriminating that the coin is unacceptable, when they do not coincide with each other.

11. A coin discriminating apparatus in accordance with claim 7 wherein the discriminating means further comprises denomination discrimination means for discriminating, when the result of discrimination made by the second denomination discriminating means of the first discriminating means and the result of discrimination made by the fourth denomination discriminating means of the second discriminating means coincide with each other, that the denomination of coin agrees with the thus discriminated denomination and discriminating that the coin is unacceptable, when they do not coincide with each other.

12. A coin discriminating apparatus in accordance with claim 8 wherein the discriminating means further comprises denomination discrimination means for discriminating, when the result of discrimination made by the second denomination discriminating means of the first discriminating means and the result of discrimination made by the fourth denomination discriminating means of the second discriminating means coincide with each other, that the denomination of coin agrees with the thus discriminated denomination and discriminating that the coin is unacceptable, when they do not coincide with each other.

* * * * *